US011348530B2

(12) United States Patent
Choi et al.

(10) Patent No.: US 11,348,530 B2
(45) **Date of Patent: *May 31, 2022**

(54) SCAN DRIVER AND DISPLAY DEVICE HAVING THE SAME

(71) Applicant: Samsung Display Co., Ltd., Yongin-si (KR)

(72) Inventors: Yang Hwa Choi, Yongin-si (KR); Jun Hyun Park, Yongin-si (KR); Dong Woo Kim, Yongin-si (KR); Kang Moon Jo, Yongin-si (KR); Sung Jae Moon, Yongin-si (KR); An Su Lee, Yongin-si (KR); Woong Sik Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 225 days.

This patent is subject to a terminal disclaimer.

(21) Appl. No.: 16/707,994

(22) Filed: Dec. 9, 2019

(65) Prior Publication Data

US 2020/0184898 A1 Jun. 11, 2020

(30) Foreign Application Priority Data

Dec. 10, 2018 (KR) ..... 10-2018-0158527
Dec. 28, 2018 (KR) ..... 10-2018-0172335
Feb. 15, 2019 (KR) ..... 10-2019-0018064

(51) Int. Cl.
*G09G 3/3266* (2016.01)
*G09G 3/3258* (2016.01)
*G09G 3/3275* (2016.01)

(52) U.S. Cl.
CPC ..... *G09G 3/3266* (2013.01); *G09G 3/3258* (2013.01); *G09G 3/3275* (2013.01);
(Continued)

(58) Field of Classification Search
None
See application file for complete search history.

(56) References Cited

U.S. PATENT DOCUMENTS 8,912,995 B2 12/2014 Shin et al.
9,984,636 B2 5/2018 Shin et al.
(Continued)

FOREIGN PATENT DOCUMENTS

KR 10-2016-0073928 6/2016
KR 10-2017-0064179 6/2017
(Continued)

OTHER PUBLICATIONS

Notice of Allowance dated Aug. 12, 2020, in U.S. Appl. No. 16/700,968.
(Continued)

*Primary Examiner* — Benjamin X Casarez
(74) *Attorney, Agent, or Firm* — H.C. Park & Associates, PLC

(57) ABSTRACT

A stage of a scan driver includes: a first driving controller for controlling a voltage of a first node and a voltage of a second node; a second driving controller for controlling a voltage of a first driving node, based on a sensing-on signal, a next carry signal, a first control clock signal, a second control clock signal, the voltage of the first node, and a voltage of a sampling node, and controlling a voltage of a second driving node, based on the voltage of the sampling node and the voltage of the first driving node; an output buffer for outputting a carry signal, the first scan signal, and the second scan signal; and a coupling controller. The second driving controller maintains the voltage of the first driving node as a gate-off voltage in response to the voltage of the second driving node and a third control clock signal.

31 Claims, 24 Drawing Sheets

(52) U.S. Cl.
CPC ..... *G09G 2310/0291* (2013.01); *G09G 2310/061* (2013.01); *G09G 2310/08* (2013.01); *G09G 2320/04* (2013.01)

(56) References Cited

U.S. PATENT DOCUMENTS

| | | | | |
|---|---|---|---|---|
| 10,878,745 | B2 * | 12/2020 | Park | G09G 3/3266 |
| 10,991,314 | B2 * | 4/2021 | Park | G09G 3/3275 |
| 2012/0056858 | A1 | 3/2012 | Ahn et al. | |
| 2016/0217728 | A1 * | 7/2016 | In | G09G 3/3266 |
| 2016/0247446 | A1 * | 8/2016 | Cao | G09G 3/3225 |
| 2016/0351160 | A1 * | 12/2016 | In | G09G 3/3225 |
| 2017/0186363 | A1 * | 6/2017 | Park | G09G 3/3266 |
| 2017/0365211 | A1 | 12/2017 | Lee et al. | |
| 2018/0129352 | A1 | 5/2018 | Kim et al. | |
| 2018/0337682 | A1 | 11/2018 | Takasugi et al. | |
| 2020/0074933 | A1 * | 3/2020 | Ban | G09G 3/3283 |
| 2020/0168162 | A1 * | 5/2020 | Feng | G11C 19/28 |
| 2020/0184898 | A1 | 6/2020 | Choi et al. | |
| 2020/0193912 | A1 | 6/2020 | Park et al. | |
| 2020/0202761 | A1 | 6/2020 | Choi et al. | |
| 2020/0258446 | A1 | 8/2020 | Choi et al. | |
| 2020/0394960 | A1 * | 12/2020 | Yuan | G09G 3/3266 |
| 2021/0201805 | A1 * | 7/2021 | Feng | G09G 3/3258 |
| 2021/0248962 | A1 * | 8/2021 | Park | G09G 3/3233 |

FOREIGN PATENT DOCUMENTS

| | | |
|---|---|---|
| KR | 10-2017-0143052 | 12/2017 |
| KR | 10-1832409 | 2/2018 |
| KR | 10-2018-0031879 | 3/2018 |
| KR | 10-2018-0036855 | 4/2018 |
| KR | 10-2020-0071206 | 6/2020 |
| KR | 10-2020-0072635 | 6/2020 |
| KR | 10-2020-0077665 | 7/2020 |
| KR | 10-2020-0083763 | 7/2020 |
| KR | 10-2020-0097382 | 8/2020 |
| KR | 10-2020-0100247 | 8/2020 |

OTHER PUBLICATIONS

Notice of Allowance dated Dec. 28, 2020, in U.S. Appl. No. 16/700,968.

* cited by examiner

SCAN DRIVER AND DISPLAY DEVICE HAVING THE SAME

CROSS-REFERENCE TO RELATED APPLICATION

This application claims priority from and the benefit of Korean Patent Applications No. 10-2019-0018064, filed on Feb. 15, 2019, No. 10-2018-0172335, filed on Dec. 28, 2018, and No. 10-2018-0158527, filed on Dec. 10, 2018, which are hereby incorporated by reference for all purposes as if fully set forth herein.

BACKGROUND

Field

Exemplary embodiments of the invention relate generally to a display device, and more specifically, to a scan driver and a display device having the same.

Discussion of the Background

A display device includes a display panel, a scan driver, a data driver, a timing driver, and the like. The scan driver provides scan signals to the display panel through scan lines. To this end, the scan driver includes stage circuits for outputting scan signals, which are coupled in sequence, and each of the stage circuits is configured with a plurality of oxide thin film transistors to be operated.

Recently, the display device has performed driving for compensating for degradation or characteristic change of a driving transistor at the outside of a pixel circuit by sensing a threshold voltage or mobility of the driving transistor included in the pixel circuit. Scan methods for a display operation, a mobility sensing operation, and a threshold voltage sensing operation are different from one another. Studies on a scan driver for stably performing operations using such various methods and a stage circuit of the scan driver have been conducted.

The above information disclosed in this Background section is only for understanding of the background of the inventive concepts, and, therefore, it may contain information that does not constitute prior art.

SUMMARY

Devices constructed according to exemplary embodiments of the invention are capable of provide a scan driver for outputting a scan signal and a sensing signal, each of which has a stable pulse, by controlling voltages of a first driving node and a second driving node, and a display device having the same.

Additional features of the inventive concepts will be set forth in the description which follows, and in part will be apparent from the description, or may be learned by practice of the inventive concepts.

According to one or more exemplary embodiments of the invention, a scan driver includes: a plurality of stages each configured to output a first scan signal and a second scan signal, each of the plurality of stages including: a first driving controller configured to control a voltage of a first node and a voltage of a second node in response to a previous carry signal; a second driving controller configured to control a voltage of a first driving node, based on a sensing-on signal, a next carry signal, a first control clock signal, a second control clock signal, the voltage of the first node, and a voltage of a sampling node, and control a voltage of a second driving node, based on the voltage of the sampling node and the voltage of the first driving node; an output buffer configured to output a carry signal in response to the voltage of the first node and the voltage of the second node, and output the first scan signal and the second scan signal in response to the voltage of the first driving node and the voltage of the second driving node; and a coupling controller configured to electrically couple the first node and the first driving node to each other and electrically couple the second node and the second driving node to each other, in response to a display-on signal, wherein the second driving controller is configured to maintain the voltage of the first driving node as a gate-off voltage in response to the voltage of the second driving node and a third control clock signal, wherein the previous carry signal refers to a carry signal from a previous stage, and wherein the next carry signal refers to a carry signal from a next stage.

The second driving controller may include a fourteenth transistor and a fifteenth transistor coupled in series between a carry output terminal outputting the carry signal and the first driving node. A gate electrode of the fourteenth transistor may receive the third control clock signal, and a gate electrode of the fifteenth transistor may be coupled to the second driving node.

The scan driver may be configured to receive a gate-on voltage as the third control clock signal in a vertical blank period, and maintained until a partial period of a display period continued to the vertical blank period.

The second driving controller may be configured to maintain a gate-off voltage to the first driving node in response to the fourteenth and fifteenth transistors being turned on.

The second driving controller may include: an eighth transistor coupled between an input terminal to which the next carry signal is applied and the sampling node, the eighth transistor including a gate electrode receiving the sensing-on signal; a ninth transistor and a tenth transistor coupled in series between a first control clock terminal to which the first control clock signal is applied and the first driving node; and an eleventh transistor coupled between a carry output terminal outputting the carry signal and a third node between the ninth and tenth transistors, the eleventh transistor including a gate electrode coupled to the carry output terminal.

A gate electrode of the ninth transistor may be coupled to the sampling node, and a gate electrode of the tenth transistor may be coupled to a second control clock terminal to which the second control clock signal is applied.

The second control clock signal may have a gate-on voltage in at least a portion of a vertical blank period, and maintain a gate-off voltage during a display period.

The entire gate-on voltage period of the second control clock signal may overlap with at least a portion of a gate-on voltage period of the first control clock signal.

Gate electrodes of the ninth and tenth transistors may be commonly coupled to the sampling node.

The eighth transistor may include a plurality of eighth transistors coupled in series between the input terminal and the sampling node. Gate electrodes of each of the plurality of eighth transistors may commonly receive the sensing-on signal.

The second driving controller may further include a twenty-seventh transistor coupled between a first power terminal to which a first power source is supplied and a common node between the plurality of eighth transistors, the twenty-seventh transistor including a gate electrode coupled to the sampling node.

The second driving controller may further include: a capacitor coupled between a second power terminal to which a second power source is applied and the sampling node; a twelfth transistor and a thirteenth transistor coupled in series between a third power terminal to which a third power source is applied and the second driving node; and a twenty-fifth transistor coupled between a first power terminal to which a first power source is supplied and an intermediate node between the twelfth transistor and the thirteenth transistor, the twenty-fifth transistor including a gate electrode coupled to the second driving node. The twelfth transistor may include a gate electrode coupled to the sampling node, and the thirteenth transistor may include a gate electrode coupled to the first driving node.

The first driving controller may include: a first transistor coupled between a first power terminal to which a first power source is applied and the first node, the first transistor including a gate electrode receiving the previous carry signal or a scan start signal; a second transistor and a third transistor coupled in series between the first node and a carry output terminal outputting the carry signal; a fourth transistor coupled between the first node and the carry output terminal, the fourth transistor including a gate electrode receiving the next carry signal; a fifth transistor coupled between a first clock terminal to which a first clock signal is applied and the second node, the fifth transistor including a gate electrode coupled to the first node; a sixth transistor coupled between the first power terminal and the second node, the sixth transistor including a gate electrode coupled to the first clock terminal; and a seventh transistor coupled between the first power terminal and the second node.

The seventh transistor may include a gate electrode receiving the first control clock signal.

The fifth transistor may include a plurality of fifth transistors coupled in series between the first clock terminal and the second node. Gates of the plurality of fifth transistors may be commonly coupled to the first node.

The first driving controller may further include a twenty-fourth transistor coupled between the first power terminal and a common node between the plurality of fifth transistors, the twenty-fourth transistor including a gate electrode coupled to the second node.

The output buffer may include: a sixteenth transistor coupled between a second clock terminal to which a clock signal is supplied and a carry output terminal outputting the carry signal, the sixteenth transistor including a gate electrode coupled to the first node; a seventeenth transistor coupled between a second power terminal to which a second power source is applied and the carry output terminal, the seventeenth transistor including a gate electrode coupled to the second node; an eighteenth transistor coupled between the second clock terminal and a first output terminal outputting the first scan signal, the eighteenth transistor including a gate electrode coupled to the first driving node; a nineteenth transistor coupled between a third power terminal to which a third power source is supplied and the first output terminal, the nineteenth transistor including a gate electrode coupled to the second driving node; a twentieth transistor coupled between a sensing clock terminal to which a sensing clock signal is applied and a second output terminal outputting the second scan signal, the twentieth transistor including a gate electrode coupled to the first driving node; and a twenty-first transistor coupled between the third power terminal and the second output terminal, the twenty-first transistor including a gate electrode coupled to the second driving node.

The coupling controller may include: a twenty-second transistor coupled between the first node and the first driving node, the twenty-second transistor including a gate electrode receiving the display-on signal; and a twenty-third transistor coupled between the second node and the second driving node, the twenty-third transistor including a gate electrode receiving the display-on signal.

According to one or more exemplary embodiments of the invention, a display device includes: a plurality of pixels respectively coupled to first scan lines, second scan lines, sensing lines, and data lines; a scan driver including a plurality of stages to supply a first scan signal and a second scan signal respectively to the first scan lines and the second scan lines; a data driver configured to supply a data signal to the data lines; and a compensator configured to generate a compensation value for compensating for degradation of the pixels, based on sensing values provided from the sensing lines, wherein each of the plurality of stages includes: a first driving controller configured to control a voltage of a first node and a voltage of a second node in response to a previous carry signal; a second driving controller configured to control a voltage of a first driving node, based on a sensing-on signal, a next carry signal, a first control clock signal, a second control clock signal, the voltage of the first node, and a voltage of a sampling node, and control a voltage of a second driving node, based on the voltage of the sampling node and the voltage of the first driving node; an output buffer configured to output a carry signal in response to the voltage of the first node and the voltage of the second node, and output the first scan signal and the second scan signal in response to the voltage of the first driving node and the voltage of the second driving node; and a coupling controller configured to electrically couple the first node and the first driving node to each other and electrically couple the second node and the second driving node to each other, in response to a display-on signal, wherein the second driving controller is configured to maintain the voltage of the first driving node as a gate-off voltage in response to the voltage of the second driving node and a third control clock signal, wherein the previous carry signal refers to a carry signal from a previous stage, and wherein the next carry signal refers to a carry signal from a next stage.

The second driving controller may include a fourteenth transistor and a fifteenth transistor coupled in series between a carry output terminal outputting the carry signal and the first driving node. A gate electrode of the fourteenth transistor may receive the third control clock signal, and a gate electrode of the fifteenth transistor may be coupled to the second driving node. The display device may be configured change the third control clock signal to a gate-on voltage in a vertical blank period, and maintain the gate-on voltage until a partial period of a display period continued to the vertical blank period.

According to one or more exemplary embodiments of the invention, a scan driver for a display device includes: a plurality of stages to output scan signals and sensing signals, at least one of the stages including: a first controller to control a voltage of a first node and a voltage of a second node in response to a previous carry signal or a scan start signal; a second controller to control a voltage of a first driving node, based on a sensing-on signal, a next carry signal, the voltage of a first power source, the voltage of the first node, and a voltage of a sampling node, and to control a voltage of a second driving node, based on the voltage of the sampling node and a control clock signal; an output buffer to output a carry signal in response to the voltage of the first node and the voltage of the second node, and to output the scan signal and the sensing signal in response to the voltage of the first driving node and the voltage of the second driving node; and a third controller to electrically couple the first node and the first driving node to each other and to electrically couple the second node and the second driving node to each other, in response to a display-on signal.

The output buffer may include a first output buffer configured to output a clock signal as a carry signal in response to the voltage of the first node and the voltage of the second node; a second output buffer configured to output a scan clock signal as the scan signal in response to the voltage of the first driving node and the voltage of the second driving node; and a third output buffer configured to output a sensing clock signal as a sensing signal in response to the voltage of the first driving node and the voltage of the second driving node.

The scan clock signal and the sensing clock signal may have the same waveform synchronized with the clock signal.

One frame period may include a display period and a vertical blank period. During the display period, the sensing-on signal may be supplied to at least k stages among the plurality of stages, wherein k may be a natural number.

During the vertical blank period following the display period, the at least k stages may be configured to output the scan signal in response to the scan clock signal, and output the sensing signal in response to the sensing clock signal.

The at least k stages may be configured to output the scan signal at least twice during the vertical blank period.

The at least k stages may be configured to output the sensing signal at least once during the vertical blank period.

The output of the scan signal may overlap with that of the sensing signal.

The second controller may include: an eighth transistor coupled between a first input terminal to which the subsequent carry signal is applied and the sampling node, the eighth transistor including a gate electrode that receives the sensing-on signal; a ninth transistor and a tenth transistor coupled in series between a control clock terminal to which the control clock signal is applied and the first driving node, the ninth and tenth transistors including gate electrodes commonly coupled to the sampling node; and an eleventh transistor coupled between a carry output terminal of the carry signal and a third node between the ninth and tenth transistors, the eleventh transistor including a gate electrode coupled to the first driving node.

The eleventh transistor may be configured to supply carry signal to the third node in response to the voltage of the first driving node.

The second controller may further include: a capacitor coupled between a second power terminal to which a second power source is applied and the sampling node; and a twelfth transistor and a thirteenth transistor coupled in series between a third power terminal to which a third power source is applied and the second driving node. The twelfth transistor may include a gate electrode that receives the control clock signal, and the thirteenth transistor may include a gate electrode coupled to the sampling node.

The first output buffer may include: a sixteenth transistor coupled between a second clock terminal to which the clock signal is applied and a carry output terminal, the sixteenth transistor including a gate electrode coupled to the first node; and a seventeenth transistor coupled between the carry output terminal and a second power terminal to which a second power source is applied, the seventeenth transistor including a gate electrode coupled to the second node.

The second output buffer may include: a eighteenth transistor coupled between a scan clock terminal to which the scan clock signal is applied and a first output terminal, the eighteenth transistor including a gate electrode coupled to the first driving node; and a nineteenth transistor coupled between a third power terminal to which a third power source is applied and the first output terminal, the nineteenth transistor including a gate electrode coupled to the second driving node.

The third output buffer may further include: a twentieth transistor coupled between a sensing clock terminal to which the sensing clock signal is applied and a second output terminal, the twentieth transistor including a gate electrode coupled to the first driving node; and a twenty-first transistor coupled between the third power terminal to which the third power source is applied and the second output terminal, the twenty-first transistor including a gate electrode coupled to the second driving node.

The third controller may include: a twenty-second transistor coupled between the first node and the first driving node, the twenty-second transistor including a gate electrode that receives the display-on signal; and a twenty-third transistor coupled between the second node and the second driving node, the twenty-third transistor including a gate electrode that receives the display-on signal.

According to one or more embodiments of the invention, a display device includes: a plurality of pixels respectively coupled to scan lines, readout lines, and data lines; and a scan driver including a plurality of stages configured to respectively supply scan signals and sensing signals to the scan lines and the readout lines, the plurality of stages including an n-th stage including: a first node; a second node; a first driving node; a second driving node; a sampling node; a first driving controller configured to control a voltage of the first node and a voltage of the second node in response to a previous carry signal from a stage previous to the n-th stage; a second driving controller configured to: control a voltage of the first driving node coupled to the first node, based on a sensing-on signal, a next carry signal, the voltage of a first power source, the voltage of the first node, and a voltage of a sampling node; and control a voltage of the second driving node, based on the voltage of the sampling node and a control clock signal; an output buffer including: a first output buffer configured to output a n-th clock signal as a carry signal in response to the voltage of the first node and the voltage of the second node; a second output buffer configured to output a n-th scan clock signal as the scan signal in response to the voltage of the first driving node and the voltage of the second driving node; and a third output buffer configured to output a n-th sensing clock signal as a sensing signal in response to the voltage of the first driving node and the voltage of the second driving node; and a connection controller configured to electrically couple the first node and the first driving node to each other and electrically couple the second node and the second driving node to each other, and wherein n is a natural number.

The second driving controller may include: an eighth transistor coupled between an input terminal to which the next carry signal is applied and the sampling node, the eighth transistor including a gate electrode that receives the sensing-on signal; a ninth transistor coupled between a third node and the first driving node, the ninth transistor including a gate electrode coupled to a first control clock terminal to which a first control clock signal is applied; an tenth transistor coupled between a second control clock terminal to which a second control clock signal is applied and the third node, the tenth transistor including a gate electrode coupled to the sampling node; an eleventh transistor coupled between a first power terminal to which the first power source is applied and the third node, the eleventh transistor including a gate electrode coupled to the first driving node; and a third capacitor coupled between a second power terminal to which a second power source is applied and the sampling node.

The ninth transistor may be operable to supply, to the first driving node, the voltage of the first power source, which is applied through the eleventh transistor when the first control clock signal is supplied.

The second driving controller may further include: twelfth and thirteenth transistors coupled in series between a third power terminal to which a third power source is applied and the second driving node. The twelfth transistor may include a gate electrode that receives the second control clock signal, and the thirteenth transistor may include a gate electrode coupled to the sampling node.

The second driving controller may further include a fifth capacitor coupled between the gate electrode of the eighth transistor and the sampling node.

The second driving controller may further include a twenty-seventh transistor diode-coupled between the first power terminal to which the first power source is applied and the sampling node.

The second driving controller may include: an eighth transistor coupled between an input terminal to which the next carry signal is applied and the sampling node, the eighth transistor including a gate electrode that receives the sensing-on signal; ninth and tenth transistors coupled in series between a control clock terminal to which the control clock signal is applied and the first driving node, the ninth and tenth transistors including gate electrodes commonly coupled to the sampling node; and an eleventh transistor coupled between a first power terminal to which the first power source is applied and a third node between the ninth and tenth transistors, the eleventh transistor including a gate electrode coupled to the first driving node.

The second driving controller may include: an eighth transistor coupled between an input terminal to which the next carry signal is applied and the sampling node, the eighth transistor including a gate electrode that receives the sensing-on signal; ninth and tenth transistors coupled in series between a clock terminal to which the control clock signal is applied and the first driving node, and the ninth and tenth transistors including gate electrodes commonly coupled to the sampling node; and an eleventh transistor diode-coupled between a carry output terminal that outputs the carry signal and a third node between the ninth and tenth transistors, or between the third node and an output terminal that outputs the scan signal.

The first driving controller may include: a first transistor coupled between a first power terminal to which the first power source is applied and the first node, the first transistor including a gate electrode that receives the previous carry signal or the scan start signal; second and third transistors coupled in series between the first node and a carry output terminal that outputs the carry signal; a fourth transistor coupled between the first node and the carry output terminal, the fourth transistor including a gate electrode that receives the next carry signal; a fifth transistor coupled between a first clock terminal to which a clock signal is applied and the second node, the fifth transistor including a gate electrode coupled to the first node; a sixth transistor coupled between the first power terminal to which the first power source is applied and the second node, the sixth transistor including a gate electrode coupled to the first clock terminal; and a seventh transistor diode-coupled between the first power terminal and the second node.

The first driving controller may further include a twenty-sixth transistor coupled between the gate electrode of the fifth transistor and the first node, the twenty-sixth transistor including a gate electrode coupled to the first power terminal.

The scan driver and the display device having the same in accordance with the present disclosure may include a configuration that stabilize a change (fluctuation) in voltage of at least one of the first node, the second node, the first driving node, the second driving node, and the sampling node and minimizes degradation of the transistors included in the stage. Thus, the first and second scan signals can be stably output in the display period and the sensing period even in long time use, and the reliability of the display device can be improved.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
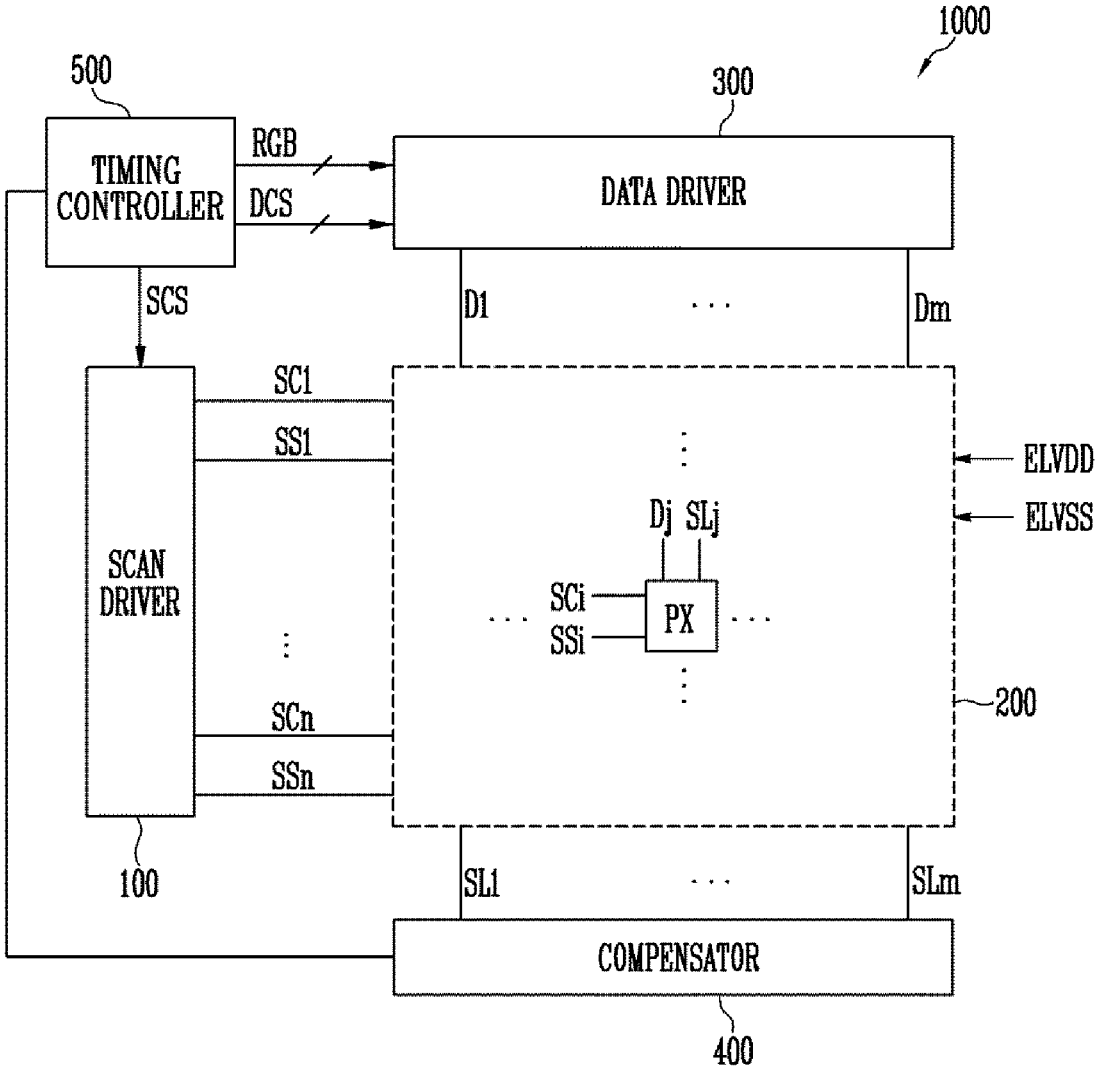
FIG. 1 is a block diagram illustrating a display device in accordance with an exemplary embodiment of the present disclosure.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram illustrating a display device in accordance with an exemplary embodiment of the present disclosure.

Referring to FIG. 1, the display device 1000 may include a scan driver 100, a display panel 200, a data driver 300, a compensator 400, and a timing controller 500.

The display device 1000 may be implemented with a self-luminescent display device, a liquid crystal display device, a quantum dot display device, or the like. The display device 1000 may be a flat panel display device, a flexible display device, a curved display device, a foldable display device, or a bendable display device. Also, the display device 1000 may be applied to a transparent display device, a head-mounted display device, a wearable display device, and the like.

The timing controller 500 may generate a data driving control signal DCS and a scan driving control signal SCS, corresponding to synchronization signals supplied from the outside. The data driving control signal DCS generated by the timing controller 500 may be supplied to the data driver 300, and the scan driving control signal SCS generated by the timing controller 500 may be supplied to the scan driver 100. In an exemplary embodiment, the timing controller 500 may generate image data RGB, based on image information received from an external graphic source, etc., and supply the image data RGB to the data driver 300.

The data driving control signal DCS may include a source start pulse and a plurality of clock signals. The source start pulse controls a sampling start time of data. The clock signals may be used to control a sampling operation.

The scan driving control signal SCS may include a scan start signal and a plurality of clock signals. The scan start signal controls a first timing of a scan signal. The clock signals may be used to shift the scan start signal.

The scan driver 100 may be supplied with the scan driving control signal SCS from the timing controller 500. The scan driver 100 supplied with the scan driving control signal SCS supplies a scan signal to first scan lines SC1 to SCn (n is a natural number). In an example, the scan driver 100 may sequentially supply the scan signal to the first scan lines SC1 to SCn. When the scan signal is sequentially supplied to the first scan lines SC1 to SCn, pixels PX may be selected in units of horizontal lines. To this end, the scan signal may be set to a gate-on voltage (e.g., a logic high level) such that transistors included in the pixels PX can be turned on.

The scan driver 100 may supply a sensing signal to second scan lines SS1 to SSn, based on the scan driving control signal SCS. When the sensing signal is supplied to the second scan lines SS1 to SSn, pixels PX may be selected in units of horizontal lines. The sensing signal may be set to a gate-on voltage (e.g., a logic high level) such that the transistors included in the pixels PX can be turned on.

A gate-on voltage does not mean one fixed voltage value but may mean a voltage that allows the transistors supplied with the gate-on voltage to be turned on. Therefore, values of gate-on voltages that predetermined input signals have and gate-on voltages charged in a predetermined node may be equal to or different from each other.

The data driver 300 may be supplied with the data driving control signal DCS and the image data RGB from the timing controller 500. The data driver 300 may convert the image data RGB into an analog data signal, and supply the data signal to data lines D1 to Dm (m is a natural number). The data signal supplied to the data lines D1 to Dm may be supplied to pixels PX selected by the scan signal. To this end, the data driver 300 may supply the data signal to the data lines D1 to Dm to be synchronized with the scan signal.

The compensator 400 may supply a predetermined voltage to the pixels PX through sensing lines SL1 to SLm, and detect a characteristic of the pixels PX from a current or voltage extracted from the pixel PX. The extracted current or voltage may correspond to a sensing value, and the compensator 400 may detect a change in characteristic of a driving transistor and/or light emitting device, based on a variation in sensing value, a difference between the sensing value and a predetermined reference, or the like.

The compensator 400 may calculate a compensation value for compensating for image data RGB or a data signal corresponding thereto, based on the detected sensing value. Accordingly, degradation of the pixels PX can be compensated. The compensation value may be provided to the timing controller 500 or the data driver 300.

During a display period, the compensator 400 may supply a predetermined reference voltage for image display to the display panel 200 through the sensing lines SL1 to SLm. Also, during a sensing period, the compensator 400 may supply a predetermined reference voltage or initialization voltage for sensing to the display panel 200 through the sensing lines SL1 to SLm.

Although a case where the compensator 400 is an independent component is illustrated in FIG. 1, at least some components of the compensator 400 may be included in the data driver 300 or the timing controller 500.

The display panel 200 includes pixels PX coupled to the first scan lines SC1 to SCn, the second scan lines SS1 to SSn, the sensing lines SL1 to SLm, and the data lines D1 to Dm. In an exemplary embodiment, the sensing lines SL1 to SLm may be excluded from the display panel 200, and the supply of a data signal and the extraction of a sensing value may be performed through the data lines D1 to Dm.

The display panel 200 may be supplied with a first driving power source ELVDD and a second driving power source ELVSS from the outside. For example, the voltage of the first driving power source ELVDD may be larger than that of the second driving power source ELVSS.

In some cases, the pixels PX may be coupled to emission control lines, in addition to the first scan lines SC1 to SCn, the second scan lines SS1 to SSn, and the data lines D1 to Dm. An emission driver for outputting an emission control signal may be further provided in the display device 1000.

Figure 2:
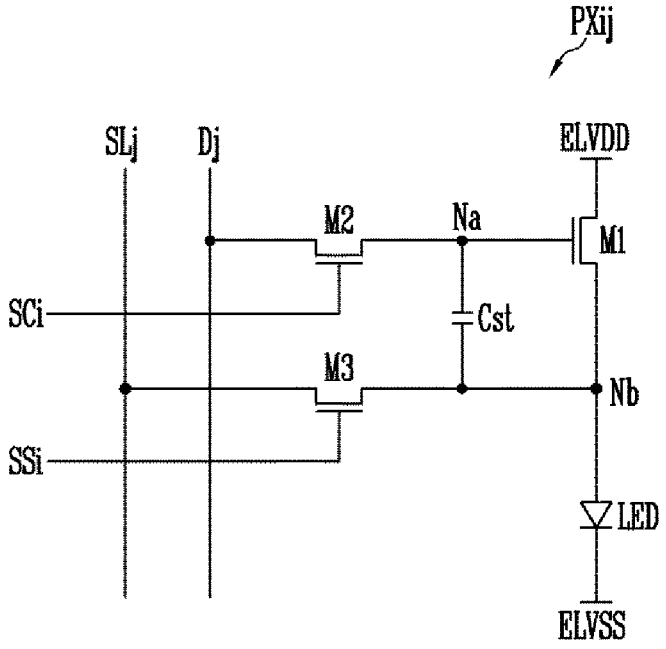
FIG. 2 is a schematic circuit diagram illustrating an example of a pixel included in the display device shown in FIG. 1.

FIG. 2 is a schematic circuit diagram illustrating an example of the pixel included in the display device shown in FIG. 1.

For convenience of description, a pixel PXij coupled to an ith first scan line SCi, an ith second scan line SSi, a jth data line Dj, and a jth sensing line SLj is illustrated in FIG. 2.

The pixel PXij may include a driving transistor M1, a switching transistor M2, a sensing transistor M3, a storage capacitor Cst, and a light emitting device LED.

The switching transistor M2 may include a first electrode coupled to the jth data line Dj, a gate electrode coupled to the ith first scan line SCi, and a second electrode coupled to a first node Na.

The switching transistor M2 may be turned on when a scan signal is supplied from the ith first scan line SCi, to supply a data signal received from the jth data line Dj to the storage capacitor Cst (or control a potential of the first node Na). The storage capacitor Cst coupled between the first node Na and a second node Nb may charge a voltage corresponding to the data signal.

The driving transistor M1 may include a first electrode coupled to the first driving power source ELVDD, a second electrode coupled to the light emitting element LED, and a gate electrode coupled to the first node Na. The driving transistor M1 may control an amount of current flowing through the light emitting element LED, corresponding to an gate-source voltage.

The sensing transistor M3 may include a first electrode coupled to the jth sensing line SLj, a second electrode coupled to the second node Nb, and a gate electrode coupled to the ith second scan line SSi. The sensing transistor M3 may be turned on when a sensing signal is supplied to the ith second scan line SSi, to control a potential of the second node Nb. Alternatively, the sensing transistor M3 may be turned on when a sensing signal is supplied to the ith second scan line SSi, to extract a current flowing through the light emitting element LED or the driving transistor M1.

The light emitting element LED may include a first electrode (anode electrode) coupled to the second electrode of the driving transistor M1 and a second electrode (cathode electrode) coupled to the second driving power source ELVSS. The light emitting element LED may generate light, corresponding to an amount of current supplied from the driving transistor M1.

The light emitting element LED may be an organic light emitting diode or an inorganic light emitting diode.

In FIG. 2, the first electrode of each of the transistors M1, M2, and M3 may be set as any one of a source electrode and a drain electrode, and the second electrode of each of the transistors M1, M2, and M3 may be set as an electrode different from the first electrode. For example, when the first electrode is set as the source electrode, the second electrode may be set as the drain electrode.

Although the transistors M1, M2, and M3 may be implemented with an NMOS transistor as shown in FIG. 2, the present disclosure is not limited thereto, and the transistors M1, M2, and M3 may be implemented with a PMOS transistor.

Figure 3:
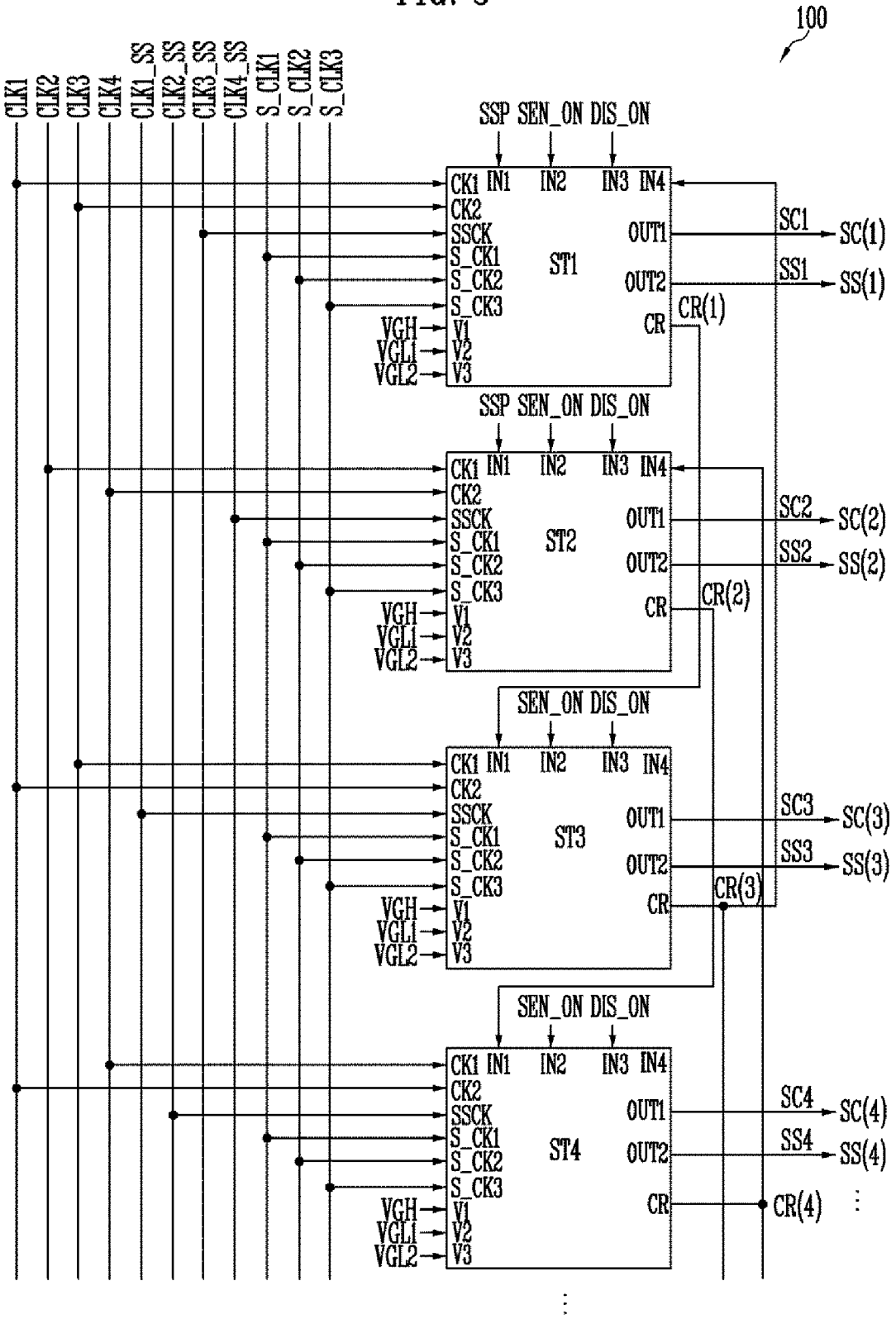
FIG. 3 is a diagram illustrating a scan driver in accordance with an exemplary embodiment.

FIG. 3 is a schematic circuit diagram illustrating a scan driver in accordance with an exemplary embodiment of the present disclosure.

Referring to FIG. 3, the scan driver 100 may include a plurality of stages ST1, ST2, ST3, ST4, . . . STn.

The stages ST1, ST2, ST3, ST4, . . . STn may respectively supply first scan signals SC(1), SC(2), SC(3), SC(4), . . . SC(n) to first scan lines SC1, SC2, SC3, SC4, . . . SCn and respectively supply second scan signals SS(1), SS(2), SS(3), SS(4), . . . SS(n) to second scan lines SS1, SS2, SS3, SS4, . . . SSn, in response to a scan start signal SSP. For example, a k-th stage may output a k-th scan signal to a k-th first scan line. In an exemplary embodiment, the scan start signal SSP for controlling a timing of a first scan signal may be supplied to a first stage ST1 and a second stage ST2. The scan start signal SSP may be supplied to the first stage ST1 and the second stage ST2 at the same timing or different timings.

Each of the stages ST1, ST2, ST3, ST4, . . . STn may include a first input terminal IN1, a second input terminal IN2, a third input terminal IN3, a fourth input terminal IN4, a first clock terminal CK1, a second clock terminal CK2, a sensing clock terminal SSCK, a first control clock terminal S_CK1, a second control clock terminal S_CK2, a third control clock terminal S_CK3, a first power terminal V1, a second power terminal V2, a third power terminal V3, a carry output terminal CR, a first output terminal OUT1, and a second output terminal OUT2.

The first input terminal IN1 may receive the scan start signal SSP or a previous carry signal. In an exemplary embodiment, the scan start signal SSP may be supplied to the first input terminal IN1 of each of the first stage ST1 and the second stage ST2, and a carry signal of a previous stage may be applied to the first input terminal IN1 of each of the stages except the first stage ST1 and the second stage ST2. In an exemplary embodiment, a (k−2)th (k is a natural number of 3 or more) carry signal may be applied to the first input terminal IN1 of the k-th stage.

The second input terminal IN2 may receive a sensing-on signal SEN_ON. The sensing-on signal SEN_ON is a control signal for outputting a scan signal and/or a sensing signal in a sensing period in which a mobility and a threshold voltage of a driving transistor included in a pixel and a current characteristic of a light emitting element LED included in the pixel may be sensed. For example, a gate-on voltage may be stored in a sampling node included in a stage by the sensing-on signal SEN_ON. In an exemplary embodiment, the sensing period may be included in a vertical blank period during one frame.

The third input terminal IN3 may receive a display-on signal DIS_ON. The display-on signal DIS_ON may have a gate-on voltage in a display period during one frame, and have a gate-off voltage in a sensing period during the one frame.

The fourth input terminal IN4 may receive a next carry signal. The next carry signal may be one of carry signals supplied after a predetermined time elapses from when a carry signal of a current stage is output. In an exemplary embodiment, a (k+2)th carry signal or a (k+3)th carry signal may be applied to the fourth input terminal IN4 of the k-th stage STk. (k is a natural number of (n−3) or less). In an exemplary embodiment, the timing controller 500 may further supply dummy carry signals to the fourth input terminal IN4 of each of the (n−2)th stage ST(n−2), the (n−1)th stage ST(n−1), and the n-th stage STn. For example, a dummy carry signal supplied to the fourth input terminal IN4 of the (n−2)th stage ST(n−2) may be a carry signal that shifted (or delayed) from the nth carry signal. A dummy carry signal supplied to the fourth input terminal IN4 of the nth stage STn may be a carry signal that is shifted (or delayed) from a dummy carry signal supplied to the fourth input terminal IN4 of the (n−1)th stage ST(n−1).

Two different clock signals among first to fourth clock signals CLK1, CLK2, CLK3, and CLK4 may be applied to the first and second clock terminals CK1 and CK2. In an exemplary embodiment, when the first clock signal CLK1 and the third clock signal CLK3 are respectively input to the first clock terminal CK1 and the second clock terminal CK2 of the k-th stage STk, the second clock signal CLK2 and the fourth clock signal CLK4 may be respectively input to the first clock terminal CK1 and the second clock terminal CK2 of a (k+1)th stage ST(k+1), the third clock signal CLK3 and the first clock signal CLK1 may be respectively input to the first clock terminal CK1 and the second clock terminal CK2 of a (k+2)th stage, and the fourth clock signal CLK4 and the first clock signal CLK1 may be respectively input to the first clock terminal CK1 and the second clock terminal CK2 of a (k+3)th stage.

The first to fourth clock signals CLK1, CLK2, CLK3, and CLK4 may function to control outputs of the first scan signals SC(1), SC(2), SC(3), SC(4), . . . SC(n). In an exemplary embodiment, the first clock signal CLK1 and the third clock signal CLK3 may be signals having a difference of a half period, and the second clock signal CLK2 and the fourth clock signal CLK4 may be signals having a difference of a half period.

In an exemplary embodiment, a gate-on voltage period of each of the clock signals CLK1, CLK2, CLK3, and CLK4 may correspond to horizontal period 1H. In addition, the gate-on voltage period of the first clock signal CLK1 and the gate-on voltage period of the second clock signal CLK2 may overlap with each other during a ¼ horizontal period ¼H. However, this is merely illustrative, and the waveform relationship of the clock signals CLK1, CLK2, CLK3, and CLK4 is not limited thereto. In addition, the number of clock signals supplied to one stage is not limited thereto.

Each of the first to fourth clock signals CLK1, CLK2, CLK3, and CLK4 may be set as a square wave signal in which a logic high level and a logic low level are alternately repeated. The logic high level may correspond to a gate-on voltage, and the logic low level may correspond to a gate-off voltage. For example, the logic high level may be a voltage value of about 10 V to about 30 V, and the logic low level may be a voltage value of about −16 V to about −3 V.

The sensing clock terminal SSCK may receive any one of first to fourth sensing clock signals CLK1_SS to CLK4_SS. For example, during a display period, the sensing clock terminal SSCK may receive a sensing clock signal synchronized with a clock signal input to the second clock terminal CK2. In an example, during the display period, the first to fourth clock signals CLK1, CLK2, CLK3, and CLK4 may have the same waveforms as the first to fourth sensing clock signals CLK1_SS to CLK4_SS, respectively.

The first to fourth sensing clock signals CLK1_SS to CLK4_SS may function to control outputs of the second scan signals SS(1), SS(2), SS(3), SS(4), . . . SS(n). The first to fourth sensing clock signals CLK1_SS to CLK4_SS may have a gate-on voltage in a sensing period. The first to fourth sensing clock signals CLK1_SS to CLK4_SS may have gate-on voltages synchronized with the outputs of the second scan signals SS(1), SS(2), SS(3), SS(4), . . . SS(N), respectively. In an exemplary embodiment, during a display period, the first to fourth sensing clock signals CLK1_SS to CLK4_SS may be configured to have a difference of a ¼ horizontal period or more. In various embodiments of the present disclosure, the sensing clock signals CLK1_SS to CLK4_SS may be set to be synchronized with the clock signals CLK1, CLK2, CLK3, and CLK4, respectively.

In an exemplary embodiment, a gate-on voltage period of each of the sensing clock signals CLK1_SS to CLK4_SS may correspond to two horizontal periods 2H. In addition, the gate-on voltage period of the first sensing clock signal CLK1_SS and the gate-on voltage period of the second sensing clock signal CLK2_SS may overlap with each other during a ¼ horizontal period ¼H. However, this is merely illustrative, and the waveform relationship of the sensing clock signals CLK1_SS to CLK_SS is not limited thereto.

The first control clock terminal S_CK1, a second control clock terminal S_CK2, and the third control clock terminal S_CK3 may receive a first control clock signal S_CLK1, a second control clock signal S_CLK2, and a third control clock signal S_CLK3, respectively. The first to third control clock signals S_CLK1 to S_CLK3 may be used to control a voltage of a first driving node. For example, the first to third control clock signals S_CLK1 to S_CLK3 may have a gate-on voltage during at least a partial period of a vertical blank period for pixel sensing.

The first power terminal V1 may receive the voltage of a first power source VGH, the second power terminal V2 may receive the voltage of a second power source VGL1, and the third power terminal V3 may receive the voltage of a third power source VGL2. The first power source VGH may be set to a gate-on voltage. The second and third power sources VGL1 and VGL2 may be set to a gate-off voltage.

In an exemplary embodiment, the second and third power sources VGL1 and VGL2 may be the same. In an exemplary embodiment, a voltage level of the second power source VGL1 may be smaller than that of the third power source VGL2. For example, the second power source VGL1 may be set to about −9 V, and the third power source VGL2 may be set to about −6 V.

The carry output terminal CR may output a carry signal. The first output terminal OUT1 may output one of the first scan signals SC(1), SC(2), SC(3), SC(4), . . . SC(n). The second output terminal OUT2 may output one of the second scan signals SS(1), SS(2), SS(3), SS(4), . . . SS(n).

Figure 4:
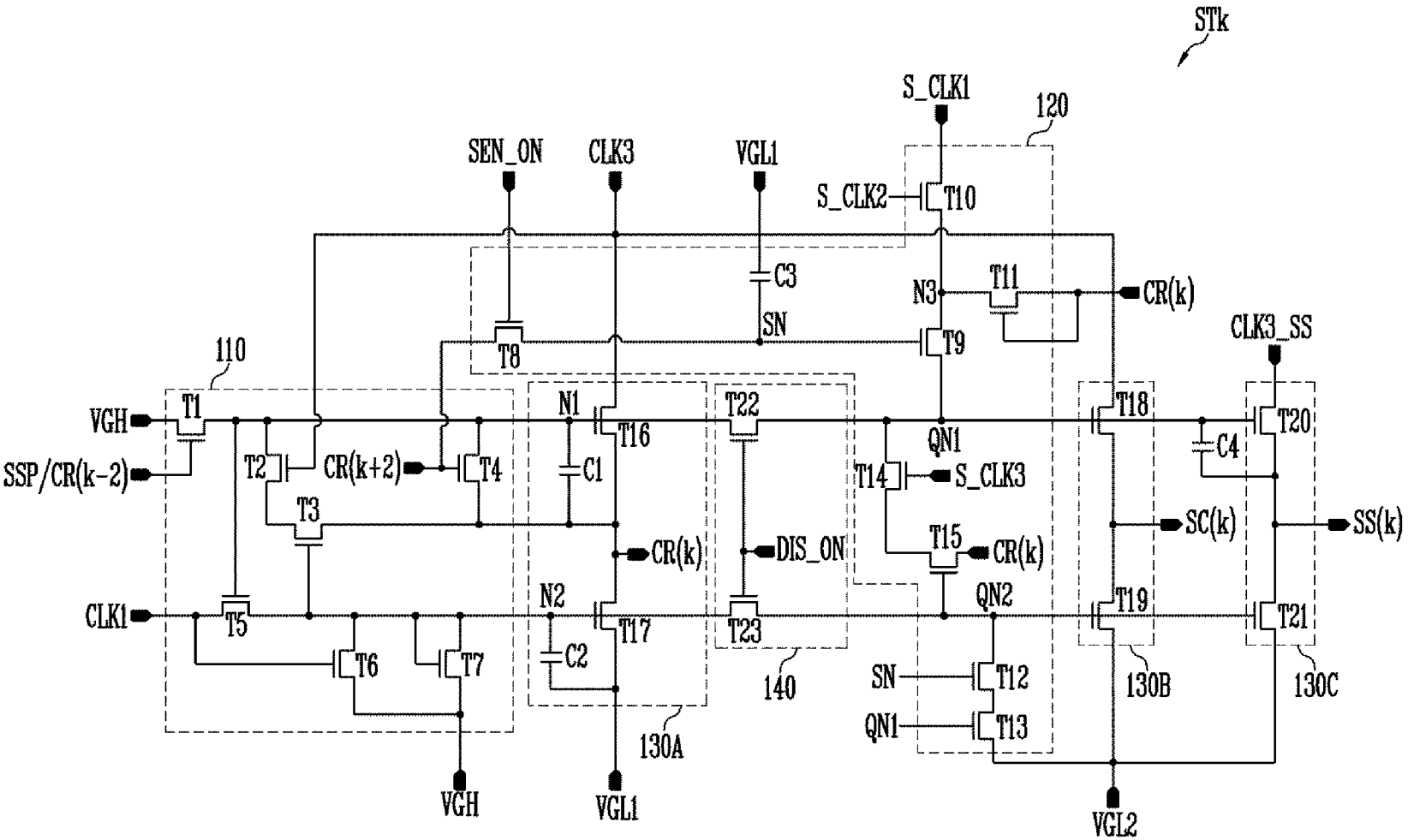
FIG. 4 is a schematic circuit diagram illustrating an example of a stage included in the scan driver shown in FIG. 3.

FIG. 4 is a schematic circuit diagram illustrating an example of the stage included in the scan driver shown in FIG. 3.

Referring to FIGS. 1, 2, 3, and 4, a kth stage STk (k is a natural number) may include a first driving controller 110, a second driving controller 120, output buffers 130A, 130B, and 130C, and a coupling controller 140.

In an exemplary embodiment, transistors included in the kth stage STk may be oxide semiconductor transistors. That is, semiconductor layers (active patterns) of the transistors may be formed of an oxide semiconductor.

The first driving controller 110 may control a voltage of a first node N1 and a voltage of a second node N2 in response to a previous carry signal CR(k−2). In an exemplary embodiment, the previous carry signal CR(k−2) may be a (k−2)th carry signal CR(k−2). However, this is merely illustrative, and the previous carry signal is not limited to the (k−2)th carry signal CR(k−2). For example, the previous carry signal may be a (k−1)th carry signal CR(k−1).

The output of a kth carry signal CR(k) may be controlled based on the voltage of the first node N1 and the voltage of the second node N2. For example, the voltage of the first node N1 is a voltage for controlling the output of the kth carry signal CR(k).

Meanwhile, in an exemplary embodiment, in a display period, a voltage of a first driving node QN1 may be determined by the voltage of the first node N1, and a voltage of a second driving node QN2 may be determined by the voltage of the second node N2. Therefore, in the display period, the output of a kth first scan signal SC(k) may be controlled by the voltage of the first node N1 and the voltage of the second node N2.

In other words, the first driving controller 110 may perform an operation of controlling the output of the carry signal CR(k) and the output of the first scan signal SC(k), based on a plurality of input signals in the display period.

In an exemplary embodiment, the first driving controller 110 may include a first transistor T1, a second transistor T2, a third transistor T3, and a fourth transistor T4 for controlling the voltage of the first node N1 and a fifth transistor T5, a sixth transistor T6, and a seventh transistor T7 for controlling the voltage of the second node N2.

The first transistor T1 may be coupled between the first power terminal V1 to which the first power source VGH is applied and the first node N1. The first transistor T1 may include a gate electrode receiving the (k−2)th carry signal CR(k−2) or the scan start signal SSP. The first transistor T1 may precharge the voltage of the first node N1 to the voltage of the first power source VGH in response to the (k−2)th carry signal CR(k−2).

The second transistor T2 and the third transistor T3 may be coupled between the first node N1 and the carry output terminal CR. The second transistor T2 may include a gate electrode receiving the third clock signal CLK3. The third transistor T3 may include a gate electrode coupled to the second node N2. The second and third transistors T2 and T3 may hold the voltage of the first node N1.

The fourth transistor T4 may be coupled between the first node N1 and the carry output terminal CR. The fourth transistor T4 may include a gate electrode receiving a (k+2)th carry signal CR(k+2). The fourth transistor T4 may discharge the voltage charged in the first node N1. For example, the voltage of the first node N1 may be discharged in synchronization with turn-on of the fourth transistor T4, i.e., a rising time of the (k+2)th carry signal CR(k+2).

The fifth transistor T5 may be coupled between the first clock terminal CK1 to which the first clock signal CLK1 is applied and the second node N2. The fifth transistor T5 may include a gate electrode coupled to the first node N1. The sixth transistor T6 may be coupled between the second node N2 and the first power terminal V1 to which the first power source VGH is supplied. The sixth transistor T6 may include a gate electrode receiving the first clock signal CLK1. The seventh transistor T7 may be diode-coupled between the first power terminal V1 and the second node N2.

The fifth to seventh transistors T5 to T7 may control the voltage of the second node N2, based on the first clock signal CLK1.

The second driving controller 120 may control a voltage of the first driving node QN1 coupled to the first node N1, based on the sensing-on signal SEN_ON, a next carry signal CR(k+2), the first control clock signal S_CLK1, the second control clock signal S_CLK2, the voltage of the first node N1, and a voltage of a sampling node SN. The second driving controller 120 may further control the voltage of the second driving node QN2, based on the voltage of the sampling node SN and the voltage of the first driving node QN1.

The second driving controller 120 may control the voltage of the first driving node QN1 and the voltage of the second driving node QN2 during a sensing period. In the sensing period, the output of a first scan signal SC(k) and a second scan signal (hereafter, may also be referred as sensing signal) SS(k) may be controlled by the voltage of the first driving node QN1 and the voltage of the second driving node QN2. In an exemplary embodiment, the sensing period may be a mobility sensing period in which a mobility of a driving transistor included in a pixel is sensed.

In an exemplary embodiment, the second driving controller 120 may include an eighth transistor T8, a ninth transistor T9, a tenth transistor T10, and an eleventh transistor T11 for controlling the voltage of the first driving node QN1 and a twelfth transistor T12 and a thirteenth transistor T13 for controlling the voltage of the second driving node QN2. The second driving controller 120 may further include a fourteenth transistor T14 and a fifteenth transistor T15 for stably maintaining the voltage of the first driving node QN1 as a gate-off voltage during a predetermined period.

The eighth transistor T8 may be coupled between the fourth input terminal IN4 to which a next carry signal is applied and the sampling node SN. The eighth transistor T8 may include a gate electrode receiving the sensing-on signal SEN_ON. In an exemplary embodiment, the next carry signal may be the (k+2)th carry signal CR(k+2). The eighth transistor T8 may charge a gate-on voltage of the (k+2)th carry signal CR(k+2) in the sampling node SN in response to the sensing-on signal SEN_ON. The sensing-on signal SEN_ON may have a gate-on voltage in synchronization with the (k+2)th carry signal CR(k+2). Alternatively, the period in which the sensing-on signal SEN_ON has the gate-on voltage may be included in the period in which the (k+2)th carry signal CR(k+2) has the gate-on voltage.

The second driving controller 120 may further include a third capacitor C3. The third capacitor C3 may be coupled between the second power terminal V2 receiving the second power source VGL1 and the sampling node SN. The gate-on voltage charged in the sampling node SN may be maintained by the third capacitor C3 in response to the sensing-on signal SEN_ON during a display period.

The ninth transistor T9 and the tenth transistor T10 may be coupled in series between the first control clock terminal S_CK1 to which the first control clock signal S_CLK1 is applied and the first driving node QN1. A node between the ninth transistor T9 and the tenth transistor T10 may be defined as a third node N3.

The ninth transistor T9 may be coupled between the third node N3 and the first driving node QN1. The ninth transistor T9 may include a gate electrode coupled to the sampling node SN.

The tenth transistor T10 may be coupled between the third node N3 and the first control clock terminal S_CK1. The tenth transistor T10 may include a gate electrode coupled to the second control clock terminal S_CK2 to which the second control clock signal S_CLK2 is applied. In an exemplary embodiment, a gate-off voltage of the second control clock signal S_CLK2 may be smaller than a gate-off voltage of the first clock signal S_CLK1 and a low voltage supplied to the sampling node SN.

In an exemplary embodiment, the gate electrode of the tenth transistor T10 may be commonly coupled to the gate electrode of the ninth transistor T9 and the sampling node SN.

The ninth and tenth transistors T9 and T10 may control the voltage of the first driving node QN1 in response to the voltage of the sampling node SN and the second clock signal S_CLK2. An excessive boosting (or amplification) of the voltage of the first driving node QN1 in a vertical blank period (e.g., a sensing period) can be prevented or suppressed by turn-on of the ninth and tenth transistors T9 and T10. Thus, degradation of a twenty-second transistor T22, etc., coupling between the first node N1 and the first driving node QN1, can be minimized.

The eleventh transistor T11 may be diode-coupled between the third node N3 and the carry output terminal CR outputting the carry signal CR(k). The eleventh transistor T11 holds a voltage of the third node N3 in response to the carry signal CR(k), so that an unnecessary increase in drain-source voltage of the ninth transistor T9 can be prevented or suppressed. Accordingly, current leakage between the first control clock terminal S_CK1 and the first driving node QN1 and current leakage in the output buffer 130B can be prevented or suppressed.

The twelfth transistor T12 and the thirteenth transistor T13 may be coupled in series between the third power terminal V3 to which the third power source VGL2 is applied and the second driving node QN2. The twelfth transistor T12 may include a gate electrode coupled to the sampling node SN, and the thirteenth transistor T13 may include a gate electrode coupled to the first driving node QN1.

In a sensing period, the twelfth and thirteenth transistors T12 and T13 may be turned on, and the voltage of the third power source VGL2 may be applied to the second driving node QN2. Therefore, in the sensing period, the voltage of the second driving node QN2 may be maintained as a gate-off voltage (logic low level).

The fourteenth transistor T14 and the fifteenth transistor T15 may be coupled in series between the first driving node QN1 and the carry output terminal CR. The fourteenth transistor T14 may include a gate electrode receiving the third control clock signal S_CLK3, and the fifteenth transistor T15 may include a gate electrode coupled to the second driving node QN2.

The fourteenth and fifteenth transistors T14 and T15 may maintain the voltage of the first driving node QN1 as a gate-off voltage after a vertical blank period in which the fourteenth and fifteenth transistors T14 and T15 are turned on to perform sensing. That is, the fourteenth and fifteenth transistors T14 and T15 are components for holding the voltage of the first driving node QN1 to a logic low level after pixel sensing. Thus, voltage ripple (voltage fluctuation) at the first driving node QN1 can be prevented or suppressed, which may be generated by the first and second control clock signals S_CLK1 and S_CLK2, etc. in a display period continued after the vertical blank period.

The output buffers 130A, 130B, and 130C may output the carry signal CR(k) in response to the voltage of the first node N1 and the voltage of the second node N2, and output the first scan signal SC(k) and/or the second scan signal SS(k) in response to the voltage of the first driving node QN1 and the voltage of the second driving node QN2.

The output buffers 130A, 130B, and 130C may include a sixteenth transistor T16, a seventeenth transistor T17, a eighteenth transistor T18, a nineteenth transistor T19, a twentieth transistor T20, and a twenty-first transistor T21. The output buffers 130A, 130B, and 130C may further include a first capacitor C1, a second capacitor C2, and a fourth capacitor C4.

The sixteenth transistor T16 may be coupled between the second clock terminal CK2 to which the third clock signal CLK3 is applied and the carry output terminal CR. The sixteenth transistor T16 may include a gate electrode coupled to the first node N1. The sixteenth transistor T16 may supply a gate-on voltage to the carry output terminal CR in response to the voltage of the first node N. For example, the sixteenth transistor T16 may serve as a pull-up buffer.

The seventeenth transistor T17 may be coupled between the carry output terminal CR and the second power terminal V2 to which the second power source VGL1 is applied. The seventeenth transistor T17 may include a gate electrode coupled to the second node N2. The seventeenth transistor T17 may supply a gate-off voltage to the carry output terminal CR in response to the voltage of the second node N2. For example, the seventeenth transistor T17 may maintain a voltage of the carry output terminal CR as a gate-off voltage level (i.e., a logic low level).

The first capacitor C1 may be coupled between the first node N1 and the carry output terminal CR. The first capacitor C1 may serve as a boosting capacitor. Accordingly, the sixteenth transistor T16 can stably maintain a turn-on state during a predetermined period. The second capacitor C2 may be coupled between the second node N2 and the second power terminal V2.

The eighteenth transistor T18 may be coupled between the second clock terminal CK2 and the first output terminal OUT1. The eighteenth transistor T18 may include a gate electrode coupled to the first driving node QN1. The eighteenth transistor T18 may supply a gate-on voltage to the first output terminal OUT1 in response to the voltage of the first driving node QN1.

The nineteenth transistor T19 may be coupled between the first output terminal OUT1 and the third power terminal V3 to which the third power source VGL2 is applied. The nineteenth transistor T19 may include a gate electrode coupled to the second driving node QN2. The nineteenth transistor T19 may supply a gate-off voltage to the first output terminal OUT1 in response to the voltage of the second driving node QN2.

The twentieth transistor T20 may be coupled between the sensing clock terminal SSCK to which the third sensing clock signal CLK3_SS is applied and the second output terminal OUT2 outputting the second scan signal SS(k). A gate electrode of the twentieth transistor T20 may be coupled to the first driving node QN1. The twentieth transistor T20 may supply a gate-on voltage to the second output terminal OUT2 in response to the voltage of the first driving node QN1. For example, the twentieth transistor T20 may serve as a pull-up buffer.

The twenty-first transistor T21 may be coupled between the second output terminal OUT2 and the third power terminal V3 to which the third power source VGL2 is applied. A gate electrode of the twenty-first transistor T21 may be coupled to the second driving node QN2. The twenty-first transistor T21 may supply a gate-off voltage to the second output terminal OUT2 in response to the voltage of the second driving node QN2.

The fourth capacitor C4 may be coupled between the first driving node QN1 and the second output terminal OUT2. The fourth capacitor C4 may serve as a boosting capacitor. Accordingly, the twentieth transistor T20 can stably maintain the turn-on state during a predetermined period.

The coupling controller 140 may electrically couple the first node N1 and the first driving node QN1 to each other and electrically couple the second node N2 and the second driving node QN2 to each other, in response to the display-on signal DIS_ON. The display-on signal DIS_ON may have a gate-on voltage in a display period, and have a gate-off voltage in a sensing period.

In an exemplary embodiment, in the display period, the output buffers 130A, 130B, and 130C may output the carry signal CR(k), the first scan signal SC(k), and the second scan signal SS(k) through the coupling controller 140 according to an operation of the first driving controller 110. That is, in the display period, the second driving controller 120 has no influence on the output of the output buffers 130A, 130B, and 130C. Similarly, in the sensing period, the output buffers 130A, 130B, and 130C may output the carry signal CR(k), the first scan signal SC(k), and the second scan signal SS(k) through the coupling controller 140 according to an operation of the second driving controller 120. That is, in the sensing period, the first driving controller 110 has no influence on the output of the output buffers 130A, 130B, and 130C.

In an exemplary embodiment, the coupling controller 140 may include the twenty-second transistor T22 and a twenty-third transistor T23.

The twenty-second transistor T22 may be coupled between the first node N1 and the first driving node QN1. A gate electrode of the twenty-second transistor T22 may be coupled to the third input terminal IN3 to which the display-on signal DIS_ON is applied.

The twenty-third transistor T23 may be coupled between the second node N2 and the second driving node QN2. A gate electrode of the twenty-third transistor T23 may be coupled to the third input terminal IN3 to which the display-on signal DIS_ON is applied.

As described above, the stage STk of the scan driver 100 in accordance with the exemplary embodiment of the present disclosure includes the ninth to eleventh transistors T9, T10, and T11. Thus, an excessive boosting (or amplification) of the voltage of the first driving node QN1 be prevented or suppressed, and current leakage of the output buffer 130B can be prevented or suppressed. Also, the stage STk includes the fourteenth transistor T14 and the fifteenth transistor T15, so that voltage ripple (voltage fluctuation) at the first driving node QN1 can be prevented or suppressed, which may be generated by the first and second control clock signals S_CLK1 and S_CLK2, etc. in the display period continued after the vertical blank period.

Accordingly, degradation of the transistors included in the stage STk can be minimized, and the output of the first scan signal SC(k) and the output of the second scan signal SS(k) in the display period and the sensing period (e.g., the vertical blank period) can be stabilized.

Figure 5:
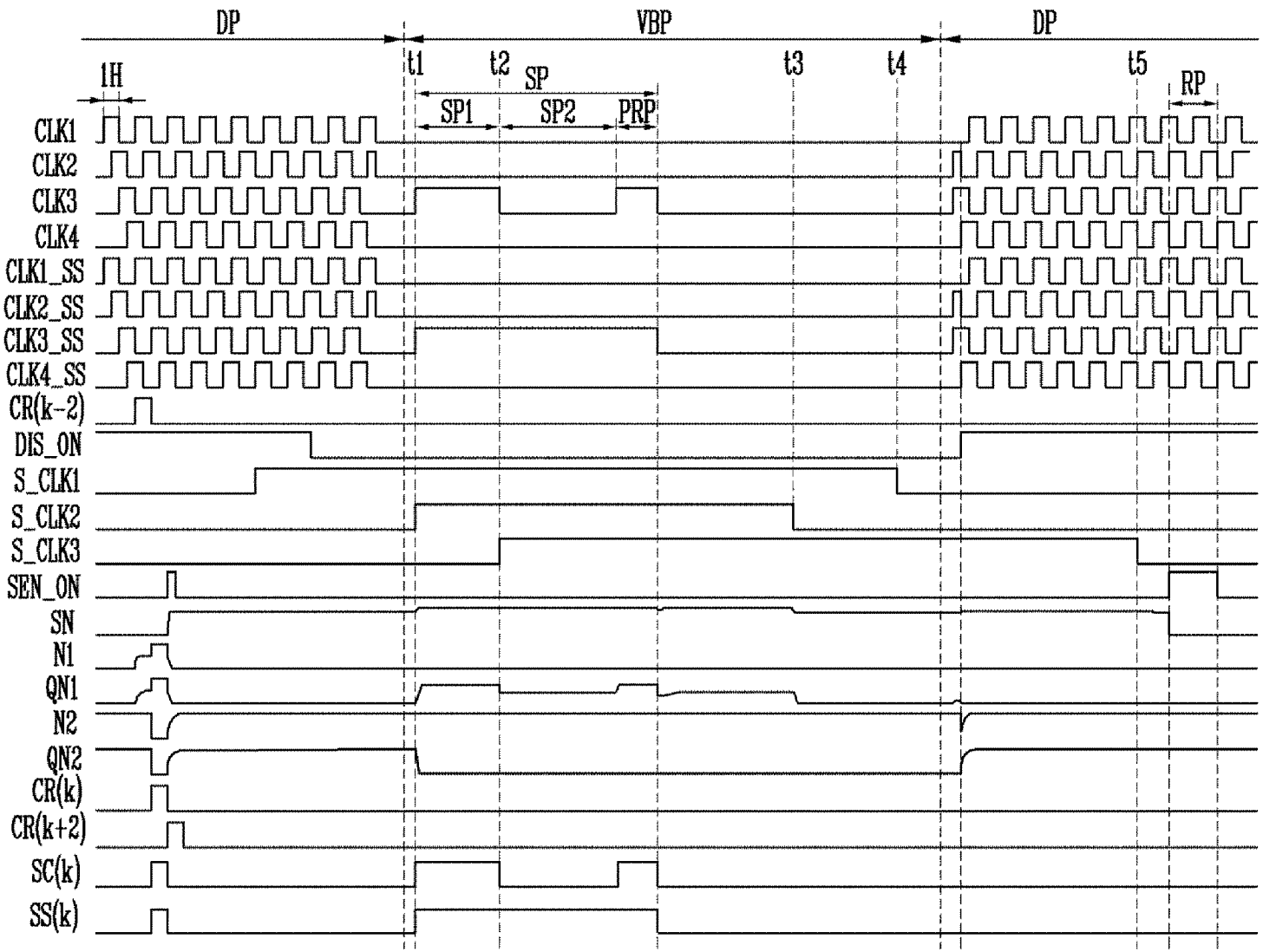
FIG. 5 is a timing diagram illustrating an example of an operation of the stage shown in FIG. 4.

FIG. 5 is a timing diagram illustrating an example of an operation of the stage shown in FIG. 4.

In FIG. 5, an operation of the kth stage STk will be mainly described. In addition, positions, widths, heights, etc. of waveforms shown in FIG. 5 are merely illustrative, and the present disclosure is not limited thereto.

Referring to FIGS. 1, 2, 3, 4, and 5, one frame period may include a display period DP and a vertical blank period VBP.

During the display period DP, the first scan signal SC(k) may be sequentially provided to pixel lines. Also, during the display period DP, the second scan signal SS(k) may be sequentially provided to the pixel lines.

In the display period DP, the sensing-on signal SEN_ON may be supplied to one stage (e.g., the kth stage STk) selected among a plurality of stages. Only the stage receiving the sensing-on signal SEN_ON may output a scan signal in a sensing period SP continued to the display period DP.

That is, only one stage among all the stages may output a scan signal in the sensing period SP. Mobility sensing on pixels receiving the output scan signal may be performed during the sensing period SP.

However, this is merely illustrative. The sensing-on signal SEN_ON may be supplied to a plurality of stages, and mobility sensing on a plurality of pixel lines may be performed during the vertical blank period VBP.

The display-on signal DIS_ON may have a gate-on voltage in the display period DP, and have a gate-off voltage in the vertical blank period VBP.

The first to third control clock signals S_CLK1, S_CLK2, and S_CLK3 may roughly have gate-on voltages in the vertical blank period VBP.

During the display period DP, when the (k−2)th carry signal CR(k−2) is applied to the first driving controller 110 in synchronization with the first clock signal CLK1 applied to the first clock terminal CK1, the voltage of the first node N1 and the voltage of the first driving node QN1 may be precharged. That is, the voltage of the first node N1 and the voltage of the first driving node QN1 may be precharged before the first and second scan signals SC(k) and SS(k) are output.

Subsequently, when the third clock signal CLK3 has a gate-on voltage, the voltage of the first node N1 and the voltage of the first driving node QN1 may be boosted by the first capacitor C1. Also, the carry signal CR(k) and the first scan signal SC(k) may be output in synchronization with the third clock signal CLK3. In addition, the second scan signal SS(k) may also be output in synchronization with the third sensing clock signal CLK3_SS.

Subsequently, the (k+2)th carry signal CR(k+2) and the sensing-on signal SEN_ON may be applied while overlapping with each other. A stage (in this embodiment, the kth stage STk) receiving the sensing-on signal SEN_ON may output the first and second scan signals SC(k) and SS(k) for pixel sensing in the subsequent vertical blank period VBP. The voltage of the first node N1 and the voltage of the first driving node QN1 are discharged in response to the (k+2)th carry signal CR(k+2), and a gate-on voltage may be charged and maintained in the sampling node SN in response to the sensing-on signal SEN_ON.

In an exemplary embodiment, a width of the sensing-on signal SEN_ON may be smaller than that of the (k+2)th carry signal CR(k+2). For example, the sensing-on signal SEN_ON may be changed to a gate-off voltage earlier than the (k+2)th carry signal CR(k+2). Thbecause, when the sensing-on signal SEN_ON may be changed to the gate-off voltage later than the (k+2)th carry signal CR(k+2), an unwanted gate-off voltage (or low voltage) may be provided to the sampling node SN. Therefore, the sensing-on signal SEN_ON and the (k+2)th carry signal CR(k+2) may rise at the same time, and the sensing-on signal SEN_ON may fall earlier than the (k+2)th carry signal CR(k+2).

Subsequently, before the sensing period SP started, the first control clock signal S_CLK1 may be changed to a gate-on voltage, and the display-on signal DIS_ON may be changed to a gate-off voltage. Although a case where the display-on signal DIS_ON is changed after the first control clock signal S_CLK1 is changed is illustrated in FIG. 5, the change relationship of the first control clock signal S_CLK1 and the display-on signal DIS_ON is not limited thereto. For example, the first control clock signal S_CLK1 and the display-on signal DIS_ON may respectively rise and fall at the same time.

The vertical blank period VBP may include the sensing period SP. In an exemplary embodiment, the vertical blank period VBP may further include a reset period RP posterior to the sensing period SP. However, this is merely illustrative, and the reset period RP may be included in the display period DP.

In an exemplary embodiment, the sensing period SP may include a first sensing period SP1 in which a mobility and/or a threshold voltage of a driving transistor is/are sensed and a second sensing period SP2 in which a current characteristic of a light emitting diode (LED) sensed. Also, the sensing period SP may include a pixel reset period PRP.

When the kth stage STk outputs the first and second scan signals SC(k) and SS(k) during the sensing period SP, the third clock signal CLK3 may have a gate-on voltage in the first sensing period SP1 and the second sensing period SP2, and the third sensing clock signal CLK3_SS may have a gate-on voltage during the sensing period SP.

In the sensing period SP, the kth stage STk may output the first scan signal SC(k) in synchronization with the third clock signal CLK3. In an exemplary embodiment, the first scan signal SC(k) may be output at least twice during the vertical blank period VBP. A first first scan signal SC(k) may be output in the first sensing period SP1, and a voltage for sensing a mobility and/or a threshold voltage of the driving transistor M1 shown in FIG. 2 may be supplied to a pixel when the first first scan signal SC(k) is output. A second first scan signal SC(k) may be output in the pixel reset period PRP, and a data voltage that was applied to the corresponding pixel in a previous display period DP may be re-applied when the second first scan signal SC(k) is output.

In addition, during the sensing period SP, the second scan signal SS(k) may be output in synchronization with the third sensing clock signal CLK3_SS.

In the sensing period SP, the display-on signal DIS_ON may have a gate-off voltage, and the first and second control clock signals S_CLK1 and S_CLK2 may have gate-on voltages. In addition, the sampling node SN may have a gate-on voltage during the sensing period SP. Accordingly, during the sensing period SP, the twenty-second transistor T22 and the twenty-third transistor T23 maintain a turn-off state, and the ninth transistor T9 and the tenth transistor T10 maintain the turn-on state.

In an exemplary embodiment, at a first time t1, the second control clock signal S_CLK2 may have a gate-on voltage in synchronization with the third clock signal CLK3 and the third sensing clock signal CLK3_SS. Accordingly, the tenth transistor T10 is turned on, and the gate-on voltage of the first control clock signal S_CLK1 is provided to the first driving node QN1 via the tenth transistor T10 and the ninth transistor T9.

The voltage of the third node N3 is maintained as a relatively high voltage by the diode-coupled eleventh transistor T11, so that excessive voltage amplification of the first driving node QN1 can be prevented or suppressed. For example, the voltage of the first driving node QN1 during the sensing period SP may be smaller than that of the first driving node QN1, which is boosted in the display period DP. However, the voltage of the first driving voltage QN1 during the sensing period SP is a voltage larger than gate-on voltages of the first and second scan signals SC(k) and SS(k), and thus the first and second scan signals SC(k) and SS(k) can be stably output during the sensing period SP.

Subsequently, at a second time t2, the third control clock signal S_CLK3 may have a gate-on voltage. For example, the third control clock signal S_CLK3 may be changed in synchronization with a falling time of the third clock signal CLK3. However, this is merely illustrative, and a rising time of the third control clock signal S_CLK3 is not limited thereto. For example, the rising time of the third control clock signal S_CLK3 may be any time as long as it is prior to a rising time of the display-on signal DIS_ON.

Subsequently, the first and second scan signals SC(k) and SS(k) may be output after the second sensing period SP2 and the pixel reset period PRP.

Since each of the voltage of the sampling node SN and the voltage of the first driving node QN1 has a gate-on voltage during the sensing period SP, the twelfth and thirteenth transistors T12 and T13 may maintain the turn-on state. Therefore, the second driving node QN2 may have a gate-off voltage during the sensing period SP.

At a third time t3 after the sensing period SP, the second control clock signal S_CLK2 may be changed to a gate-off voltage. Then, the tenth transistor T10 may be turned off, and the voltage of the first driving node QN1 may be decreased to a gate-off voltage.

At a fourth time t4 after the sensing period SP, the first control clock signal S_CLK1 may be changed to a gate-off voltage. In an exemplary embodiment, the third time t3 and the fourth time t4 may be included in the vertical blank period VBP. Although a case where the fourth time t4 is posterior to the third time t3 is illustrated in FIG. 5, the present disclosure is not limited thereto. For example, the first control clock signal S_CLK1 and the second control clock signal S_CLK2 may be simultaneously changed to gate-off voltages.

In an exemplary embodiment, the entire gate-on voltage period of the second control clock signal S_CLK2 may overlap with at least a portion of a gate-on voltage period of the first control clock signal S_CLK1.

Subsequently, the display-on signal DIS_ON may have a gate-on voltage, and the display period may be started.

The third control clock signal S_CLK3 may maintain a gate-on voltage until a fifth time t5. When the display period DP is re-started, the voltage of the second driving node QN2 may be increased by the first clock signal CLK1. Therefore, the fourteenth and fifteenth transistors T14 and T15 may maintain the turn-on state, and the voltage of the first driving node QN1 may be maintained as a predetermined low level (gate-off voltage) by the gate-off voltage of the carry signal CR(k).

Thus, an unintended increase in voltage of the first driving node QN1 after the vertical blank period VBP can be prevented or suppressed, and the first and second scan signals SC(k) and SS(k) can be stably output in the display period DP.

In an exemplary embodiment, the fifth time t5 at which the third control clock signal S_CLK3 is changed to the gate-off voltage may be before the reset period RP after the display period DP is started.

In an exemplary embodiment, the sensing-on signal SEN_ON may have a gate-on voltage in the reset period RP. The reset period RP may be set as a period after the fifth time t5. The (k+2)th carry signal CR(k+2) has a gate-off voltage, and therefore, the voltage of the sampling node SN may be reset as a gate-off voltage.

As described above, in the scan driver 100 in accordance with the exemplary embodiment of the present disclosure, an excessive increase in drain-source voltage of the transistors coupled to the first driving node QN1 can be prevented or suppressed, and current leakage to the first driving node QN1 can be prevented or suppressed. Accordingly, the first and second scan signals SC(k) and SS(k) can be stably output even in long time use. In addition, an unintended increase in voltage at the first driving node QN1 after the sensing period SP is ended by the fourteenth and fifteenth transistors T14 and T15 can be prevented or suppressed. Accordingly, the first and second scan signals SC(k) and SS(k) can be stably output.

Figure 6:
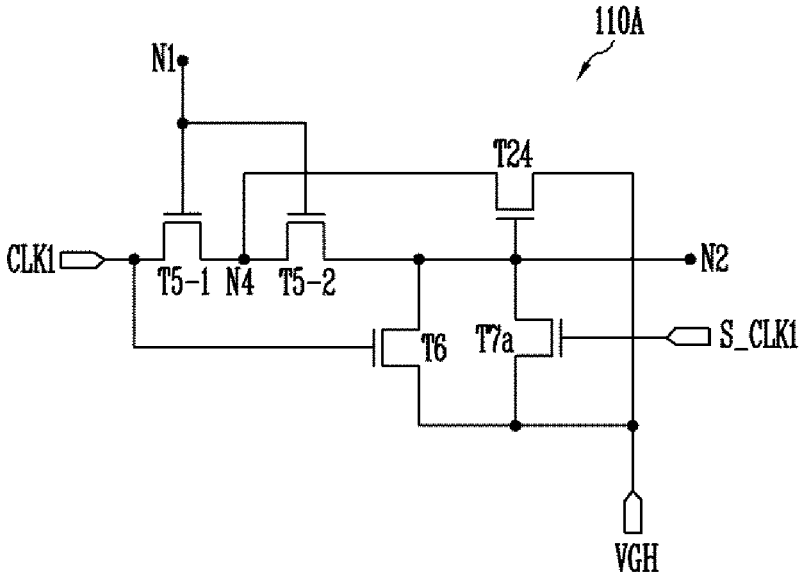
FIG. 6 is a schematic circuit diagram illustrating an example of a portion of a first driving controller included in the stage shown in FIG. 4.

FIG. 6 is a schematic circuit diagram illustrating an example of a portion of the first driving controller included in the stage shown in FIG. 4.

In FIG. 6, components identical to those described with reference to FIGS. 3 and 4 are designated by like reference numerals, and their overlapping descriptions will be omitted.

In an exemplary embodiment, the stage shown in FIG. 6 may have a configuration substantially identical or similar to the stage STk shown in FIG. 4, except the configuration of a first driving controller 110A.

Referring to FIGS. 3, 4, 5, and 6, the first driving controller 110A may include a first transistor T1, a second transistor T2, a third transistor T3, a fourth transistor T4, a plurality of fifth transistor T5-1 and T5-2, a sixth transistor T6, a seventh transistor T7*a* and a twenty-fourth transistor T24.

The first to fourth transistors T1 to T4 and the sixth transistor T6 are configured identically to those included in the first driving controller 110 shown in FIG. 4, and therefore, their overlapping descriptions will be omitted.

The first driving controller 110A may include the plurality of fifth transistors T5-1 and T5-2 coupled in series. The fifth transistors T5-1 and T5-2 may be coupled between the first clock terminal CK1 to which the first clock signal CLK1 is applied and the second node N2. Gate electrodes of the fifth transistors T5-1 and T5-2 may be commonly coupled to the first node N1.

An unintended voltage drop can be minimized by the fifth transistors T5-1 and T5-2 coupled in series.

The twenty-fourth transistor T24 may be coupled between the first power terminal V1 to which the first power source VGH is supplied and an intermediate node N4 between the fifth transistors T5-1 and T5-2. The twenty-fourth transistor T24 may include a gate electrode coupled to the second node N2.

The twenty-fourth transistor T24 holds a voltage of the intermediate node N4 as the voltage of the first power source VGH in response to the voltage of the second node N2, so that an unnecessary increase in drain-source voltage of the fifth transistors T5-1 and T5-2 can be prevented or suppressed. Thus, current leakage to the second node N2 can be prevented or suppressed.

The seventh transistor T7*a* may be coupled between the first power terminal V1 and the second node N2. The seventh transistor T7*a* may include a gate electrode coupled to the first control clock terminal S_CK1 to which the first control clock signal S_CLK1 is applied.

The seventh transistor T7*a* may maintain the turn-on state during the vertical blank period VBP (i.e., the sensing period SP) in response to the first control clock signal S_CLK1. Thus, the voltage of the second node N2 can be stably maintained as a gate-off voltage during the sensing period SP.

In an exemplary embodiment, the gate electrode of the seventh transistor T7*a* may be coupled to the second node N2.

As described above, current leakage to the second node N2 and an unintended voltage fluctuation can be minimized by the fifth transistors T5-1 and T5-2, the seventh transistor T7*a*, and the twenty-fourth transistor T24, which are included in the first driving controller 110A.

Figure 7:
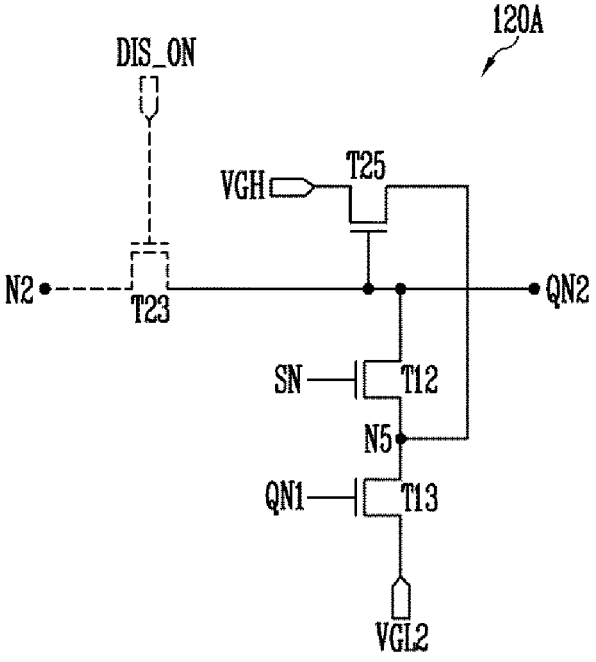
FIG. 7 is a schematic circuit diagram illustrating an example of a portion of a second driving controller included in the stage shown in FIG. 4.

FIG. 7 is a schematic circuit diagram illustrating an example of a portion of the second driving controller included in the stage shown in FIG. 4.

In FIG. 7, components identical to those described with reference to FIGS. 3 and 4 are designated by like reference numerals, and their overlapping descriptions will be omitted.

In an exemplary embodiment, the stage shown in FIG. 7 may have a configuration substantially identical or similar to the stage STk shown in FIG. 4, except the configuration of a second driving controller 120A.

Referring to FIGS. 3, 4, 5, 6, and 7, the second driving controller 120A may include eighth to fifteenth transistors T8 to T15 and a twenty-fifth transistor T25.

The eighth to fifteenth transistors T8 to T15 are configured identically to those included in the second driving controller 120 shown in FIG. 4, and therefore, their overlapping descriptions will be omitted.

The second driving controller 120A may further include the twenty-fifth transistor T25. The twenty-fifth transistor T25 may be coupled between the first power terminal V1 to which the first power source VGH is supplied and an intermediate node N5 between the twelfth transistor T12 and the thirteenth transistor T13. The twenty-fifth transistor T25 may include a gate electrode coupled to the second driving node QN2.

The twenty-fifth transistor T25 holds a voltage of the intermediate node N5 as the voltage of the first power source VGH in response to the voltage of the second driving node QN2, so that an unnecessary increase in drain-source voltage of the twelfth and thirteenth transistors T12 and T13 can be prevented or suppressed. Thus, current leakage to the second driving node QN2 can be prevented or suppressed.

Figure 8:
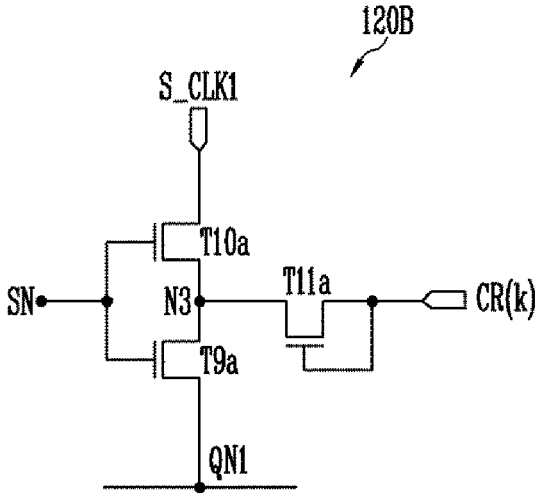
FIG. 8 is a schematic circuit diagram illustrating an example of the portion of a second driving controller included in the stage shown in FIG. 4.

FIG. 8 is a schematic circuit diagram illustrating an example of the portion of the second driving controller included in the stage shown in FIG. 4.

The stage shown in FIG. 8 may have a configuration substantially identical or similar to the stage STk shown in FIG. 4, except the configuration of ninth and tenth transistors T9*a* and T10*a*.

Referring to FIGS. 3, 4, 5, 6, 7, and 8, a second driving controller 120B may include an eighth transistor T8, a ninth transistor T9*a*, a tenth transistor T10*a*, an eleventh transistor T11*a*, a twelfth transistor T12, a thirteenth transistor T13, a fourteenth transistor T14, and a fifteenth transistor T15.

In an exemplary embodiment, the second driving controller 120B may further include the twenty-fifth transistor T25 shown in FIG. 7.

The eighth transistor T8 and the twelfth to fifteenth transistors T12 to T15 are configured identically to those included in the second driving controller 120 shown in FIG. 4, and therefore, their overlapping descriptions will be omitted.

The ninth transistor T9*a* and the tenth transistor T10*a* may be coupled in series between the first control clock terminal S_CK1 to which the first control clock signal S_CLK1 is applied and the first driving node QN1. Gate electrodes of the ninth and tenth transistors T9*a* and T10*a* may be commonly coupled to the sampling node SN.

The eleventh transistor T11*a* may be diode-coupled between the third node N3 and the carry output terminal CR outputting the carry signal CR(k).

Operations of the ninth to eleventh transistors T9*a*, T10*a*, and T11*a* are similar to those of the ninth to eleventh transistors T9, T10, and T11 shown in FIG. 4, and therefore, their overlapping descriptions will be omitted.

In the stage in accordance with this embodiment, the second control clock signal S_CLK2 and the second control clock terminal S_CK2 receiving the same may be omitted, and thus the configuration of the scan driver and the display device having the same can be simplified.

Figure 9:
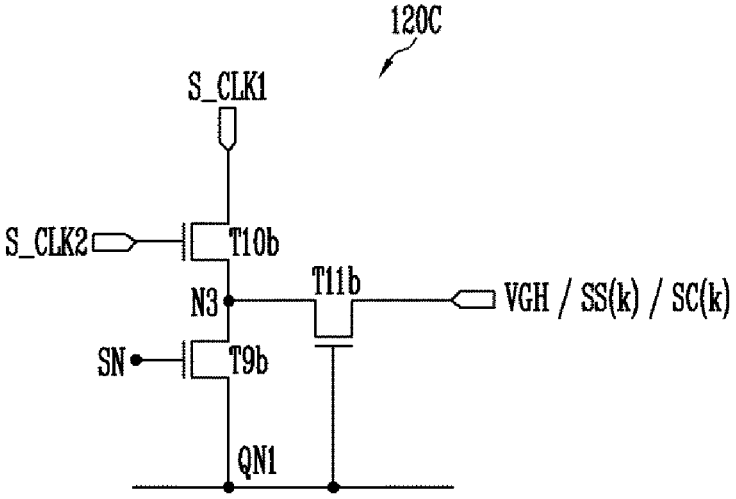
FIG. 9 is a schematic circuit diagram illustrating an example of the portion of a second driving controller included in the stage shown in FIG. 4.

FIG. 9 is a schematic circuit diagram illustrating an example of the portion of the second driving controller included in the stage shown in FIG. 4.

The stage shown in FIG. 9 may have a configuration substantially identical or similar to the stage STk shown in FIG. 4, except the configuration of an eleventh transistor T11*b*.

Referring to FIGS. 3, 4, 5, 6, 7, and 9, a second driving controller 120C may include eighth to fifteenth transistors T8 to T15. In an exemplary embodiment, the second driving controller 120C may further include the twenty-fifth transistor T25 shown in FIG. 7.

A ninth transistor T9*b* and a tenth transistor T10*b* may be substantially identical to the ninth and tenth transistors T9 and T10 shown in FIG. 4, respectively.

In an exemplary embodiment, an eleventh transistor T11*b* may be coupled between the third node N3 and the first power terminal V1 to which the first power source VGH is supplied. The eleventh transistor T11*b* may include a gate electrode coupled to the first driving node QN1.

The eleventh transistor T11*b* may provide the voltage of the first power source VGH to the third node N3 in response to the voltage of the first driving node QN1. Thus, an unnecessary increase in drain-source voltage of the ninth and tenth transistors T9*b* and T10*b* can be prevented or suppressed, and current leakage to the first driving node QN1 can be prevented or suppressed.

In an exemplary embodiment, one terminal of the eleventh transistor T11*b* may be coupled to the first output terminal OUT1 outputting the first scan signal SC(k) or the second output terminal OUT2 outputting the second scan signal SS(k), instead of the first power terminal V1.

Operations of the ninth to eleventh transistors T9*b* to T11*b* are similar to those of the ninth to eleventh transistors T9 to T11 shown in FIG. 4, and therefore, their overlapping descriptions will be omitted.

Figure 10:
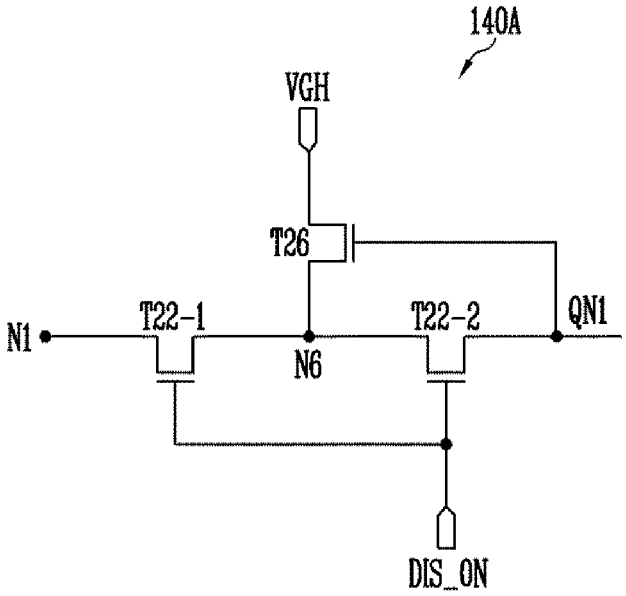
FIG. 10 is a schematic circuit diagram illustrating an example of a portion of a coupling controller included in the stage shown in FIG. 4.

FIG. 10 is a schematic circuit diagram illustrating an example of a portion of the coupling controller included in the stage shown in FIG. 4.

The coupling controller shown in FIG. 10 has a configuration substantially identical or similar to the coupling controller shown in FIG. 4, except a plurality of twenty-second transistors T22-1 and T22-1 and a twenty-sixth transistor T26, and therefore, overlapping descriptions will be omitted.

Referring to FIGS. 3, 4, 5, and 10, the coupling controller 140A may include the plurality of twenty-second transistors T22-1 and T22-2, a twenty-third transistor T23, and the twenty-sixth transistor T26.

The plurality of twenty-second transistors T22-1 and T22-2 may be coupled in series between the first node N1 and the first driving node QN1. Gate electrodes of the plurality of twenty-second transistors T22-1 and T22-2 may be commonly coupled to the third input terminal IN3 to which the display-on signal DIS_ON is applied.

The twenty-sixth transistor T26 may be coupled between the first power terminal V1 to which the first power source VGH is supplied and an intermediate node N6 between the plurality of twenty-second transistors T22-1 and T22-2. The twenty-sixth transistor T26 may include a gate electrode coupled to the first driving node QN1.

The twenty-sixth transistor T26 supplies the voltage of the first power source VGH to the intermediate node N6 in response to the voltage of the first driving node QN1, so that an unnecessary increase in drain-source voltage of the plurality of twenty-second transistors T22-1 and T22-2 can be prevented or suppressed. Accordingly, degradation of the transistors included in the stage can be minimized.

Figure 11:
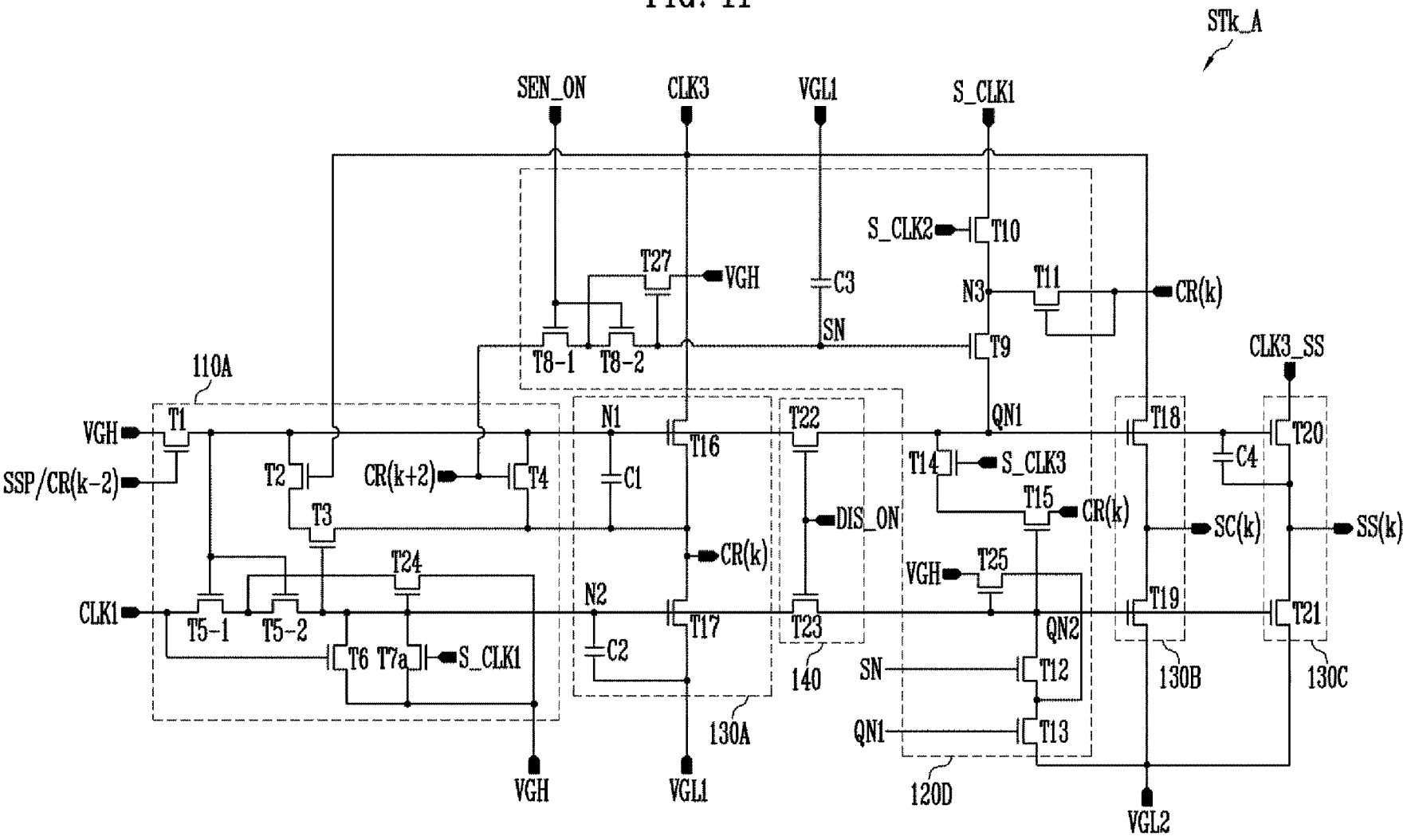
FIG. 11 is a schematic circuit diagram illustrating an example of the stage included in the scan driver shown in FIG. 3.

FIG. 11 is a schematic circuit diagram illustrating an example of the stage included in the scan driver shown in FIG. 3.

The stage shown in FIG. 11 may have a configuration substantially identical or similar to the stage STk_A shown in FIG. 4, except some components of first and second driving controllers. Descriptions of components overlapping with those shown in FIGS. 3, 4, 6, and 7 will be omitted.

Referring to FIGS. 3, 4, 5, 6, 7, and 11, the stage STk_A may include the first driving controller 110A, a second driving controller 120D, the output buffers 130A, 130B, and 130C, and the coupling controller 140.

In an exemplary embodiment, as shown in FIG. 11, a portion of the first driving controller 110A shown in FIG. 6 may be applied to the first driving controller 110 shown in FIG. 4, and a portion of the second driving controller 120A shown in FIG. 7 may be applied to the second driving controller 120 shown in FIG. 4.

In an exemplary embodiment, the second driving controller 120D may include a plurality of eighth transistors T8-1 and T8-2 and a twenty-seventh transistor T27.

The plurality of eighth transistors T8-1 and T8-2 may be coupled in series between the fourth input terminal IN4 to which the next carry signal CR(k+2) is supplied and the sampling node SN. Gate electrodes of the plurality of eighth transistors T8-1 and T8-2 may be commonly coupled to the second input terminal IN2 to which the sensing-on signal SEN_ON is applied.

The twenty-seventh transistor T27 may be coupled between the first power terminal V1 to which the first power source VGH is supplied and an intermediate node between the plurality of eighth transistors T8-1 and T8-2. The twenty-seventh transistor T27 may include a gate electrode coupled to the sampling node SN.

The twenty-seventh transistor T27 supplies the voltage of the first power source VGH to the intermediate node in response to the voltage of the sampling node SN, so that an unnecessary increase in drain-source voltage of the plurality of eighth transistors T8-1 and T8-2 can be prevented or suppressed. Accordingly, degradation of the transistors included in the stage.

In some embodiments, at least one configuration among transistor configurations shown in FIGS. 8, 9, and 10 may be applied to the stage STk and STk_A shown in FIGS. 4 and 11.

As described above, the scan driver and the display device having the same in accordance with the exemplary embodiment of the present disclosure can include a configuration that stabilize a change in voltage of at least one of the first node N1, the second node N2, the first driving node QN1, the second driving node QN2, and the sampling node SN and minimizes degradation of the transistors included in the stage. Thus, the first and second scan signals SC(k) and SS(k) can be stably output in the display period and the sensing period even in long time use, and the reliability of the display device can be improved.

Figure 12:
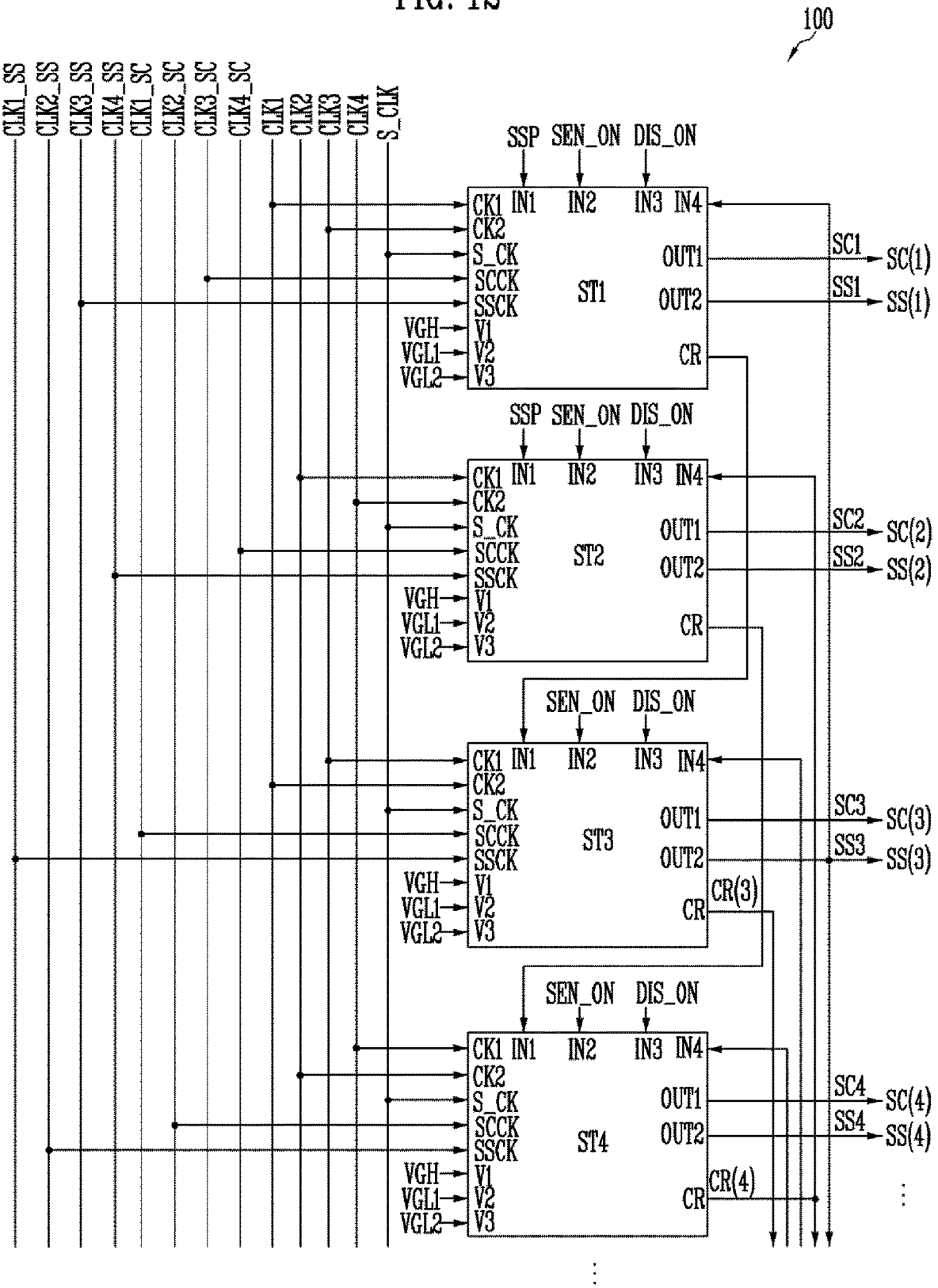
FIG. 12 is a diagram illustrating a scan driver according to an exemplary embodiment.

FIG. 12 is a diagram illustrating a scan driver according to an exemplary embodiment.

In FIG. 12, components similar or identical to those described with reference to FIG. 3 are designated by like reference numerals, and their overlapping descriptions will be omitted.

Referring to FIG. 12, the scan driver 100 may include a plurality of stages ST1, ST2, ST3, ST4, . . . , and STn.

In some embodiments, each of the stages ST1, ST2, ST3, ST4, . . . , and STn may include a first input terminal IN1, a second input terminal IN2, a third input terminal IN3, a fourth input terminal IN4, a first clock terminal CK1, a second clock terminal CK2, a control clock terminal S_CK, a sensing clock terminal SSCK, a scan clock terminal SCCK, a first power terminal V1, a second power terminal V2, a third power terminal V3, a carry output terminal CR, a first output terminal OUT1, and a second output terminal OUT2.

The first input terminal IN1 may receive the scan start signal SSP or a carry signal from a preceding stage. The second input terminal IN2 may receive a sensing-on signal SEN_ON. The third input terminal IN3 may receive a display-on signal DIS_ON. The fourth input terminal IN4 may receive a subsequent carry signal. The subsequent carry signal may be one of carry signals supplied after a predetermined time elapses from when a carry signal of a current stage is output.

Clock signals having a difference of a half period, e.g., first and third clock signals CLK1 and CLK3 may be applied to the first clock terminal CK1 and the second clock terminal CK2 of the nth stage. Second and fourth clock signals CLK2 and CLK4 may be applied to the first clock terminal CK1 and the second clock terminal CK2 of an (n+1)th stage.

The control clock terminal S_CK may receive a control clock signal S_CLK. The control clock signal S_CLK may have the gate-on voltage in the sensing period, and charge the gate-on voltage in a first driving node QN1.

The sensing clock terminal SSCK may receive one of sensing clock signals CLK1_SS to CLK4_SS. For example, the sensing clock terminal SSCK may receive a sensing clock signal having the same waveform as the clock signal input to the second clock terminal CK2 during the display period DP.

The sensing clock signals CLK1_SS to CLK4_SS may have the gate-on voltage in the sensing period in which the mobility and the threshold voltage of the driving transistor included in the pixel and the current characteristic of the organic light emitting diode OLED included in the pixel are sensed. The sensing clock signals CLK1_SS to CLK4_SS may have the gate-on voltage synchronized with the output of a sensing signal SS(k). In an exemplary embodiment, the sensing clock signals CLK1_SS to CLK4_SS may be configured to have a difference of a half period or more. In various exemplary embodiments, the sensing clock signals CLK1_SS to CLK4_SS may be set to have the same waveforms synchronized with the clock signals CLK1 to CLK4, respectively during the display period DP.

In an exemplary embodiment, a first sensing clock signal CLK1_SS having the same waveform synchronized with the first clock signal CLK1 may be applied to the sensing clock terminal SSCK of the nth stage, and a second sensing clock signal CLK2_SS_having the same waveform synchronized with the second clock signal CLK2 may be applied to the sensing clock terminal SSCK of the (n+1)th stage during the display period DP. In addition, a third sensing clock signal CLK3_SS having the same waveform synchronized with the third clock signal CLK3 may be applied to the sensing clock terminal SSCK of an (n+2)th stage, and a fourth sensing clock signal CLK4_SS having the same waveform synchronized with the fourth clock signal CLK4 may be applied to the sensing clock terminal SSCK of an (n+3)th stage during the display period DP.

In an exemplary embodiment, a gate-on voltage period of each of the first to fourth sensing clock signals CLK1_SS to CLK4_SS may correspond to two horizontal periods 2H. In addition, the gate-on voltage period of the first sensing clock signal CLK1_SS and the gate-on voltage period of the second sensing clock signal CLK2_SS may overlap with each other during one horizontal period 1H. However, this is merely illustrative, and the waveform relationship between the sensing clock signals CLK1_SS to CLK4_SS is not limited thereto.

The scan clock terminal SCCK may receive one of scan clock signals CLK1_SC to CLK4_SC. For example, the scan clock terminal SSCK may receive a scan clock signal having the same waveform as the clock signal input to the second clock terminal CK2 during the display period DP.

The scan clock signals CLK1_SC to CLK4_SC may have the gate-on voltage in the sensing period in which the mobility and threshold voltage of the driving transistor of the pixel are sensed.

The scan clock signals CLK1_SC to CLK4_SC may have the gate-on voltage synchronized with the output of a scan signal SC(k). In an exemplary embodiment, the scan clock signals CLK1_SC to CLK4_SC may be configured to have a difference of a half period or more. In various exemplary embodiments, the scan clock signals CLK1_SC to CLK4_SC may be set to have the same waveforms synchronized with the clock signals CLK1 to CLK4, respectively, during the display period DP.

In an exemplary embodiment, a first scan clock signal CLK1_SC having the same waveform synchronized with the first clock signal CLK1 may be applied to the scan clock terminal SCCK of the (4*a*+1)th stage, and a second scan clock signal CLK2_SC having the same waveform synchronized with the second clock signal CLK may be applied to the scan clock terminal SCCK of the (4*a*+2)th stage during the display period DP. In addition, a third scan clock signal CLK3_SC having the same waveform synchronized with the third clock signal CLK3 may be applied to the scan clock terminal SCCK of the (4*a*+3)th stage, and a fourth scan clock signal CLK4_SC having the same waveform synchronized with the fourth clock signal CLK4 may be applied to the scan clock terminal SCCK of the (4*a*+4)th stage during the display period DP. (Here, a may be 0 or natural number, where 4*a*+4 is equal to or smaller than n).

In an exemplary embodiment, a gate-on voltage period of each of the first to fourth scan clock signals CLK1_SC to CLK4_SC may correspond to two horizontal periods 2H. In addition, the gate-on voltage period of the first scan clock signal CLK1_SC and the gate-on voltage period of the second scan clock signal CLK2_SC may overlap with each other during one horizontal period 1H. However, this is merely illustrative, and the waveform relationship between the scan clock signals CLK1_SC to CLK4_SC is not limited thereto.

Figure 13:
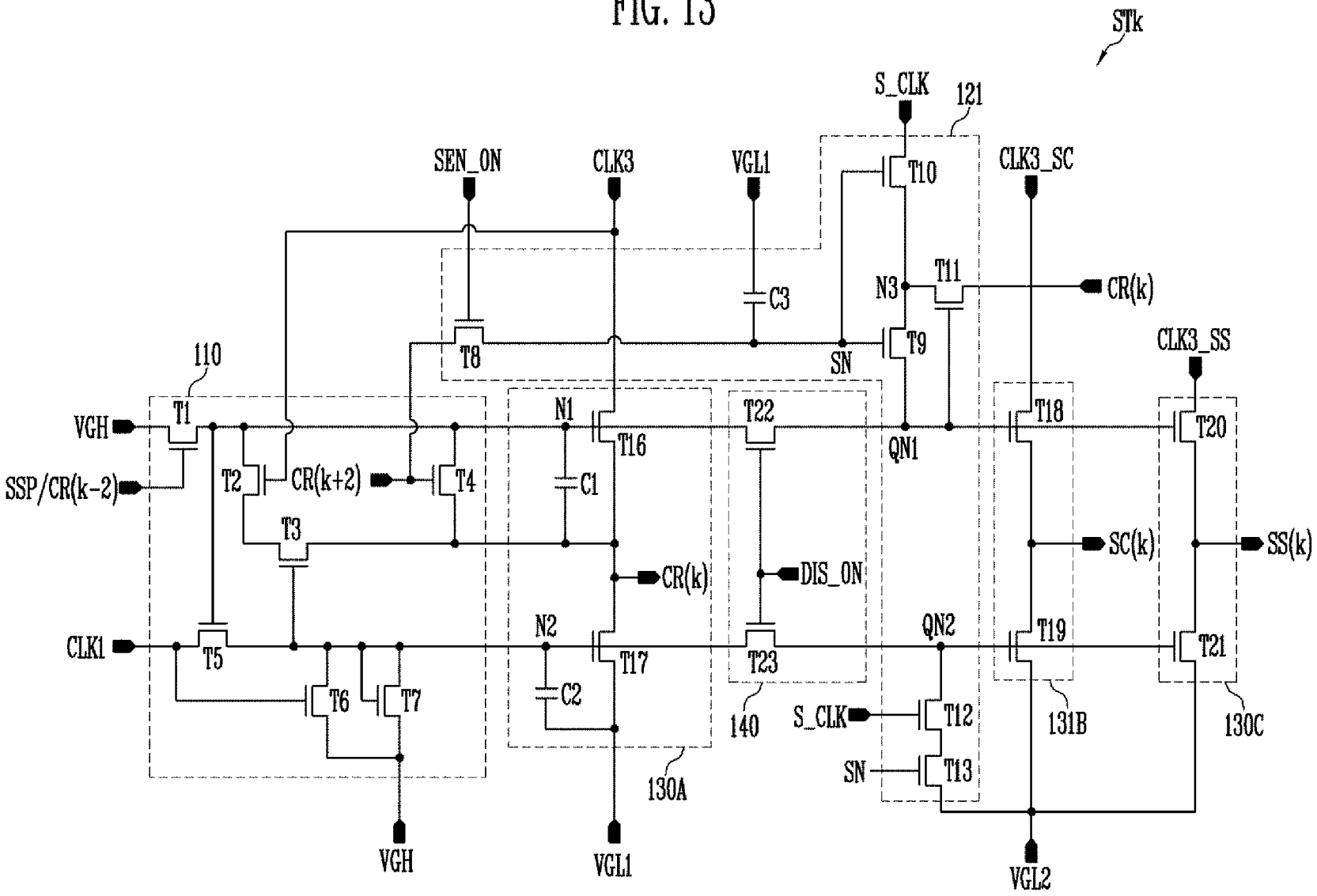
FIG. 13 is a circuit diagram illustrating an example of a stage included in the scan driver shown in FIG. 12.

FIG. 13 is a circuit diagram illustrating an example of a stage included in the scan driver shown in FIG. 12.

In FIG. 13, components identical to those described with reference to FIG. 4 are designated by like reference numerals, and their overlapping descriptions will be omitted.

In an exemplary embodiment, the stage STk shown in FIG. 13 may have a configuration substantially identical or similar to the stage STk shown in FIG. 4, except the configuration of a second driving controller 121 and an output buffer 131B.

Referring to FIGS. 1, 12, and 13, the kth stage STk may include the first driving controller 110, a second driving controller 121, output buffers 130A, 131B, and 130C, and the coupling controller 140.

The second driving controller 121 may control the voltage of the first driving node QN1 and the voltage of the second driving node QN2 during a sensing period. In the sensing period, the output of the scan signal SC(k) may be controlled by the voltage of the first driving node QN1 and the voltage of the second driving node QN2.

In an exemplary embodiment, the second driving controller 121 may include eighth to eleventh transistors T8 to T11 for controlling the voltage of the first driving node QN1 and twelfth and thirteenth transistors T12 and T13 for controlling the voltage of the second driving node QN2. The second driving controller 121 may further include a third capacitor C3.

The ninth transistor T9 and the tenth transistor T10 may be coupled in series between the control clock terminal S_CK to which the control clock signal S_CLK is applied and the first driving node QN1. A node between the ninth transistor T9 and the tenth transistor T10 may be defined as the third node N3.

The ninth and tenth transistors T9 and T10 may include gate electrodes commonly coupled to the sampling node SN. The ninth and tenth transistors T9 and T10 may transfer the control clock signal S_CLK to the first driving node QN1, based on the voltage of the sampling node SN. In an exemplary embodiment, the control clock signal S_CLK may have the gate-on voltage in the sensing period.

The eleventh transistor T11 may be coupled between the third node N3 and the carry output terminal CR from which the kth carry signal CR(k) is output. The eleventh transistor T11 may include a gate electrode coupled to the first driving node QN1.

The ninth to eleventh transistors T9 to T11 hold a voltage of the third node N3 as the voltage of the carry signal CR(k) in response to the voltage of the first driving node QN1, so that an unnecessary drain-source voltage increase of the ninth transistor T9 can be prevented or reduced. Thus, the stable output of the scan signal SC(k) can be ensured, and the reliability of the display device can be improved.

The twelfth transistor T12 and the thirteenth transistor T13 may be coupled in series between the third power terminal V3 to which the third power source VGL2 is applied and the second driving node QN2. The twelfth transistor T12 may include a gate electrode that receives the control clock signal S_CLK, and the thirteenth transistor T13 may include a gate electrode coupled to the sampling node SN. In the sensing period, the twelfth and thirteenth transistors T12 and T13 may be turned on, and the voltage of the third power source VGL2 may be applied to the second driving node QN2.

The eighteenth transistor T18 may be coupled between the scan clock terminal SCCK to which the third scan clock signal CLK3_SC is applied and the first output terminal OUT1. The eighteenth transistor T18 may include a gate electrode coupled to the first driving node QN1. The eighteenth transistor T18 may supply the gate-on voltage to the first output terminal OUT1 in response to the voltage of the first driving node QN1.

The nineteenth transistor T19 may be coupled between the first output terminal OUT1 and the third power terminal V3 to which the third power source VGL2 is applied. The nineteenth transistor T19 may include a gate electrode coupled to the second driving node QN2. The nineteenth transistor T19 may supply the gate-off voltage to the first output terminal OUT1 in response to the voltage of the second driving node QN2.

Accordingly, the scan driver 100 having the stages STk of FIG. 13 is supplied with each of the clock signal (in the above, the third clock signal CLK3) for outputting the carry signal CR(k), the scan clock signal CLK_SC (in the above, the third scan clock signal CLK3_SC) for outputting the scan signal SC(k), and the sensing clock signal CLK_SS (in the above, the third sensing clock signal CLK3_SS) for outputting the sensing signal SS(k). Thus, the scan driver 100 according to the exemplary embodiment independently controls the output of the scan signal SC(k) and the sensing signal SS(k), and can sense not only the mobility and threshold voltage of the driving transistor included in the pixel but also the current characteristic of the organic light emitting diode OLED during the sensing period. Further, the scan driver 100 according to the exemplary embodiment can output a plurality of scan signals and a plurality of sensing signals in one sensing period, using a plurality of scan clock signals CLK_SC and a plurality of sensing clock signals CLK_SS. Accordingly, a plurality of pixel rows can be sensed in one sensing period.

Figure 14:
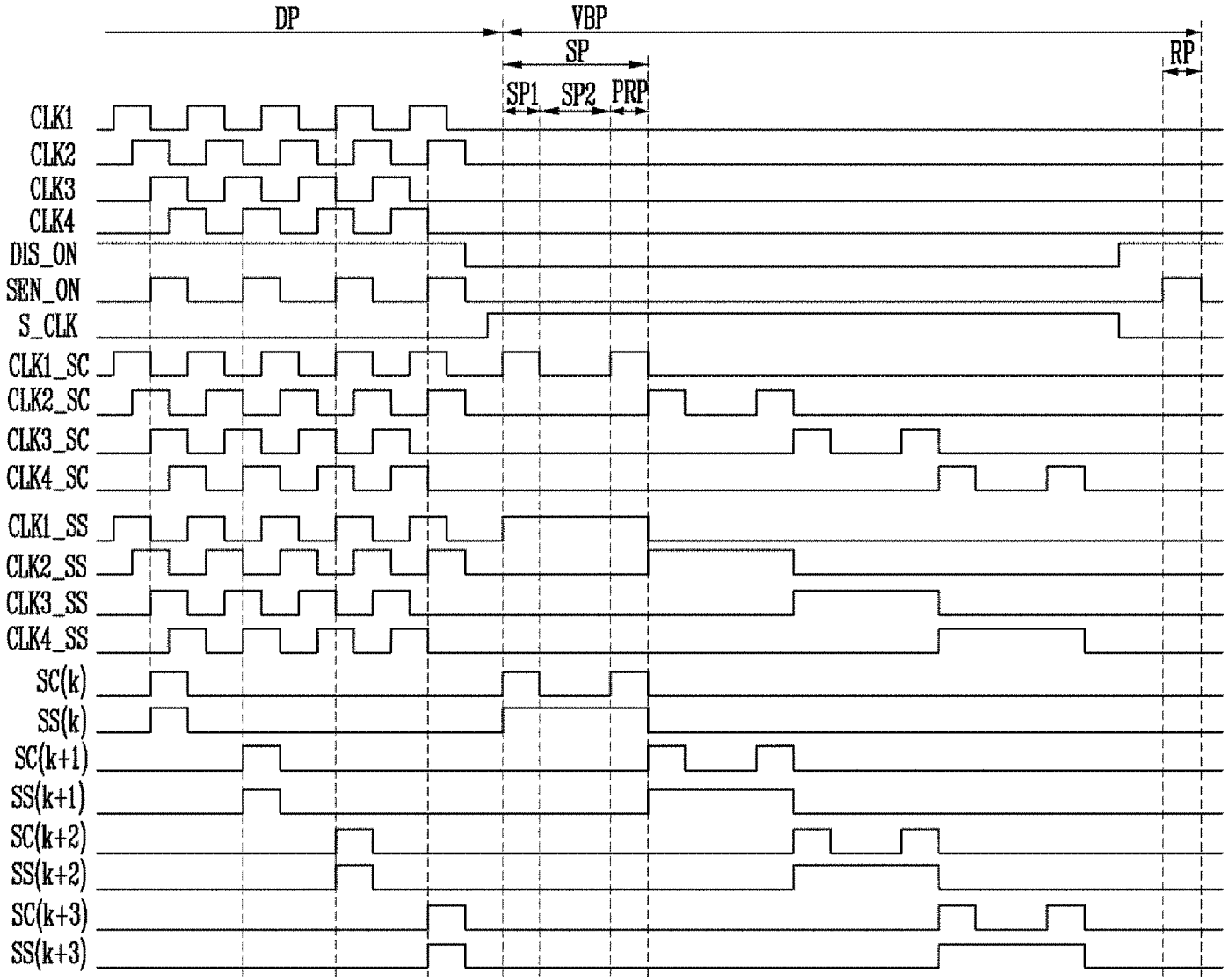
FIG. 14 is a timing diagram illustrating an example of an operation of the stage shown in FIG. 13.

FIG. 14 is a timing diagram illustrating an example of an operation of the stage shown in FIG. 13.

In FIG. 14, components identical to those described with reference to FIG. 5 are designated by like reference numerals, and their overlapping descriptions will be omitted. In FIG. 14, operations of kth to (k+3)th stages STk to STk+3 will be mainly described. In addition, positions, widths, heights, etc. of waveforms shown in FIG. 14 are merely illustrative, and the exemplary embodiments are not limited thereto.

Referring to FIGS. 1, 12, 13, and 14, the scan driver 100 including the kth to (k+3)th stages STk to ST(k+3) may sequentially output a scan signal.

In this embodiment, the scan driver 100 is supplied with four clock signals CLK, four scan clock signals CLK_SC, and four sensing clock signals CLK_SS, and therefore, an example in which the sensing-on signal SEN_ON is supplied to four stages during the display period DP is illustrated. However, the exemplary embodiments are not limited thereto.

In some embodiments, when the (k−2)th carry signal CR(k−2) is applied in synchronization with the first clock signal CLK1 applied to the first clock terminal CK1, the voltage of the first node N1 may be precharged. However, this is merely illustrative, and the (k−1)th carry signal CR(k−1) may be applied instead of the (k−2)th carry signal CR(k−2). That is, the voltage of the first node N1 and the voltage of the first driving node QN1 may be precharged before the kth scan signal SC(k) is output.

Subsequently, when the third clock signal CLK3 and the third scan clock signal CLK3_SC have the gate-on voltage, the voltage of the first node N1 and the voltage of the first driving node QN1 may be boosted by the first capacitor C1. In addition, the kth carry signal CR(k) may be output in synchronization with the third clock signal CLK3, and the kth carry signal CR(k) and the kth scan signal SC(k) may be output in synchronization with the third scan clock signal CLK3_SC.

Subsequently, the (k+2)th carry signal CR(k+2) and the sensing-on signal SEN_ON may be simultaneously applied. At least one stage that receives the sensing-on signal SEN_ON may output a scan signal SC(k) in the subsequent vertical blank period VBP. The voltage of the first node N1 and the voltage of the first driving node QN1 may be discharged in response to the (k+2)th carry signal CR(k+2), and the gate-on voltage may be charged and maintained in the sampling node SN in response to the sensing-on signal SEN_ON.

When the control clock signal S_CLK has the gate-on voltage and the display-on signal DIS_ON has the gate-off voltage, the voltage of the first driving node QN1 may be charged by the control clock signal S_CLK.

Subsequently, the kth stage STk may output the scan signal SC(k) in synchronization with the third scan clock signal CLK3_SC applied to the scan clock terminal SCCK. In an exemplary embodiment, the scan signal SC(k) may be output at least twice during the vertical blank period VBP.

Also, the kth stage STk may output a sensing signal SS(k) in synchronization with the third sensing clock signal CLK3_SS applied to the sensing clock terminal SSCK. In an exemplary embodiment, the sensing signal SS(k) may be output in the first sensing period SP1, the second sensing period SP2, and the pixel reset period PRP. The mobility and threshold voltage of the driving transistor may be sensed based on the voltage supplied to the pixel by the first scan signal SC(k) and the sensing current supplied to the pixel by the sensing signal SS(k) in the first sensing period SP1. In addition, the current characteristic of the organic light emitting diode OLED may be sensed based on the sensing current supplied to the pixel by the sensing signal SS(k) in the second sensing period SP2.

The at least one stage that receives the sensing-on signal SEN_ON during the display period DP sequentially performs the above-described operations in the sensing period SP. That is, during the vertical blank period VBP, the first to fourth scan clock signals CLK1_SC to CLK4_SC and the first to fourth sensing clock signals CLK1_SS to CLK4_SS are sequentially output as shown in FIG. 14, so that the scan signal and the sensing signal are sequentially supplied to the kth stage STk, the (k+1)th stage STk+1, the (k+2)th stage STk+2, and the (k+3)th stage STk+3, thereby performing sensing on the pixel.

Subsequently, in the reset period RP, the sensing-on signal SEN_ON may have the gate-on voltage. Since the (k+2)th carry signal CR(k+2) has the gate-off voltage, the voltage of the sampling node SN may be reset.

Figure 15:
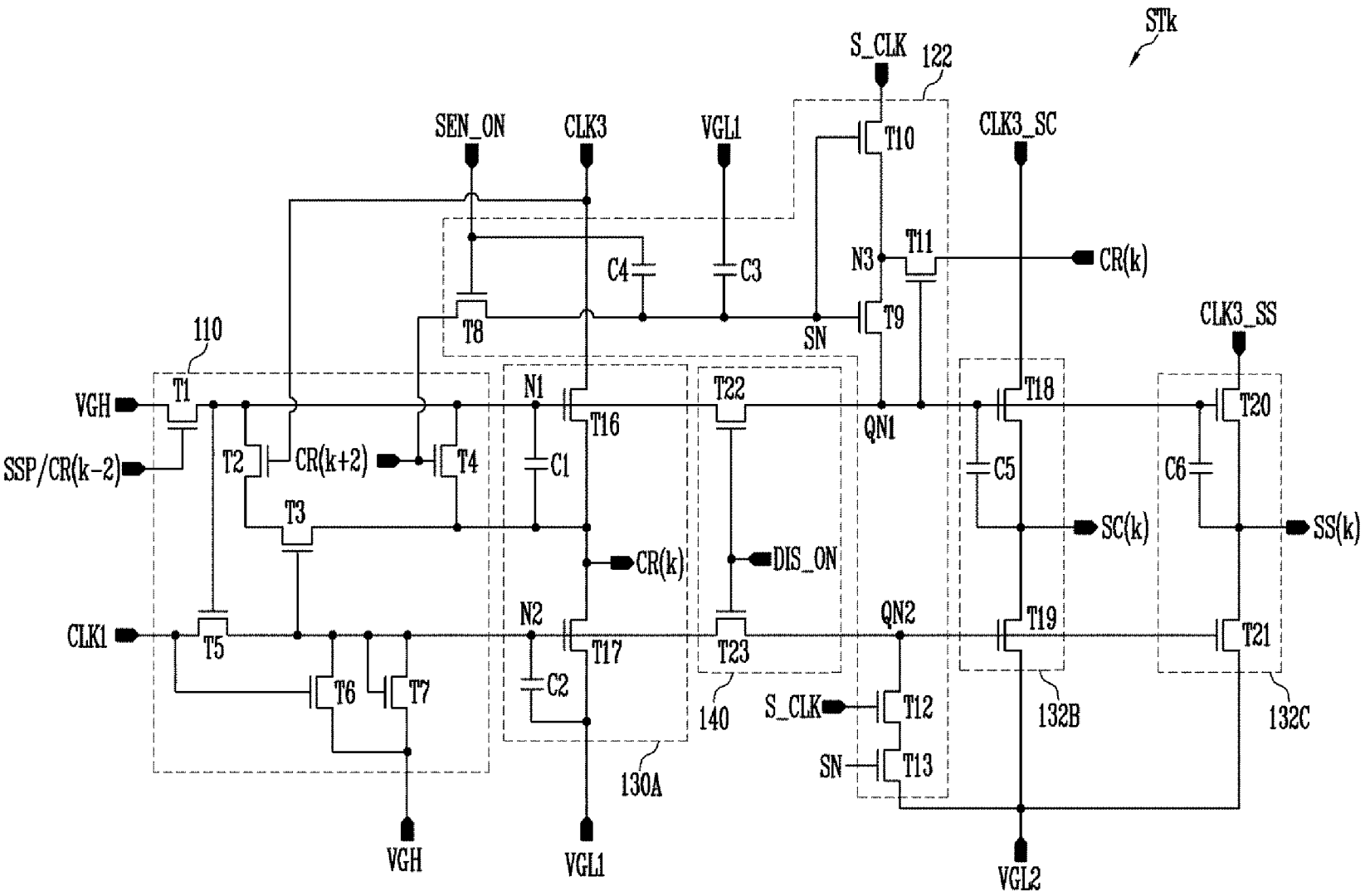
FIG. 15 is a circuit diagram illustrating an example of a stage included in the scan driver shown in FIG. 12.

FIG. 15 is a circuit diagram illustrating an example of the stage included in the scan driver shown in FIG. 12.

Referring to FIG. 15, the kth stage STk may further include a fourth capacitor C4, a fifth capacitor C5, and a sixth capacitor C6, as compared with the embodiment shown in FIG. 13.

Specifically, a second driving controller 122 may further include the fourth capacitor C4. The fourth capacitor C4 may be coupled between the gate electrode of the eighth transistor T8 and the sampling node SN.

In addition, an output buffer 132B may further include the fifth capacitor C5. The fifth capacitor C5 may be coupled between the first driving node QN1 and the first output terminal OUT1.

An output buffer 132C may further include the sixth capacitor C6. The sixth capacitor C6 may be coupled between the first driving node QN1 and the second output terminal OUT2.

The fourth capacitor C4, the fifth capacitor C5, and the sixth capacitor C6 are further provided, so that the stage STk can be stronger against a negative threshold voltage condition.

The scan driver of FIGS. 12, 13, 14, and 15 outputs a scan signal and a sensing signal, using clock signals for respectively generating the scan signal, the sensing signal, and a carry signal, so that a plurality of pixel rows can be sensed during the vertical blank period.

Further, the display device 1000 includes the scan driver, so that the reliability of the display device can be improved. In addition, a problem of the data voltage charging rate being decreased for a high resolution display device, such as 4 k UHD image quality, may be prevented or reduced.

Figure 16:
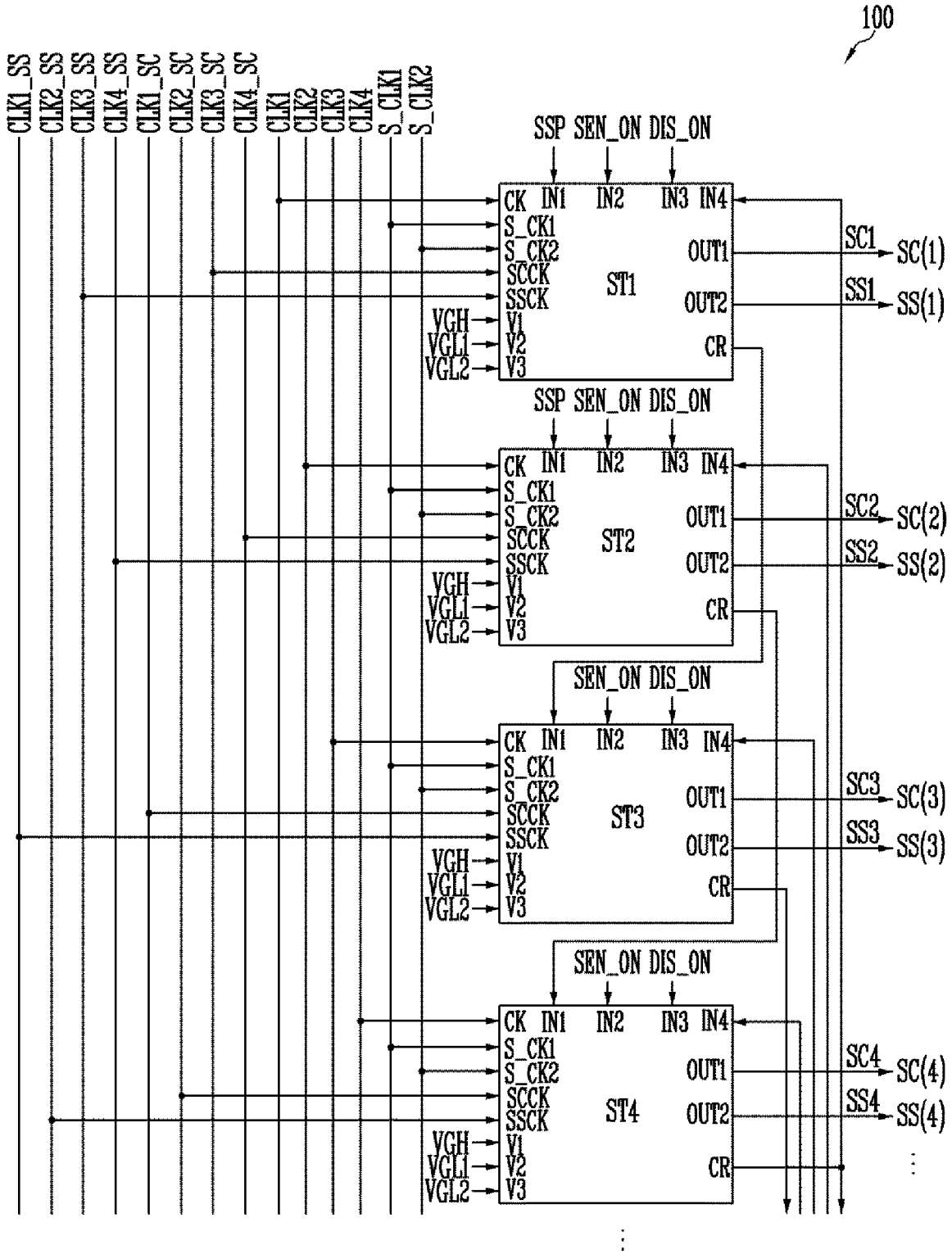
FIG. 16 is diagram of illustrating a scan driver according to an exemplary embodiment.

FIG. 16 is diagram of illustrating a scan driver according to an exemplary embodiment.

In FIG. 16, components similar or identical to those described with reference to FIGS. 3 and/or 12 are designated by like reference numerals, and their overlapping descriptions will be omitted.

Referring to FIG. 16, the scan driver 100 may include a plurality of stages ST1, ST2, ST3, ST4, . . . up to STn.

Each of the stages ST1, ST2, ST3, ST4, STn may include a first input terminal IN1, a second input terminal IN2, a third input terminal IN3, a fourth input terminal IN4, a clock terminal CK, a first control clock terminal S_CK1, a second control clock terminal S_CK2, a sensing clock terminal SSCK, a scan clock terminal SCCK, a first power terminal V1, a second power terminal V2, a third power terminal V3, a carry output terminal CR, a first output terminal OUT1, and a second output terminal OUT2.

The first control clock terminal S_CK1 and the second control clock terminal S_CK2 may receive a first control clock signal S_CLK1 and a second control clock signal S_CLK2, respectively. The first control clock signal S_CLK1 and the second control clock signal S_CLK2 may have a gate-on voltage in the sensing period, and charge the gate-on voltage in a first driving node. In an exemplary embodiment, the first control clock signal S_CLK1 and the second control clock signal S_CLK2 may have a gate-off voltage set lower than that of other signals. For example, the gate-off voltage of the first control clock signal S_CLK1 and the second control clock signal S_CLK2 may be set as about −15 V.

In an exemplary embodiment, the first control clock signal S_CLK1 may have the same waveform as the second control clock signal S_CLK2 in the vertical blank period, and have the same waveform as a predetermined carry signal in the display period.

In other exemplary embodiments, any one of the first control clock signal S_CLK1 and the second control clock signal S_CLK2 may be omitted.

The sensing clock terminal SSCK may receive any one of sensing clock signals CLK1_SS to CLK4_SS. For example, the sensing clock terminal SSCK may receive a sensing clock signal synchronized with a clock signal input to the clock terminal CK.

The scan clock terminal SCCK may receive any one of scan clock signals CLK1_SC to CLK4_SC. For example, the scan clock terminal SCCK may receive a scan control clock signal synchronized with a clock signal input to the clock terminal CK.

Figure 17:
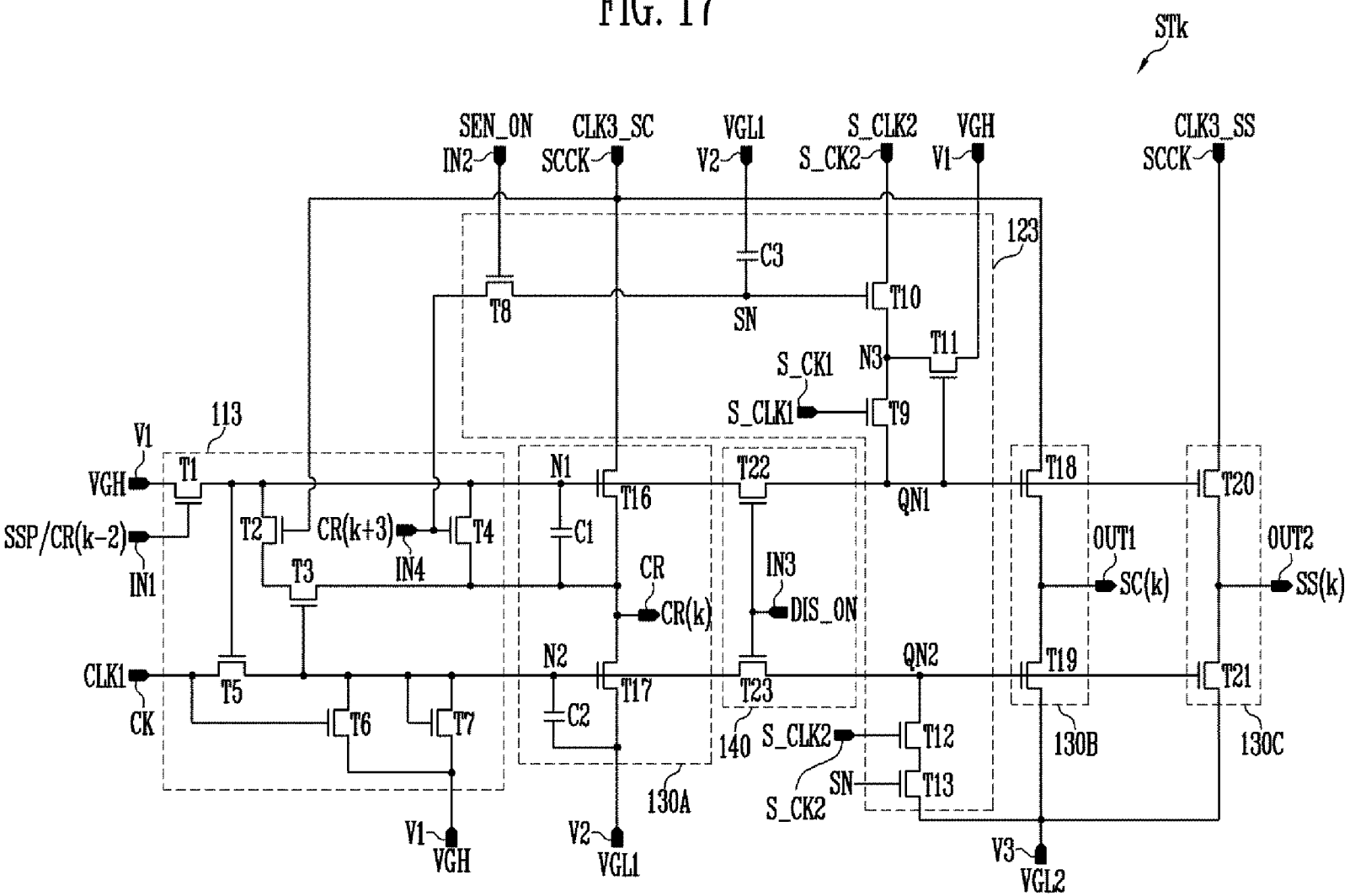
FIG. 17 is a circuit diagram of a first exemplary embodiment of a stage included in the scan driver shown in FIG. 16.

FIG. 17 is a circuit diagram of a first exemplary embodiment of a stage included in the scan driver shown in FIG. 16.

In FIG. 17, components identical to those described with reference to FIG. 4 are designated by like reference numerals, and their overlapping descriptions will be omitted.

In an exemplary embodiment, the stage shown in FIG. 17 may have a configuration substantially identical or similar to the stage STk shown in FIG. 4, except the configuration of a first driving controller 113 and a second driving controller 123.

Referring to FIGS. 1, 16, and 17, the kth stage STk may include a first driving controller 113, a second driving controller 123, the output buffers 130A, 130B, and 130C, and the coupling controller 140.

In some embodiments, the fourth transistor T4 in the first driving controller 113 may include a gate electrode coupled to the fourth input terminal IN4 to which a (k+3)th carry signal CR(k+3) is supplied. The fourth transistor T4 may discharge a voltage charged in the first node N1. For example, the voltage of the first node N1 may be discharged in synchronization with a turn-on time of the foruth transistor T4, i.e., a rising time of the (k+3)th carry signal CR(k+3).

In an exemplary embodiment, the second driving controller 123 may include eighth to eleventh transistors T8 to 11 that control the voltage of the first driving node QN1, and a twelfth transistor T12 and a thirteenth transistor T13, which control the voltage of the second driving node QN2. The second driving controller 123 may further include a third capacitor C3.

The eighth transistor T8 may be coupled between the fourth input terminal IN4 to which a next carry signal is applied and a sampling node SN. A gate electrode of the eighth transistor T8 may be coupled to the second input terminal IN2 to which the sensing-on signal SEN_ON is applied. In an exemplary embodiment, the next carry signal may be the (k+3)th carry signal CR(k+3) or a (k+2)th carry signal CR(k+2). The eighth transistor T8 may charge a gate-on voltage of the next carry signal in the sampling node SN in response to the sensing-on signal SEN_ON. The sensing-on signal SEN_ON may have a gate-on voltage in synchronization with the next carry signal.

The ninth transistor T9 and the tenth transistor T10 may be coupled in series between the second sensing clock terminal S_CK2 to which the second control clock signal S_CLK2 is applied and the first driving node QN1. A common node between the ninth transistor T9 and the tenth transistor T10 may be defined as the third node N3.

A gate electrode of the ninth transistor T9 may be coupled to the first control clock terminal S_CK1 to which the first control clock signal S_CLK1 is applied. A gate electrode of the tenth transistor T10 may be coupled to the sampling node SN.

The eleventh transistor T11 may be coupled between the third node N3 and the first power terminal V1 to which the first power source VGH is applied. A gate electrode of the eleventh transistor T11 may be coupled to the first driving node QN1.

The ninth to eleventh transistors T9 to T11 hold a voltage of the third node N3 as the voltage of the first power source VGH in response to the voltage of the first driving node QN1, so that an unnecessary drain-source voltage increase of the ninth transistor T9 can be prevented. Thus, the output of the scan signal SC(k) can be stably ensured, and the reliability of the display device can be improved.

In various exemplary embodiments of the invention, the second driving controller 123 may charge a stable gate-on voltage in the first driving node QN1, not only using a voltage of the sampling node SN but also using the second control clock signal S_CLK2, during the sensing period. For example, a conductive path passing through the tenth transistor T10 and the ninth transistor T9 may be further formed during the mobility sensing period, and the voltage of the first driving node QN1 may be further charged.

In addition, the ninth transistor T9 is turned on in synchronization with the first control clock signal S_CLK1, so that the voltage of the first power source VGH can be applied to the first driving node QN1 through the ninth transistor T9. That is, the second driving controller 123 may charge a stable gate-on voltage to the first driving node QN1, not only using the voltage of the first node N1 but also using the first power source VGH, during the display period. For example, a conductive path passing through the eleventh transistor T11 and the ninth transistor T9 may be further formed during the display period, and the second driving controller 123 may assist (supplement) a voltage charge at the first driving node QN1.

In an exemplary embodiment, an operation of the first control clock signal S_CLK1 in the display period may be changed depending on an ambient temperature. When the display device operates at a high temperature, it is unnecessary for the second driving controller 123 to assist the voltage charge at the first driving node QN1. Therefore, at a preset threshold temperature or more, the first control clock signal S_CLK1 may maintain a gate-off voltage during the display period. Only when the display device operates at a temperature lower than the threshold temperature, the first control clock signal S_CLK1 may have a gate-on voltage in synchronization with the scan start signal SSP or the (k−2)th carry signal CR(k−2).

The first control clock signal S_CLK1 may be a global signal. Therefore, in order to assist the voltage charge at the first driving node QN1 in stages corresponding to a plurality of pixel rows, the first control clock signal S_CLK1 may have a gate-on voltage plural times during the display period.

As described above, the scan driver according to the exemplary embodiment holds a voltage of the third node N3 as a predetermined voltage, so that an unnecessary drain-source voltage increase of the ninth transistor T9 can be prevented. In addition, a gate-on voltage can be stably charged in the first driving node QN1 during the display period and the sensing period. Thus, the reliability of the output of the scan signal SC(k) can be further improved.

The twelfth transistor T12 and the thirteenth transistor T13 may be coupled in series between the second driving node QN2 and the third power terminal V3 to which the third power source VGL2 is applied. A gate electrode of the twelfth transistor T12 may be coupled to the second control clock terminal S_CK2 to which the second control clock signal S_CLK2 is applied. A gate electrode of the thirteenth transistor T13 may be coupled to the sampling node SN. In the sensing period, the twelfth transistor T12 and the thirteenth transistor T13 may be turned on, and the voltage of the third power source VGL2 may be applied to the second driving node QN2.

Figure 18:
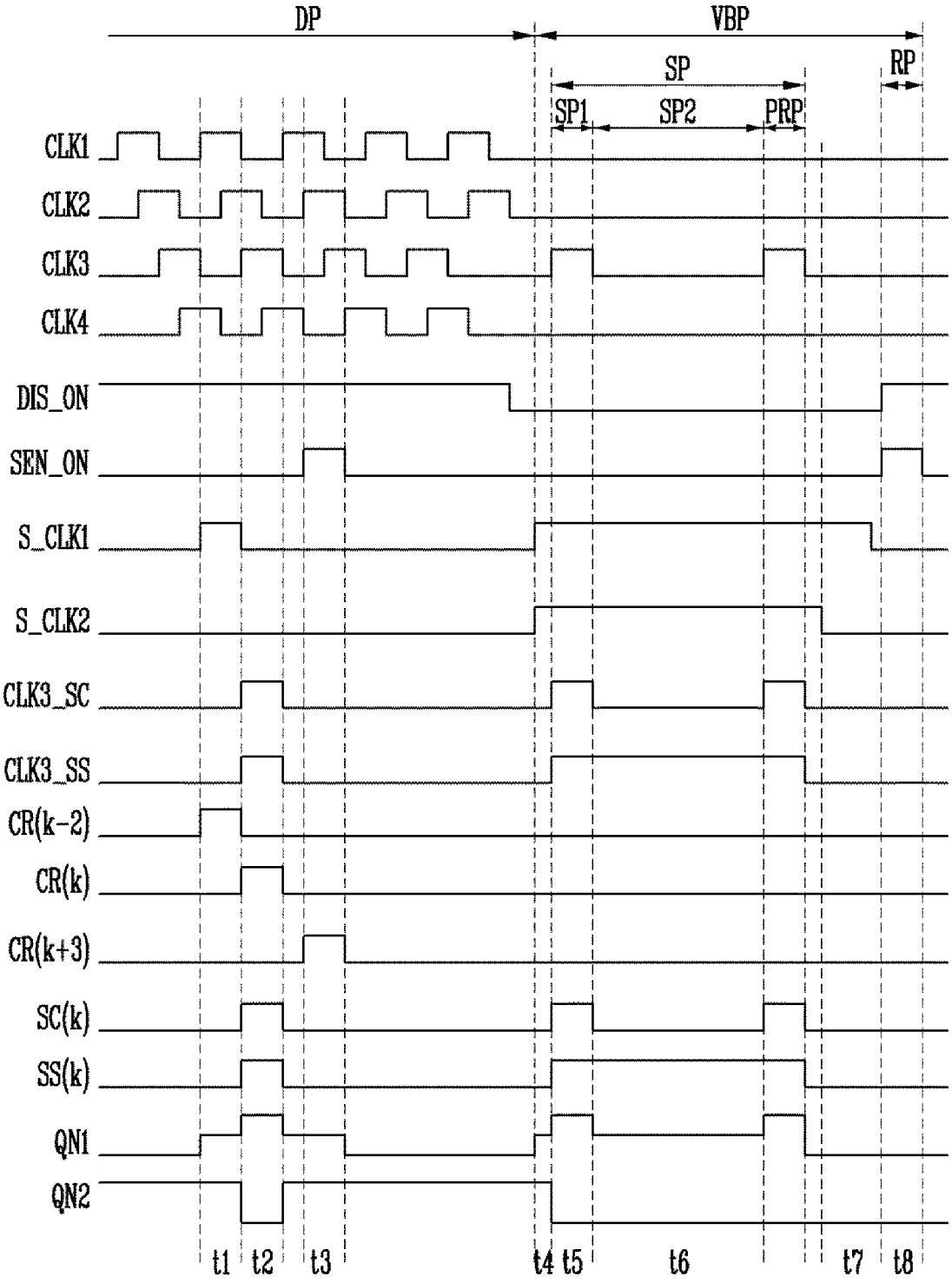
FIG. 18 is a timing diagram illustrating an example of an operation of the stage shown in FIG. 17.

FIG. 18 is a timing diagram illustrating an example of an operation of the stage shown in FIG. 17.

In FIG. 18, components identical to those described with reference to FIG. 5 are designated by like reference numerals, and their overlapping descriptions will be omitted. In FIG. 18, an operation of the kth stage STk will be mainly described. In addition, positions, widths, heights, etc. of waveforms shown in FIG. 18 are merely illustrative, and the exemplary embodiments are not limited thereto.

Referring to FIGS. 1, 16, 17, and 18, one frame period may include a display period DP and a vertical blank period VBP.

In the display period DP, the display-on signal DIS_ON may have a gate-on voltage, and the second control clock signal S_CLK2 may have a gate-off voltage. Accordingly, during the display period DP, the twenty-second transistor T22 and the twenty-third transistor T23 maintain the turn-on state, and the twelfth transistor T12 maintains a turn-off state.

In a first period t1, the scan start signal SSP or the (k−2)th carry signal CR(k−2) is applied in synchronization with the first clock signal CLK1 applied to the clock terminal CK. Then, the first transistor T1 is turned on, and the first power terminal V1 and the first node N1 are electrically coupled to each other. Accordingly, the voltage of the first node N1 and the voltage of the first driving node QN1 can be precharged.

When the voltage of the first node N1, the voltage of the second node N2, the voltage of the first driving node QN1, and the voltage of the second driving node QN2 are increased, the eighteenth transistor T18, the nineteenth transistor T19, the sixteenth transistor T16, the seventeenth transistor T17, the twentieth transistor T20, and the twenty-first transistor T21 are turned on. However, the third scan clock signal CLK_SC and the third sensing clock signal CLK3_SS have a gate-off voltage, and hence the kth carry signal CR(k), the kth scan signal SC(k), and the kth sensing signal SS(k) are not output.

In various exemplary embodiments, the first control clock signal S_CLK1 may be further supplied in the first period t1. When the first control clock signal S_CLK1 has a gate-on voltage, the ninth transistor T9 is turned on. In addition, since the first driving node QN1 is precharged, the eleventh transistor T11 maintains the turn-on state. Then, the voltage of the first power source VGH is supplied to the first driving node QN1, to assist (supplement) a voltage charge at the first driving node QN1.

In an exemplary embodiment, when the first control clock signal S_CLK1 has a gate-off voltage as does the second control clock signal S_CLK2 in the display period, the ninth transistor T9 is turned off. For example, when the display device operates at a high temperature, the first control clock signal S_CLK1 may not be supplied during the display period DP. That is, at a preset threshold temperature or more, the first control clock signal S_CLK1 may maintain a gate-off voltage during the display period DP. Only when the display device operates at a temperature lower than the threshold temperature, the first control clock signal S_CLK1 may have a gate-on voltage in synchronization with the scan start signal SSP or the (k−2)th carry signal CR(k−2).

In a second period t2, the third scan clock signal CLK_SC has a gate-on voltage. Then, the voltage of the first node N1 and the voltage of the first driving node QN1 may be boosted by the first capacitor C1.

In addition, the gate-off voltage of the first clock signal CLK1 is supplied to the second node N2 and the second driving node QN2 via the fifth transistor T5 that is in the turn-on state. Accordingly, the nineteenth transistor T19, the seventeenth transistor T17, and the twenty-first transistor T21 are turned off. Then, the kth carry signal CR(k) may be output in synchronization with the third scan clock signal CLK3_SC, the kth scan signal SC(k) may be output, and the kth sensing signal SS(k) may be output in synchronization with the third sensing clock signal CLK3_SS.

During the second period t2, the voltage of the first power source VGH is supplied to the third node N3 through the eleventh transistor T11 that maintains the turn-on state. Then, the voltage of the third node N3 is held as a predetermined voltage, an unnecessary drain-source voltage increase of the ninth transistor T9 is prevented, and a gate-on voltage can be stably charged in the first driving node QN1. Hereinafter, such a driving characteristic may be equally applied below in periods in which the first control clock signal S_CLK1 is not supplied.

In a third period t3, the (k+3)th carry signal CR(k+3) and the sensing on signal SEN_ON may be simultaneously applied. Then, the eighth transistor T8 is turned on to supply a gate-on voltage of the (k+3)th carry signal CR(k+3) to the sampling node SN. Accordingly, the sampling node SN can be charged with the gate-on voltage. When the fourth transistor T4 is turned on in response to the (k+3)th carry signal CR(k+3), the voltage of the first node N1 and the voltage of the first driving node QN1 may be discharged, and the gate-on voltage may be charged and maintained in the sampling node SN in response to the sensing-on signal SEN_ON.

The stage STk that receives the sensing-on signal SEN_ON may output the scan signal SC(k) and the sensing signal SS(k) in the subsequent vertical blank period VBP. That is, when the first and second control clock signals S_CLK1 and S_CLK2 have a gate-on voltage and the display-on signal DIS_ON has a gate-off voltage during the vertical blank period VBP, the voltage of the first driving node QN1 may be charged by the first and second control clock signals S_CLK1 and S_CLK2, according to the voltage charged in the sampling node SN.

When the first node N1 and the first driving node QN1 are set to a gate-off voltage, the first transistor T1, the twenty-second transistor T22, and the twentieth transistor T20 are turned off. During the third period t3, the first clock signal CLK1 has a gate-on voltage, and the second node N2 and the second driving node QN2 are set to a gate-on voltage by the sixth transistor T6 and the seventh transistor T7. Then, the nineteenth transistor T19, the seventeenth transistor T17, and the twenty-first transistor T21 are turned on. Thus, the voltage of the second power source VGL1 is output to the carry output terminal CR, and the voltage of the third power source VGL2 is output to the first output terminal OUT1 and the second output terminal OUT2. Consequently, the carry signal CR(k), the scan signal SC(k), and the sensing signal SS(k) are inactivated.

The vertical blank period VBP may include the sensing period SP and a reset period RP. However, this is merely illustrative, and the reset period RP may be included in the display period DP. In an exemplary embodiment, the sensing period SP may include a first sensing period SP1 in which a mobility and a threshold voltage of a driving transistor are sensed, and a second sensing period SP2 in which a current characteristic of a light emitting device LED is sensed. Also, the sensing period SP may include a pixel reset period PRP.

In the sensing period SP, the kth stage STk may output the scan signal SC(k) in synchronization with the third scan clock signal CLK3_SC applied to the scan clock terminal SCCK. In an exemplary embodiment, the scan signal SC(k) may be output at least twice during the vertical blank period VBP.

Also, in the sensing period SP, the kth stage STk may output the sensing signal SS(k) in synchronization with the third sensing control clock signal CLK_SS applied to the sensing clock terminal SSCK. In an exemplary embodiment, the sensing signal SS(k) may be output in the first sensing period SP1, the second sensing period SP2, and the pixel reset period PRP.

During a fourth period t4, the first control clock signal S_CLK1 and the second control clock signal S_CLK2 are supplied together. When the first scontrol clock signal S_CLK1 has the gate-on voltage, the ninth transistor T9 is turned on. The sampling node SN of the corresponding selected stage STk is charged with a gate-on voltage during the display period DP, and hence the tenth transistor T10 maintains the turn-on state. Accordingly, a gate-on voltage of the second control clock signal S_CLK2 can be transferred to the first driving node QN1 via the ninth transistor T9 and the tenth transistor T10. When the first driving node QN1 is set to the gate-on voltage, the eighteenth transistor T18 and the twentieth transistor T20 are turned on.

During a fifth period t5, when the third scan clock signal CLK3_SC is supplied, a gate-on voltage of the third scan clock signal CLK3_SC is supplied to the first output terminal OUT1 via the turned-on eighteenth transistor T18.

In addition, when the third sensing clock signal CLK3_SS is supplied, a gate-on voltage of the third sensing clock signal CLK3_SS is supplied to the second output terminal OUT2 via the turned-on twentieth transistor T20. Accordingly, the sensing signal SS(k) is activated.

In a sixth period t6, when the supply of the third scan clock signal CLK3_SC is stopped, a gate-off voltage of the third scan clock signal CLK3_SC is supplied to the first output terminal OUT1. Accordingly, the scan signal SC(k) is inactivated.

In a seventh period t7, when the supply of the second control clock signal S_CLK2 is stopped, a gate-off voltage of the second control clock signal S_CLK2 may be transferred to the first driving node QN1 via the ninth transistor T9 and the tenth transistor T10. Accordingly, the first driving node QN1 is initialized to the gate-off voltage.

In an eighth period t8, i.e., the reset period RP, the sensing-on signal SEN_ON may have a gate-on voltage. The (k+3)th carry signal CR(k+3) has a gate-off voltage, and therefore, the voltage of the sampling node SN may be reset to the gate-off voltage.

Figure 19:
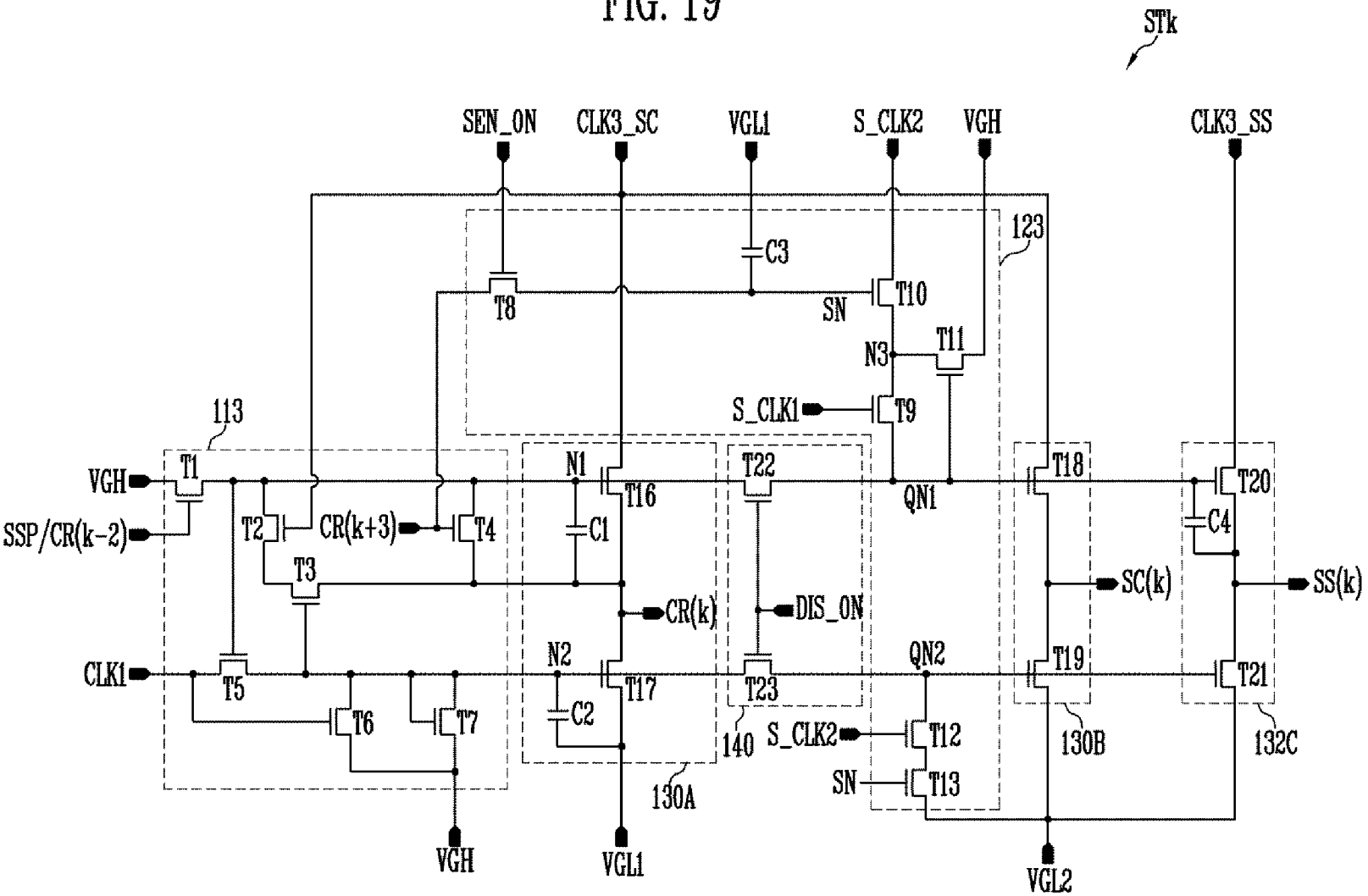
FIG. 19 is a circuit diagram of a second exemplary embodiment of the stage included in the scan driver shown in FIG. 16.

FIG. 19 is a circuit diagram of a second exemplary embodiment of the stage included in the scan driver shown in FIG. 16.

In FIG. 19, components identical to those described with reference to FIG. 17 are designated by like reference numerals, and repetitive descriptions will be omitted to avoid redundancy. In addition, a kth stage STk shown in FIG. 19 may have a configuration substantially identical or similar to that of the stage STk shown in FIG. 17, except the configuration of an output buffer 132C.

Referring to FIGS. 16 and 19, the kth stage STk may include the first driving controller 113, the second driving controller 123, the output buffers 130A, 130B, and 132C, and the coupling controller 140.

In an exemplary embodiment, the output buffer 132C may further include a fourth capacitor C4. The fourth capacitor C4 may be coupled between the first driving node QN1 and the second output terminal OUT2 that outputs the sensing signal SS(k). The fourth capacitor C4 is provided, so that the stage STk can be stronger against a negative threshold voltage condition. Further, the fourth capacitor C4 is provided, so that a voltage of the first driving node QN1 can be boosted during a display period DP.

The exemplary driving method of the stage STk shown in FIG. 19 is substantially same as that shown in FIG. 18, and therefore, repetitive descriptions will be omitted to avoid redundancy.

Figure 20:
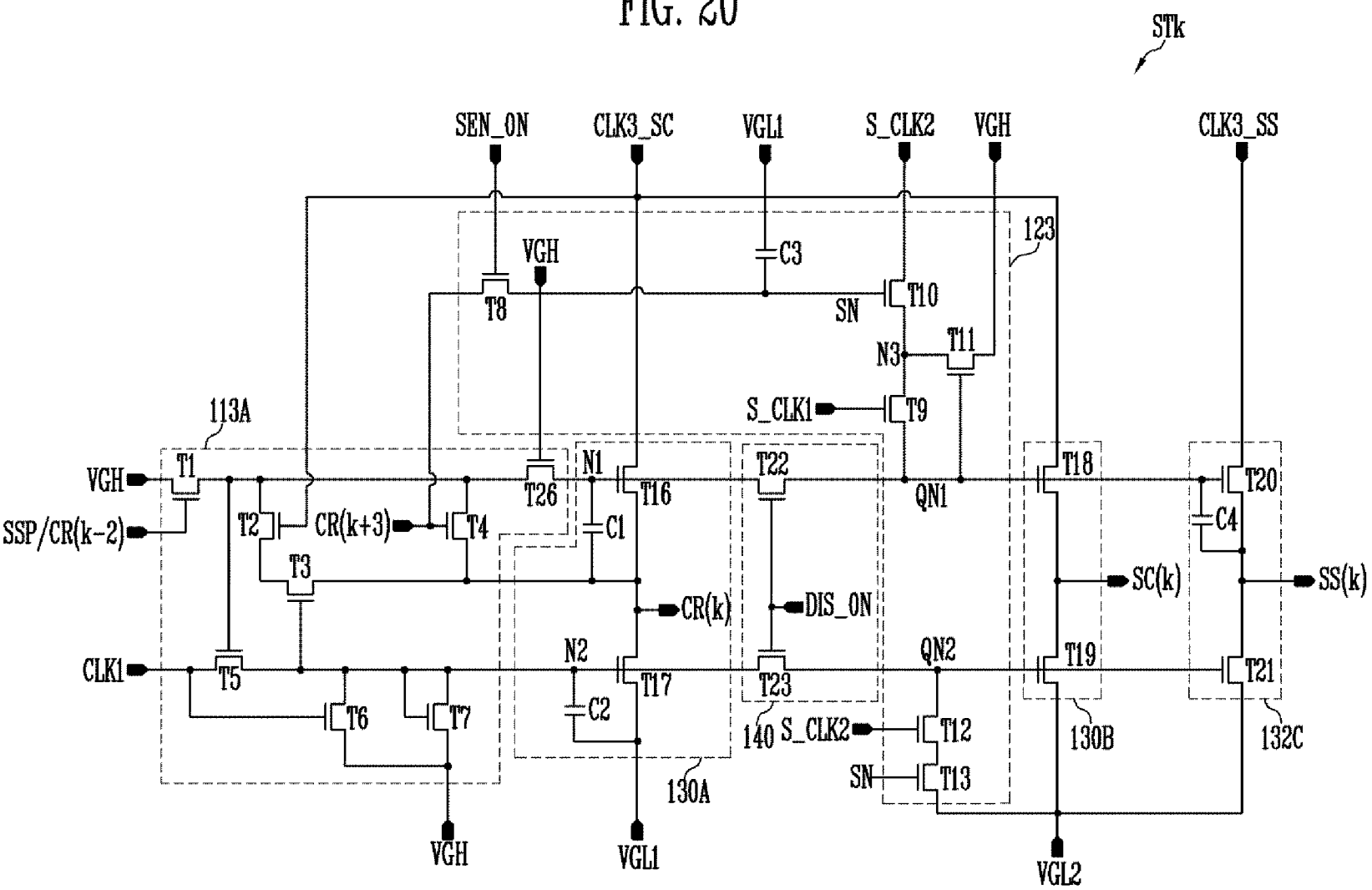
FIG. 20 is a circuit diagram of a third exemplary embodiment of the stage included in the scan driver shown in FIG. 16.

FIG. 20 is a circuit diagram of a third exemplary embodiment of the stage included in the scan driver shown in FIG. 16.

In FIG. 20, components identical to those described with reference to FIG. 17 are designated by like reference numerals, and repetitive descriptions will be omitted to avoid redundancy. In addition, a kth stage STk shown in FIG. 20 may have a configuration substantially identical or similar to that of the stage STk shown in FIG. 19, except the configuration of a first driving controller 113A.

Referring to FIGS. 16 and 20, the kth stage STk may include the first driving controller 113A, the second driving controller 123, the output buffers 130A, 130B, and 132C, and the coupling controller 140.

In an exemplary embodiment, the first driving controller 113A may further include a twenty-sixth transistor T26. The twenty-sixth transistor T26 may be coupled between the gate electrode of the fifth transistor T5 and the first node N1. A gate electrode of the twenty-sixth transistor T26 may be coupled to the first power terminal V1 that receives the first power source VGH. The twenty-sixth transistor T26 may always maintain the turn-on state due to the voltage of the first power source VGH. Therefore, the twenty-sixth transistor T26 does not have great influence on an operation of the first node N1 and/or an operation of the first driving node QN1.

The twenty-sixth transistor T26 may stabilize the gate voltage of the fifth transistor T5. For example, when the voltage of the first node N1 is boosted by the first capacitor C1, the gate voltage of the fifth transistor T5 is not influenced by the boosted voltage due to the twenty-sixth transistor T26. Thus, when the fifth transistor T5 is turned on, a gate-source voltage Vgs of the fifth transistor T5 can be prevented from being unintentionally increased, and the fifth transistor T5 can be stably operated. Consequently, the reliability of the scan driver 100 can be improved.

The exemplary driving method of the stage STk shown in FIG. 20 is substantially the same as that shown in FIG. 18, and therefore, repetitive descriptions will be omitted to avoid redundancy.

Figure 21:
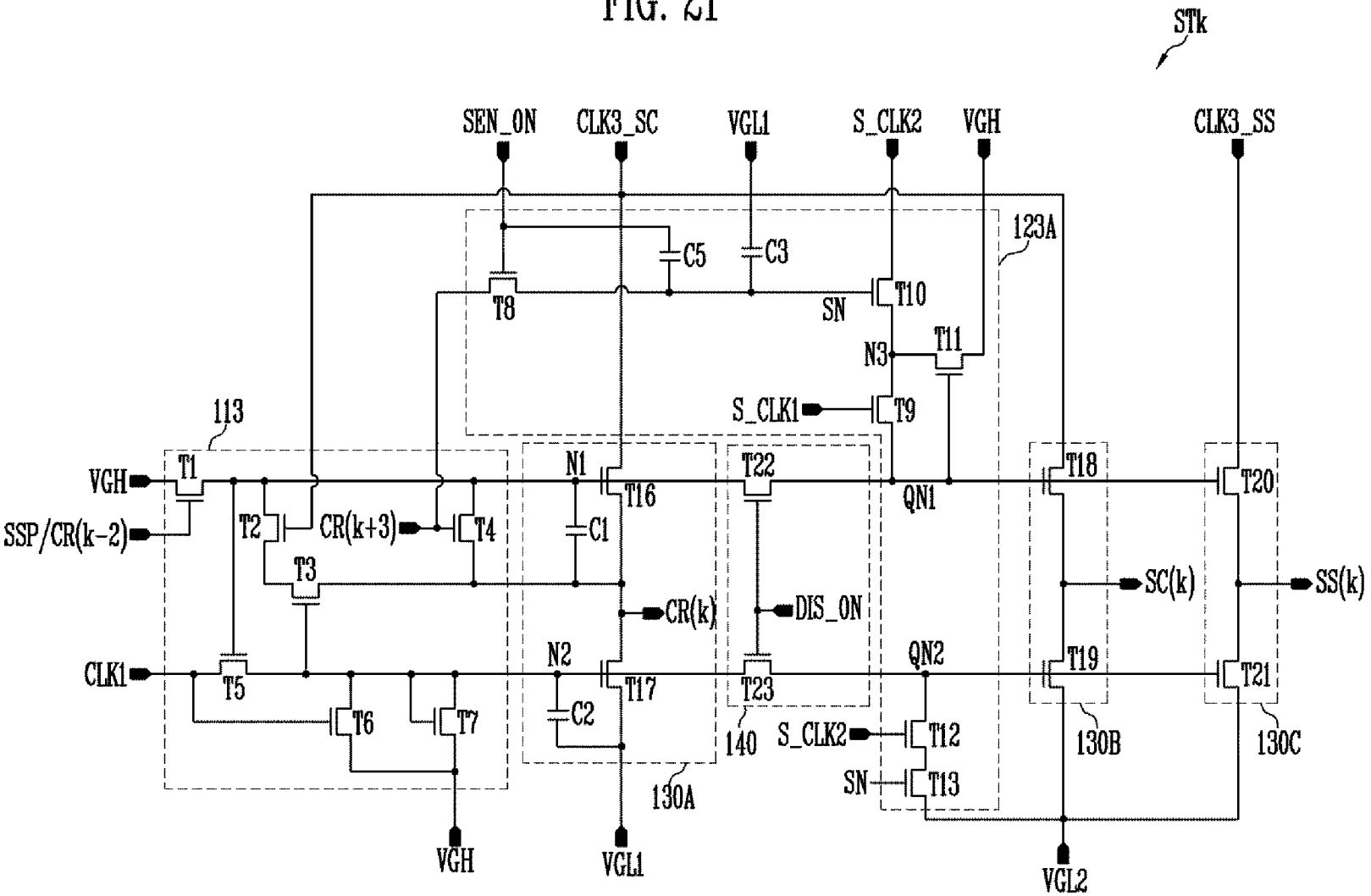
FIG. 21 is a circuit diagram of a fourth exemplary embodiment of the stage included in the scan driver shown in FIG. 16.

FIG. 21 is a circuit diagram of a fourth exemplary embodiment of the stage included in the scan driver shown in FIG. 16.

In FIG. 21, components identical to those described with reference to FIG. 17 are designated by like reference numerals, and repetitive descriptions will be omitted to avoid redundancy. In addition, a kth stage STk shown in FIG. 21 may have a configuration substantially identical or similar to that of the stage STk shown in FIG. 17, except the configuration of a second driving controller 123A.

Referring to FIGS. 16 and 21, the kth stage STk may include the first driving controller 113, the second driving controller 123A, the output buffers 130A, 130B, and 130C, and the coupling controller 140.

In an exemplary embodiment, the second driving controller 123A may further include a fifth capacitor C5. The fifth capacitor C5 may be coupled between the gate electrode of the eighth transistor T8 and the sampling node SN.

In an exemplary embodiment, the fifth capacitor C5 is provided, so that a leakage current generated by the supply of the sensing-on signal SEN_ON can be prevented.

The exemplary driving method of the stage STk shown in FIG. 21 is substantially the same as that shown in FIG. 18, and therefore, repetitive descriptions will be omitted to avoid redundancy.

Figure 22:
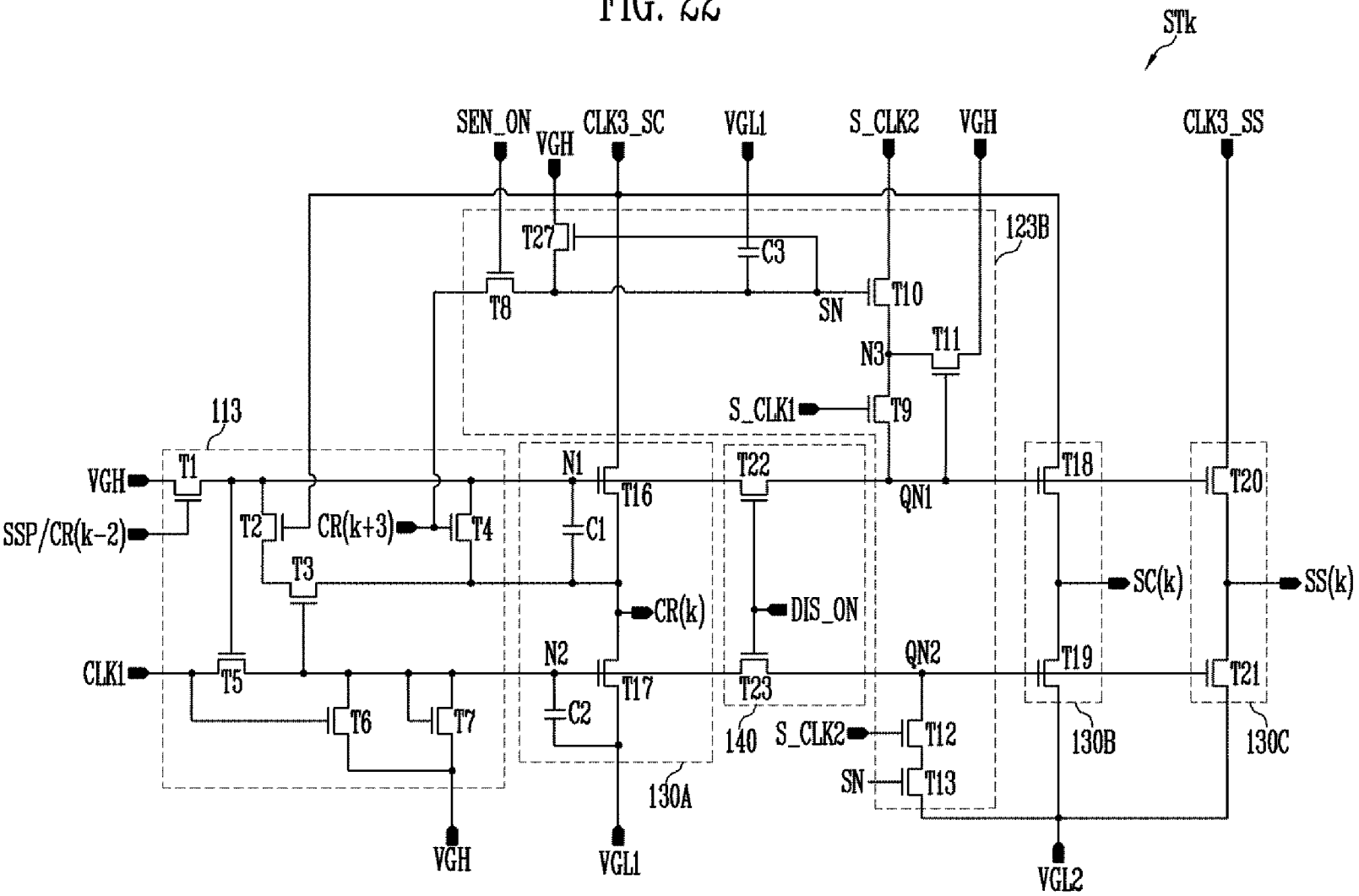
FIG. 22 is a circuit diagram of a fifth exemplary embodiment of the stage included in the scan driver shown in FIG. 16.

FIG. 22 is a circuit diagram of a fifth exemplary embodiment of the stage included in the scan driver shown in FIG. 16.

In FIG. 22, components identical to those described with reference to FIG. 17 are designated by like reference numerals, and repetitive descriptions will be omitted to avoid redundancy. In addition, a kth stage STk shown in FIG. 22 may have a configuration substantially identical or similar to that of the stage STk shown in FIG. 17, except the configuration of a second driving controller 123B.

Referring to FIGS. 16 and 22, the kth stage STk may include the first driving controller 113, the second driving controller 123B, the output buffers 130A, 130B, and 130C, and the coupling controller 140.

In an exemplary embodiment, the second driving controller 123B may further include a twenty-seventh transistor T27.

The twenty-seventh transistor T27 may be diode-coupled between the first power terminal V1 that receives the first power source VGH and the sampling node SN. The twenty-seventh transistor T27 may be turned on according to the voltage of the sampling node SN, to supply the voltage of the first power source VGH to the sampling node SN.

As described above, the twenty-seventh transistor T27 can stably maintain the voltage of the sampling node SN as a gate-on voltage after the gate-on voltage is charged in the sampling node SN.

The exemplary driving method of the stage STk shown in FIG. 22 is identical to that shown in FIG. 18, and therefore, repetitive descriptions will be omitted to avoid redundancy.

One or at least two of the above-described embodiments shown in FIGS. 19, 20, 21, and 22 may be combined. That is, in various exemplary embodiments, the stage STk of the exemplary embodiment shown in FIG. 17 may additionally include one or two or more of the components added according to the exemplary embodiments shown in FIGS. 19, 20, 21, and 22.

Figure 23:
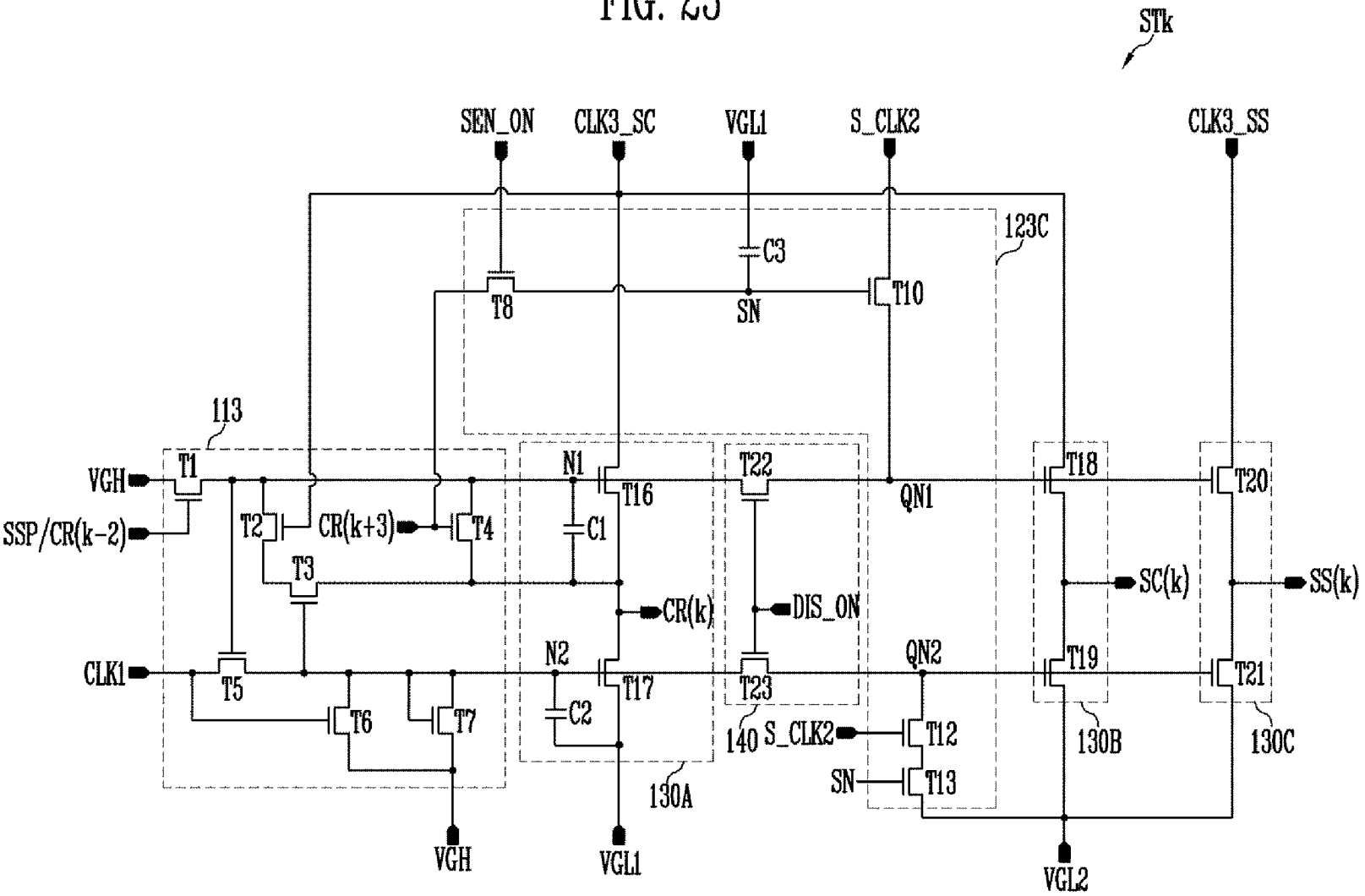
FIG. 23 is a circuit diagram of a sixth exemplary embodiment of the stage included in the scan driver shown in FIG. 16.

FIG. 23 is a circuit diagram of a sixth exemplary embodiment of the stage included in the scan driver shown in FIG. 16.

In FIG. 23, components identical to those described with reference to FIG. 17 are designated by like reference numerals, and repetitive descriptions will be omitted to avoid redundancy. In addition, a kth stage STk shown in FIG. 23 may have a configuration substantially identical or similar to that of the stage STk shown in FIG. 17, except the configuration of a second driving controller 123C.

Referring to FIGS. 16 and 23, the kth stage STk may include the first driving controller 113, the second driving controller 123C, the output buffers 130A, 130B, and 130C, and the coupling controller 140.

In an exemplary embodiment, as compared with the exemplary embodiment shown in FIG. 17, the second driving controller 123C includes the tenth transistor T10 instead of the ninth to eleventh transistors T9 to T11. The tenth transistor T10 is coupled between the second control clock terminal S_CK2 to which the second control clock signal S_CLK2 is applied and the first driving node QN1. The gate electrode of the tenth transistor T10 is coupled to the sampling node SN.

Figure 24:
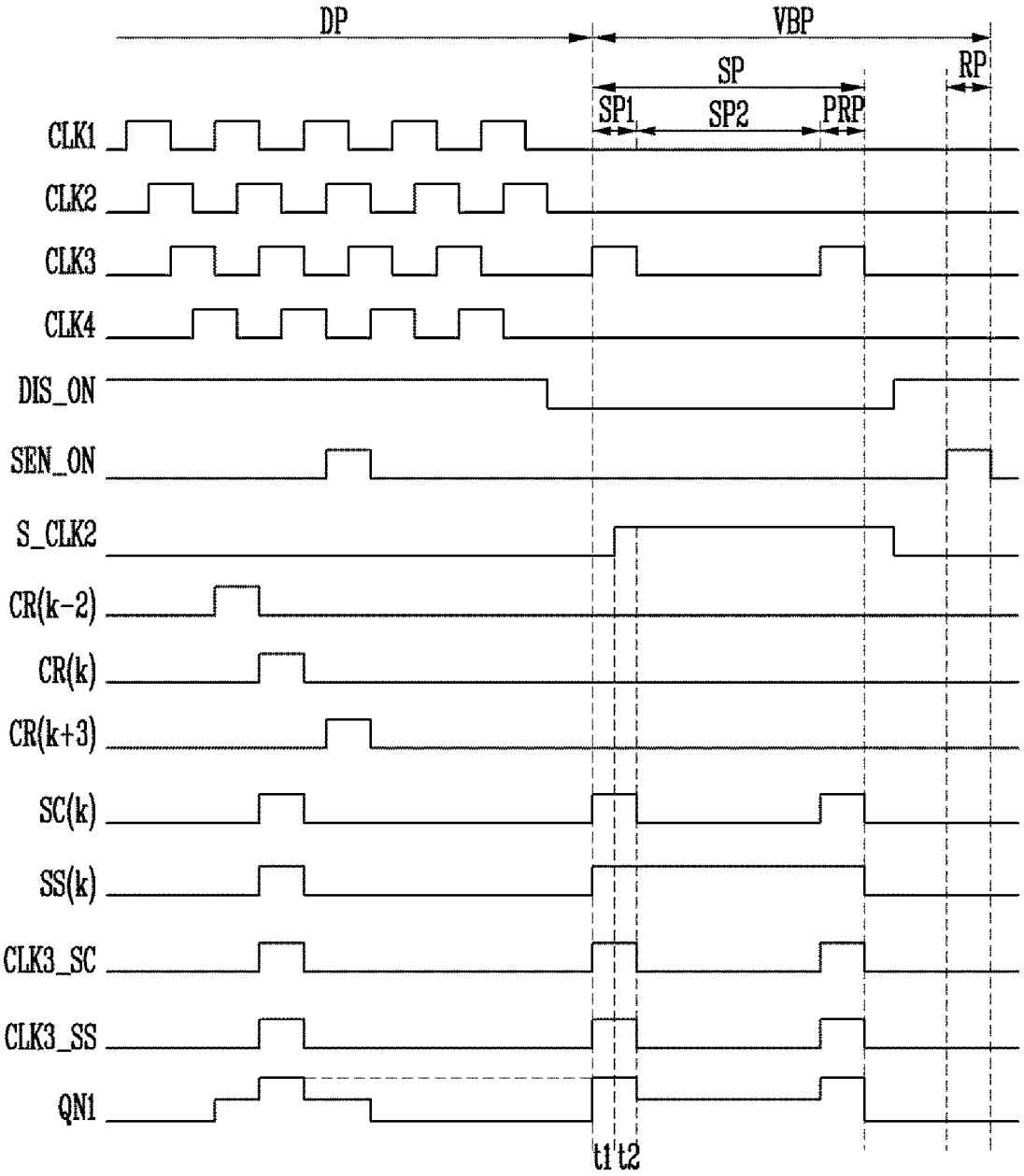
FIG. 24 is a timing diagram illustrating an example of an operation of the stage shown in FIG. 23.

FIG. 24 is a timing diagram illustrating an example of an operation of the stage shown in FIG. 23.

Referring to FIGS. 16, 23, and 24, one frame period may include a display period DP and a vertical blank period VBP.

In the display period DP, the scan signal SC(k) may be sequentially provided to pixel lines. Also, during the display period DP, the sensing signal SS(k) may be provided to the pixel lines.

In the display period DP, the sensing-on signal SEN_ON may be supplied at least one selected stage (in the illustrated embodiment, the kth stage STk) among a plurality of stages. Only the stage that receives the sensing-on signal SEN_ON may output the scan signal SC(k) and the sensing signal SS(k) in a sensing period SP continued to the display period DP. During the sensing period SP, sensing may be performed on pixels that receive the scan signal SC(k) and sensing signal SS(k), which are output from the at least one selected stage.

The exemplary driving method in the display period DP is the same as described with reference to FIG. 18, and therefore, repetitive descriptions will be omitted to avoid redundancy.

In the sensing period SP, the kth stage STk may output the scan signal SC(k) in synchronization with the third scan clock signal CLK3_SC applied to the scan clock terminal SCCK. In an exemplary embodiment, the scan signal SC(k) may be output at least twice during the vertical blank period VBP.

Also, in the sensing period SP, the kth stage STk may output the sensing signal SS(k) in synchronization with the third sensing clock signal CLK3_SS applied to the sensing clock signal SSCK. In an exemplary embodiment, the sensing signal SS(k) may be output in the first sensing period SP1, the second sensing period SP2, and the pixel reset period PRP. While the sensing signal SS(k) is being output in the first sensing period SP1, a sensing current for sensing a mobility and a threshold voltage of a driving transistor provided in a pixel may be applied to the pixel. While the sensing signal SS(k) is being output in the second sensing period SP2, a sensing current for sensing a current characteristic of a light emitting device LED provided in the pixel may be applied to the pixel.

In the sensing period SP, the display-on signal DIS_ON may have a gate-off voltage, and the second control clock signal S_CLK2 may have a gate-on voltage. Accordingly, during the sensing period SP, the twenty-second transistor T22 and the twenty-third transistor T23 may maintain the turn-off state, and the twelfth transistor T12 may be turned on according to the second control clock signal S_CLK2.

Portions of an operation in the sensing period SP, which are different from those described in FIG. 18, will mainly described.

In the exemplary embodiment, the third scan clock signal CLK3_SC and the third sensing clock signal CLK3_SS are first supplied in a first period t1, and the second control clock signal S_CLK2 is then supplied in a second period t2. As compared with the case where, in FIG. 18, the second control clock signal S_CLK2 is first supplied and the third scan clock signal CLK3_SC and the third sensing clock signal CLK_SS are then supplied in the sensing period SP, the voltage of the first driving node QN1 is prevented from being boosted. Accordingly, during the second period t2 in which the scan signal SC(k) and the sensing signal SS(k) are output together, the voltage of the first driving node QN1 is lower than that during the fifth period t5 in FIG. 18.

As described above, the boosting of the first driving node QN1 is prevented, a drain-source voltage Vds and a gate-source voltage Vgs of the tenth transistor T10 can be prevented from being transiently increased. Further, stress applied to the tenth transistor T10 is reduced, so that damage can be prevented.

Figure 25:
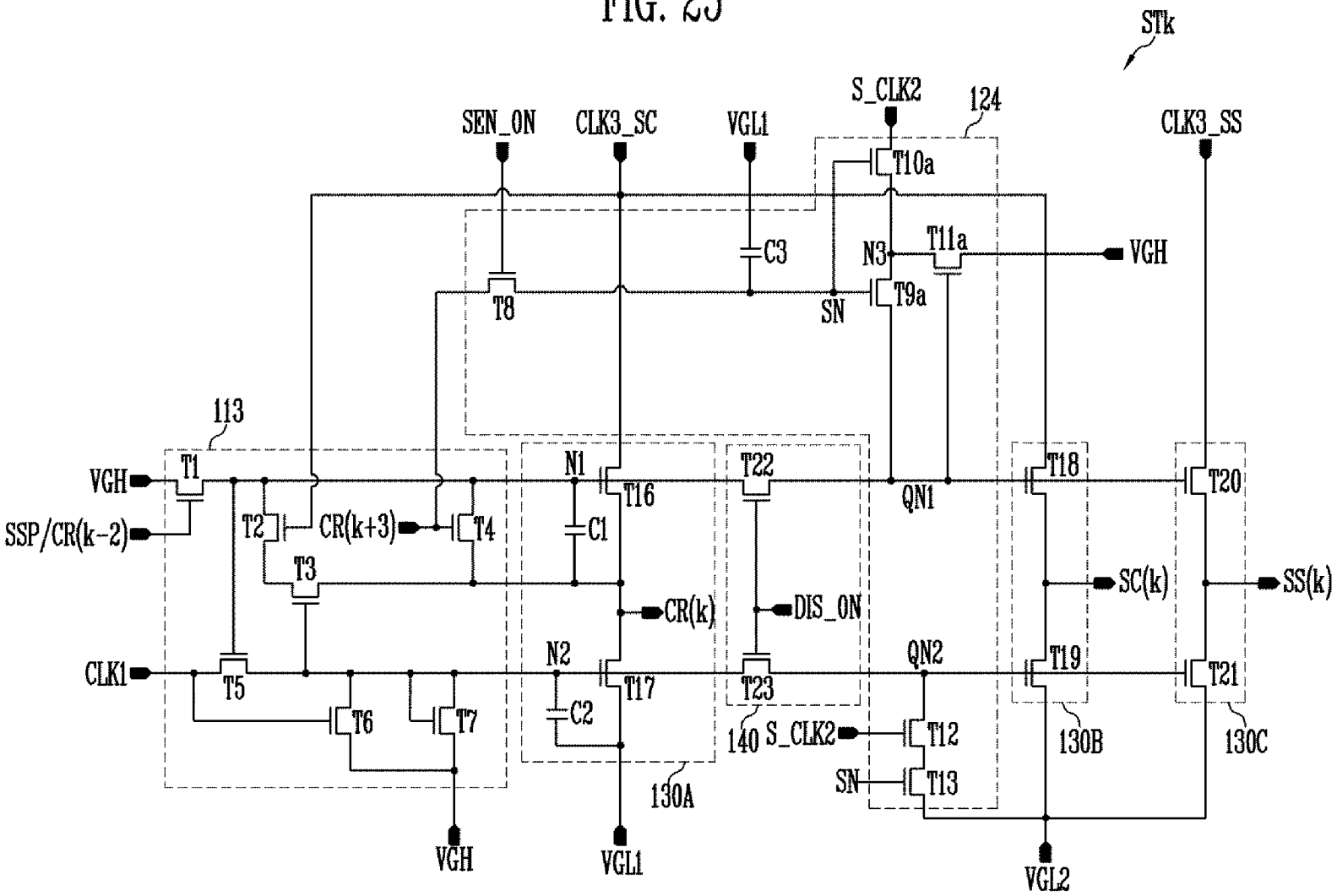
FIG. 25 is a circuit diagram of a seventh exemplary embodiment of the stage included in the scan driver shown in FIG. 16.

FIG. 25 is a circuit diagram of a seventh exemplary embodiment of the stage included in the scan driver shown in FIG. 16.

In FIG. 25, components identical to those described with reference to FIG. 23 are designated by like reference numerals, and repetitive descriptions will be omitted to avoid redundancy. In addition, a kth stage STk shown in FIG. 25 may have a configuration substantially identical or similar to that of the stage STk shown in FIG. 23, except the configuration of a second driving controller 124. The second driving controller 124 may have a configuration similar to that of the second driving controller 120B shown in FIG. 8.

Referring to FIGS. 16 and 25, the kth stage STk may include the first driving controller 113, the second driving controller 124, the output buffers 130A, 130B, and 130C, and the coupling controller 140.

In an exemplary embodiment, the second driving controller 124 may include a ninth transistor T9*a*, a tenth transistor T10*a*, and an eleventh transistor T11*a*.

The ninth transistor T9*a* and the tenth transistor T10*a* may be coupled between the second control clock terminal S_CK2 to which the second control clock signal S_CLK2 is applied and the first driving node QN1. Gate electrodes of the ninth transistor T9*a* and the tenth transistor T10*a* may be commonly coupled to the sampling node SN. The ninth transistor T9*a* and the tenth transistor T10*a* may transfer the second control clock signal S_CLK2 to the first driving node QN1, based on the voltage of the sampling node SN. In an exemplary embodiment, the second control clock signal S_CLK2 may have a gate-on voltage in the sensing period (e.g., the mobility sensing period).

The eleventh transistor T11*a* may be coupled between the third node N3 and the first power terminal V1 to which the first power source VGH is applied. The eleventh transistor T11*a* may include a gate electrode coupled to the first driving node QN1.

The ninth to eleventh transistors T9*a* to T11*a* hold the voltage of the third node N3 as the voltage of the first power source VGH in response to the voltage of the first driving node QN1, so that an unnecessary drain-source voltage increase of the ninth transistor T9*a* can be prevented. Thus, the output of the scan signal SC(k) can be stably ensured, and the reliability of the display device can be improved.

The exemplary driving method of the stage STk shown in FIG. 25 is identical to that shown in FIG. 24, and therefore, repetitive descriptions will be omitted to avoid redundancy.

Figure 26:
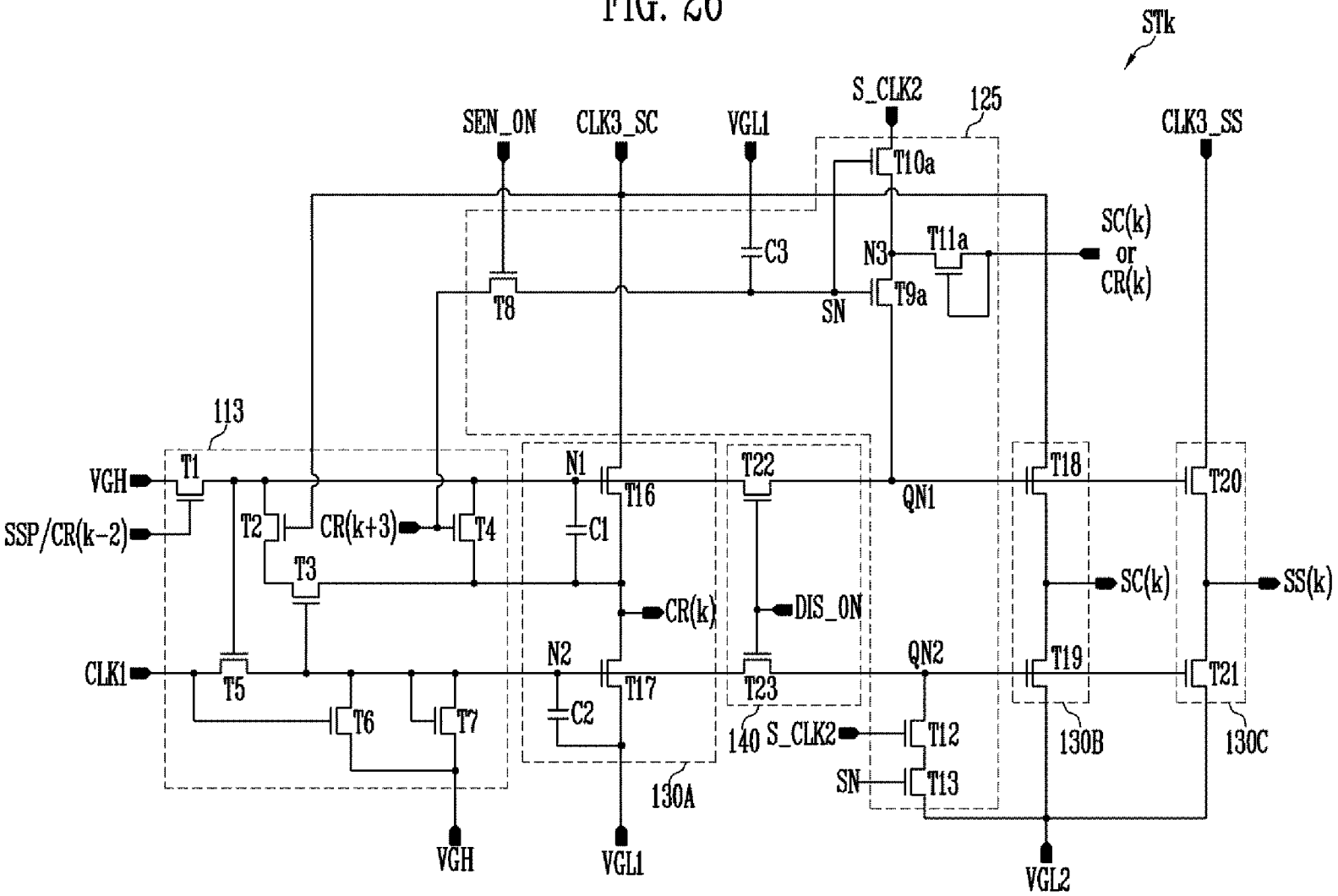
FIG. 26 is a circuit diagram of an eighth exemplary embodiment of the stage included in the scan driver shown in FIG. 16.

FIG. 26 is a circuit diagram of an eighth exemplary embodiment of the stage included in the scan driver shown in FIG. 16.

In FIG. 26, components identical to those described with reference to FIG. 23 are designated by like reference numerals, and repetitive descriptions will be omitted to avoid redundancy. In addition, a kth stage STk shown in FIG. 26 may have a configuration substantially identical or similar to that of the stage STk shown in FIG. 23, except the configuration of a second driving controller 125. The second driving controller 125 may have a configuration similar to that of the second driving controller 120B shown FIG. 8.

Referring to FIGS. 16 and 26, the kth stage STk may include the first driving controller 113, the second driving controller 125, the output buffers 130A, 130B, and 130C, and the coupling controller 140.

In an exemplary embodiment, the second driving controller 125 may include the ninth transistor T9*a*, the tenth transistor T10*a*, and the eleventh transistor T11*a*.

The eleventh transistor T11*a* may be diode-coupled between the third node N3 and the carry output terminal CR that outputs the carry signal CR(k) or between the third node N3 and the first output terminal OUT1 that outputs the scan signal SC(k). Therefore, the eleventh transistor T11*a* may transfer the carry signal CR(k) or the scan signal SC(k) to the third node N3 in response to the carry signal CR(k) or the scan signal SC(k). That is, the ninth transistor T9*a*, the tenth transistor T10*a*, and the eleventh transistor T11*a* hold the voltage of the third node N3 as a predetermined voltage in response to the carry signal CR(k) or the scan signal SC(k), so that an unnecessary drain-source voltage increase of the ninth transistor T9*a* can be prevented. Thus, the output of the scan signal SC(k) can be stably ensured, and the reliability of the display device can be improved.

The exemplary driving method of the stage STk shown in FIG. 26 is identical to that shown in FIG. 24, and therefore, repetitive descriptions will be omitted to avoid redundancy.

The scan driver according to the exemplary embodiment prevents a transient increase in drain-source voltage of transistors coupled to the first driving node, stabilizes a voltage of the first driving node and a voltage of the first node, and prevents a leakage current of the first node at a high temperature, so that a scan signal can be stably output even in long-time use.

Further, the display device according to the exemplary embodiment includes the scan driver, so that the reliability of the display device can be improved. In addition, a problem can be prevented that the data voltage charging rate of a high resolution display device of 4 k UHD image quality or more is decreased.

As described above, the scan driver and the display device having the same in accordance with the exemplary embodiment of the present disclosure can include a configuration that stabilizes a change in voltage of at least one of the first node, the second node, the first driving node, the second driving node, and the sampling node, minimizes degradation of the transistors included in the stage, and prevents a leakage current of the first node at a high temperature. Thus, the first and second scan signals SC(k) and SS(k) can be stably output in the display period and the sensing period even in long time use, and the reliability of the display device can be improved.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A scan driver comprising:

a plurality of stages each configured to output a first scan signal and a second scan signal, each of the plurality of stages comprising:

a first driving controller configured to control a voltage of a first node and a voltage of a second node in response to a previous carry signal;

a second driving controller configured to control a voltage of a first driving node, based on a sensing-on signal, a next carry signal, a first control clock signal, a second control clock signal, the voltage of the first node, and a voltage of a sampling node, and control a voltage of a second driving node, based on the voltage of the sampling node and the voltage of the first driving node;

an output buffer configured to output a carry signal in response to the voltage of the first node and the voltage of the second node, and output the first scan signal and the second scan signal in response to the voltage of the first driving node and the voltage of the second driving node; and a coupling controller configured to electrically couple the first node and the first driving node to each other and electrically couple the second node and the second driving node to each other, in response to a display-on signal, wherein:

the second driving controller is configured to maintain the voltage of the first driving node as a gate-off voltage in response to the voltage of the second driving node and a third control clock signal;

the previous carry signal refers to a carry signal from a previous stage;

the next carry signal refers to a carry signal from a next stage;

the second driving controller includes a fourteenth transistor and a fifteenth transistor coupled in series between a carry output terminal outputting the carry signal and the first driving node;

a gate electrode of the fourteenth transistor receives the third control clock signal; and a gate electrode of the fifteenth transistor is coupled to the second driving node.

2. The scan driver of claim 1, configured to receive a gate-on voltage as the third control clock signal in a vertical blank period, and maintained until a partial period of a display period continued to the vertical blank period.

3. The scan driver of claim 1, wherein the second driving controller is configured to maintain a gate-off voltage to the first driving node in response to the fourteenth and fifteenth transistors being turned on.

4. The scan driver of claim 1, wherein the second driving controller comprises:

at least one eighth transistor coupled between an input terminal to which the next carry signal is applied and the sampling node, the at least one eighth transistor comprising a gate electrode receiving the sensing-on signal;

a ninth transistor and a tenth transistor coupled in series between a first control clock terminal to which the first control clock signal is applied and the first driving node; and an eleventh transistor coupled between the carry output terminal and a third node between the ninth and tenth transistors, the eleventh transistor comprising a gate electrode coupled to the carry output terminal.

5. The scan driver of claim 4, wherein a gate electrode of the ninth transistor is coupled to the sampling node, and a gate electrode of the tenth transistor is coupled to a second control clock terminal to which the second control clock signal is applied.

6. The scan driver of claim 5, wherein the second control clock signal has a gate-on voltage in at least a portion of a vertical blank period, and maintains a gate-off voltage during a display period.

7. The scan driver of claim 6, wherein the entire gate-on voltage period of the second control clock signal overlaps with at least a portion of a gate-on voltage period of the first control clock signal.

8. The scan driver of claim 4, wherein gate electrodes of the ninth and tenth transistors are commonly coupled to the sampling node.

9. The scan driver of claim 4, wherein the at least one eighth transistor comprises a plurality of eighth transistors coupled in series between the input terminal and the sampling node, wherein gate electrodes of the plurality of eighth transistors commonly receive the sensing-on signal.

10. The scan driver of claim 9, wherein the second driving controller further comprises: a twenty-seventh transistor coupled between a first power terminal to which a first power source is supplied and a common node between the plurality of eighth transistors, the twenty-seventh transistor comprising a gate electrode coupled to the sampling node.

11. The scan driver of claim 1, wherein the second driving controller further comprises:

a capacitor coupled between a second power terminal to which a second power source is applied and the sampling node;

a twelfth transistor and a thirteenth transistor coupled in series between a third power terminal to which a third power source is applied and the second driving node; and a twenty-fifth transistor coupled between a first power terminal to which a first power source is supplied and an intermediate node between the twelfth transistor and the thirteenth transistor, the twenty-fifth transistor comprising a gate electrode coupled to the second driving node, wherein the twelfth transistor comprises a gate electrode coupled to the sampling node, and the thirteenth transistor comprises a gate electrode coupled to the first driving node.

12. The scan driver of claim 1, wherein the first driving controller comprises:

a first transistor coupled between a first power terminal to which a first power source is applied and the first node, the first transistor comprising a gate electrode receiving the previous carry signal or a scan start signal;

a second transistor and a third transistor coupled in series between the first node and the carry output terminal;

a fourth transistor coupled between the first node and the carry output terminal, the fourth transistor comprising a gate electrode receiving the next carry signal;

at least one fifth transistor coupled between a first clock terminal to which a first clock signal is applied and the second node, the at least one fifth transistor comprising a gate electrode coupled to the first node;

a sixth transistor coupled between the first power terminal and the second node, the sixth transistor comprising a gate electrode coupled to the first clock terminal; and a seventh transistor coupled between the first power terminal and the second node.

13. The scan driver of claim 12, wherein the seventh transistor comprises a gate electrode receiving the first control clock signal.

14. The scan driver of claim 12, wherein the at least one fifth transistor comprises a plurality of fifth transistors coupled in series between the first clock terminal and the second node, wherein gate electrodes of the plurality of fifth transistors are commonly coupled to the first node, wherein the first driving controller further comprises:

a twenty-fourth transistor coupled between the first power terminal and a common node between the plurality of fifth transistors, the twenty-fourth transistor comprising a gate electrode coupled to the second node.

15. The scan driver of claim 1, wherein the output buffer comprises:

a sixteenth transistor coupled between a second clock terminal to which a clock signal is supplied and the carry output terminal, the sixteenth transistor comprising a gate electrode coupled to the first node;

a seventeenth transistor coupled between a second power terminal to which a second power source is applied and the carry output terminal, the seventeenth transistor comprising a gate electrode coupled to the second node;

an eighteenth transistor coupled between the second clock terminal and a first output terminal outputting the first scan signal, the eighteenth transistor comprising a gate electrode coupled to the first driving node;

a nineteenth transistor coupled between a third power terminal to which a third power source is supplied and the first output terminal, the nineteenth transistor comprising a gate electrode coupled to the second driving node;

a twentieth transistor coupled between a sensing clock terminal to which a sensing clock signal is applied and a second output terminal outputting the second scan signal, the twentieth transistor comprising a gate electrode coupled to the first driving node; and a twenty-first transistor coupled between the third power terminal and the second output terminal, the twenty-first transistor comprising a gate electrode coupled to the second driving node.

16. The scan driver of claim 1, wherein the coupling controller comprises:

a twenty-second transistor coupled between the first node and the first driving node, the twenty-second transistor comprising a gate electrode receiving the display-on signal; and a twenty-third transistor coupled between the second node and the second driving node, the twenty-third transistor comprising a gate electrode receiving the display-on signal.

17. A display device comprising:

a plurality of pixels respectively coupled to first scan lines, second scan lines, sensing lines, and data lines;

a scan driver comprising a plurality of stages to supply a first scan signal and a second scan signal respectively to the first scan lines and the second scan lines;

a data driver configured to supply a data signal to the data lines; and a compensator configured to generate a compensation value for compensating for degradation of the pixels, based on sensing values provided from the sensing lines, wherein:

each of the plurality of stages comprises:

a first driving controller configured to control a voltage of a first node and a voltage of a second node in response to a previous carry signal;

a second driving controller configured to control a voltage of a first driving node, based on a sensing-on signal, a next carry signal, a first control clock signal, a second control clock signal, the voltage of the first node, and a voltage of a sampling node, and control a voltage of a second driving node, based on the voltage of the sampling node and the voltage of the first driving node;

an output buffer configured to output a carry signal in response to the voltage of the first node and the voltage of the second node, and output the first scan signal and the second scan signal in response to the voltage of the first driving node and the voltage of the second driving node; and a coupling controller configured to electrically couple the first node and the first driving node to each other and electrically couple the second node and the second driving node to each other, in response to a display-on signal;

the second driving controller is configured to maintain the voltage of the first driving node as a gate-off voltage in response to the voltage of the second driving node and a third control clock signal;

the previous carry signal refers to a carry signal from a previous stage;

the next carry signal refers to a carry signal from a next stage;

the second driving controller comprises a fourteenth transistor and a fifteenth transistor coupled in series between a carry output terminal outputting the carry signal and the first driving node;

a gate electrode of the fourteenth transistor receives the third control clock signal;

a gate electrode of the fifteenth transistor is coupled to the second driving node; and the display device is configured to change the third control clock signal to a gate-on voltage in a vertical blank period, and to maintain the gate-on voltage until a partial period of a display period continued to the vertical blank period.

18. A scan driver for a display device, the scan driver comprising:

a plurality of stages to output scan signals and sensing signals, at least one of the stages comprising:

a first driving controller to control a voltage of a first node and a voltage of a second node in response to a previous carry signal or a scan start signal;

a second driving controller to control a voltage of a first driving node, based on a sensing-on signal, a next carry signal, a voltage of a first power source, the voltage of the first node, and a voltage of a sampling node, and to control a voltage of a second driving node, based on the voltage of the sampling node and a control clock signal;

an output buffer to output a carry signal in response to the voltage of the first node and the voltage of the second node, and to output the scan signal and the sensing signal in response to the voltage of the first driving node and the voltage of the second driving node; and a coupling controller to electrically couple the first node and the first driving node to each other and to electrically couple the second node and the second driving node to each other, in response to a display-on signal, wherein the first driving controller comprises:

a first transistor coupled between a first power terminal to which the first power source is applied and the first node, the first transistor comprising a gate electrode that receives the previous carry signal or the scan start signal;

second and third transistors coupled in series between the first node and a carry output terminal that outputs the carry signal;

a fourth transistor coupled between the first node and the carry output terminal, the fourth transistor comprising a gate electrode that receives the next carry signal;

a fifth transistor coupled between a first clock terminal to which a clock signal is applied and the second node, the fifth transistor comprising a gate electrode coupled to the first node;

a sixth transistor coupled between the first power terminal to which the first power source is applied and the second node, the sixth transistor comprising a gate electrode coupled to the first clock terminal; and a seventh transistor diode-coupled between the first power terminal and the second node.

19. The scan driver of claim 18, wherein the second driving controller comprises:

an eighth transistor coupled between a first input terminal to which the next carry signal is applied and the sampling node, the eighth transistor comprising a gate electrode that receives the sensing-on signal;

a ninth transistor and a tenth transistor coupled in series between a control clock terminal to which the control clock signal is applied and the first driving node, the ninth and tenth transistors comprising gate electrodes commonly coupled to the sampling node; and an eleventh transistor coupled between the carry output terminal of the carry signal and a third node between the ninth and tenth transistors, the eleventh transistor comprising a gate electrode coupled to the first driving node, and wherein the eleventh transistor is configured to supply the carry signal to the third node in response to the voltage of the first driving node.

20. The scan driver of claim 19, wherein the second driving controller further comprises:

a capacitor coupled between a second power terminal to which a second power source is applied and the sampling node; and a twelfth transistor and a thirteenth transistor coupled in series between a third power terminal to which a third power source is applied and the second driving node, wherein the twelfth transistor comprises a gate electrode that receives the control clock signal, and the thirteenth transistor comprises a gate electrode coupled to the sampling node.

21. The scan driver of claim 19, wherein the output buffer comprises:

a sixteenth transistor coupled between a second clock terminal to which a clock signal is applied and the carry output terminal, the sixteenth transistor comprising a gate electrode coupled to the first node;

a seventeenth transistor coupled between the carry output terminal and a second power terminal to which a second power source is applied, the seventeenth transistor comprising a gate electrode coupled to the second node;

an eighteenth transistor coupled between a scan clock terminal to which a scan clock signal is applied and a first output terminal, the eighteenth transistor comprising a gate electrode coupled to the first driving node;

a nineteenth transistor coupled between a third power terminal to which a third power source is applied and the first output terminal, the nineteenth transistor comprising a gate electrode coupled to the second driving node;

a twentieth transistor coupled between a control clock terminal to which a control clock signal is applied and a second output terminal, the twentieth transistor comprising a gate electrode coupled to the first driving node; and a twenty-first transistor coupled between the third power terminal to which the third power source is applied and the second output terminal, the twenty-first transistor comprising a gate electrode coupled to the second driving node.

22. The scan driver of claim 21, wherein the scan clock signal and the sensing clock signal have the same waveform synchronized with the clock signal.

23. The scan driver of claim 18, wherein the second driving controller comprises:

an eighth transistor coupled between an input terminal to which the next carry signal is applied and the sampling node, the eighth transistor comprising a gate electrode that receives the sensing-on signal;

a ninth transistor coupled between a third node between the ninth transistor and a tenth transistor and the first driving node, the ninth transistor comprising a gate electrode coupled to a first control clock terminal to which a first control clock signal is applied;

the tenth transistor coupled between a second control clock terminal to which a second control clock signal is applied and the third node, the tenth transistor comprising a gate electrode coupled to the sampling node;

an eleventh transistor coupled between the first power terminal and the third node, the eleventh transistor comprising a gate electrode coupled to the first driving node; and a third capacitor coupled between a second power terminal to which a second power source is applied and the sampling node.

24. The scan driver of claim 23, wherein the ninth transistor is operable to supply, to the first driving node, the voltage of the first power source, which is applied through the eleventh transistor when the first control clock signal is supplied.

25. The scan driver of claim 23, wherein the second driving controller further comprises:

twelfth and thirteenth transistors coupled in series between a third power terminal to which a third power source is applied and the second driving node, wherein the twelfth transistor comprises a gate electrode that receives the second control clock signal, and the thirteenth transistor comprises a gate electrode coupled to the sampling node.

26. The scan driver of claim 23, wherein the second driving controller further comprises a fifth capacitor coupled between the gate electrode of the eighth transistor and the sampling node.

27. The scan driver of claim 23, wherein the second driving controller further comprises a twenty-seventh transistor diode-coupled between the first power terminal to which the first power source is applied and the sampling node.

28. The scan driver of claim 18, wherein the second driving controller comprises:

an eighth transistor coupled between an input terminal to which the next carry signal is applied and the sampling node, the eighth transistor comprising a gate electrode that receives the sensing-on signal;

ninth and tenth transistors coupled in series between a control clock terminal to which the control clock signal is applied and the first driving node, the ninth and tenth transistors comprising gate electrodes commonly coupled to the sampling node; and an eleventh transistor coupled between the first power terminal and a third node between the ninth and tenth transistors, the eleventh transistor comprising a gate electrode coupled to the first driving node.

29. The scan driver of claim 18, wherein the second driving controller comprises:

an eighth transistor coupled between an input terminal to which the next carry signal is applied and the sampling node, the eighth transistor comprising a gate electrode that receives the sensing-on signal;

ninth and tenth transistors coupled in series between a control clock terminal to which the control clock signal is applied and the first driving node, and the ninth and tenth transistors comprising gate electrodes commonly coupled to the sampling node; and an eleventh transistor diode-coupled between the carry output terminal and a third node between the ninth and tenth transistors, or between the third node and an output terminal that outputs the scan signal.

30. The scan driver of claim 18, wherein the first driving controller further comprises a twenty-sixth transistor coupled between the gate electrode of the fifth transistor and the first node, the twenty-sixth transistor comprising a gate electrode coupled to the first power terminal.

31. The scan driver of claim 18, wherein the coupling controller comprises:

a twenty-second transistor coupled between the first node and the first driving node, the twenty-second transistor comprising a gate electrode that receives the display-on signal; and a twenty-third transistor coupled between the second node and the second driving node, the twenty-third transistor comprising a gate electrode that receives the display-on signal.

* * * * *